US005725044A

United States Patent [19]

Hirokawa

[11] Patent Number: 5,725,044

[45] Date of Patent: Mar. 10, 1998

[54] CASTING METHOD USING A FORMING DIE

[76] Inventor: Koji Hirokawa, 1053, Ota-Machi, Isesaki-shi, Gunma-ken, Japan

[21] Appl. No.: 519,170

[22] Filed: Aug. 25, 1995

[30] Foreign Application Priority Data

| | | | |
|---|---|---|---|
| Aug. 30, 1994 | [JP] | Japan | 6-205543 |
| Sep. 26, 1994 | [JP] | Japan | 6-229962 |
| Oct. 4, 1994 | [JP] | Japan | 6-240352 |
| Mar. 20, 1995 | [JP] | Japan | 7-060967 |
| Mar. 29, 1995 | [JP] | Japan | 7-071645 |
| Apr. 18, 1995 | [JP] | Japan | 7-092807 |

[51] Int. Cl.[6] ..... B22D 29/00; B22C 1/00

[52] U.S. Cl. ..... 164/131; 164/132; 164/138

[58] Field of Search ..... 164/131, 132, 164/369, 120, 138

[56] References Cited

U.S. PATENT DOCUMENTS

| | | | |
|---|---|---|---|
| 2,454,819 | 11/1948 | Leipzig . | |
| 4,573,519 | 3/1986 | Donomoto et al. | 164/131 |
| 4,691,756 | 9/1987 | Suzuki et al. | 164/361 |
| 4,712,600 | 12/1987 | Hamajima et al. | 164/97 |
| 5,303,761 | 4/1994 | Flessner et al. | 164/15 |
| 5,318,091 | 6/1994 | Pavoni et al. . | |
| 5,355,933 | 10/1994 | Voss | 164/132 |
| 5,566,742 | 10/1996 | Nemoto | 164/132 |

FOREIGN PATENT DOCUMENTS

| | | | |
|---|---|---|---|
| 0006721 | 1/1980 | European Pat. Off. . | |
| 0166228 | 1/1986 | European Pat. Off. . | |
| 0257425 | 3/1988 | European Pat. Off. . | |
| 0309378 | 3/1989 | European Pat. Off. . | |
| 0347627 | 12/1989 | European Pat. Off. . | |
| 2332055 | 1/1974 | Germany . | |
| 2843688 | 10/1979 | Germany . | |
| 4325562 | 5/1994 | Germany | 164/369 |
| 54-60220 | 5/1979 | Japan | 164/132 |
| 61-293646 | 12/1986 | Japan | 164/132 |
| 5-192762 | 8/1993 | Japan | 164/131 |
| 6-87052 | 3/1994 | Japan . | |
| 6-87063 | 3/1994 | Japan . | |
| 6-87064 | 3/1994 | Japan . | |
| 6-91345 | 4/1994 | Japan . | |
| 6-91346 | 4/1994 | Japan . | |
| 6-91565 | 4/1994 | Japan . | |
| 6-99247 | 4/1994 | Japan . | |
| 6-99436 | 4/1994 | Japan . | |
| 6-122037 | 5/1994 | Japan . | |
| 6-126376 | 5/1994 | Japan . | |
| 6-198388 | 7/1994 | Japan . | |
| 0629291A | 10/1994 | Japan . | |
| 06328195A | 11/1994 | Japan . | |
| 07001079A | 1/1995 | Japan . | |
| 07001080A | 1/1995 | Japan . | |
| 07003997A | 1/1995 | Japan . | |
| 5597706 | 6/1977 | U.S.S.R. | 164/132 |
| 1199673 | 7/1970 | United Kingdom . | |
| 1574634 | 9/1980 | United Kingdom . | |
| 2156720 | 10/1985 | United Kingdom . | |
| 2269771 | 2/1994 | United Kingdom | 164/132 |
| WO89/09106 | 10/1989 | WIPO . | |

*Primary Examiner*—Joseph J. Hail, III
*Assistant Examiner*—I.-H. Lin
*Attorney, Agent, or Firm*—Jacobson, Price, Holman & Stern, PLLC

[57] ABSTRACT

A plastic forming die for formation of outer surface is set on the inner surface of a cavity of a die. The forming die has a forming die body in a square barrel shape, and there are a lot of through holes provided between mount surfaces and inner side surfaces of the forming die body. Grooves communicating with the through holes are provided in the mount surfaces. When a molten metal is injected into the cavity, the through holes of the forming die body form outwardly projecting portions of a cast product. The forming die is then melted to be removed from the cast product.

24 Claims, 39 Drawing Sheets

CASTING METHOD USING A FORMING DIE

BACKGROUND OF THE INVENTION

The present invention relates to a forming die, a casting method using the forming die, a core, and a casting method using the core.

In a general procedure for producing an aluminum cast product using the diecasting method or the like, molten aluminum is poured into a die, and in this case the shape of the outer surface of the aluminum cast product is formed by the inner surface of a cavity of the die. When the shape of the outer surface of the aluminum cast product is flat or simple, the shape of the outer surface of the aluminum cast product can be easily formed by the inner surface of the cavity of the die.

When the outer surface of the aluminum cast product has a predetermined shape, the shape of the inner surface of the cavity is formed so as to match with a contour of the cast product.

For such cases that the outer surface of the aluminum cast product was desired to be finished in a more complicated shape, a conventional practice was such that after the aluminum cast product was once cast by a die, the outer surface of the aluminum cast product was finished in a desired shape of outer surface by grinding or cutting.

With the grinding or cutting for the aluminum cast product, the working efficiency, however, drops because of an increase of steps thereof. Further, there are cases that a desired shape of outer surface cannot be achieved even by grinding or cutting.

On the other hand, the shape of the inner surface of aluminum is formed by a core. A sand core is generally used as the core, but handling of the sand core is complicated and troublesome.

SUMMARY OF THE INVENTION

The present invention has been accomplished taking the above points into account, and an object of the invention is to provide a forming die, and a casing method using the forming die, a core, and a casting method using the core, by which a cast product having a desired shape of outer surface can be easily and simply cast without applying grinding or cutting, and by which a cast product having a desired shape of inner surface can be easily and simply cast.

A first feature of the present invention is a forming die for formation of outer surface, which is mounted on at least a part of an inner surface of a cavity of a casting die and which forms an outer surface of a cast product cast by the casting die.

A second feature of the present invention is a combination of a forming die with a die, comprising: a casting die having a cavity; and a forming die for formation of outer surface, which is mounted on at least a part of an inner surface of the cavity of the casting die and which forms an outer surface of a cast product cast by the casting die.

A third feature of the present invention is a casting method using a forming die for formation of outer surface, comprising: a step of setting the forming die for formation of outer surface, which forms an outer surface of a cast product, on an inner surface of a cavity of a casting die; a step of pouring a molten metal into the cavity of the casting die to form the cast product; and a step of taking the cast product and the forming die out of the die.

A fourth feature of the present invention is a cast product comprising a case body in which an inner space is formed opening one side thereof, and a lot of outwardly projecting portions projecting outwardly on side surfaces of the case body.

A fifth feature of the present invention is a casting method using a forming die for formation of outer surface, comprising: a step of setting the forming die for formation of outer surface containing an organic material, on an inner surface of a cavity of a casting die; a step of pouring a molten metal into the cavity of the casting die to form a cast product; a step of taking the cast product and the forming die out of the die; and a step of subjecting the cast product and the forming die to a salt bath treatment in a molten salt to decompose the organic material in the forming die into sludge of inorganic materials, and gas.

A sixth feature of the present invention is a core, which is mounted in a cavity of a casting die and which forms an inner surface of a cast product cast by the casting die, and the core is made of a thermosetting resin.

A seventh feature of the present invention is a core, which is mounted on a cavity of a casting die and which forms an inner surface of a cast product cast by the casting die, and the core is made of a thermoplastic resin.

An eighth feature of the present invention is a core, which is mounted in a cavity of a casting die and which forms an inner surface of a cast product cast by the casting die, and the core is made of a heat-resistant inorganic material bound with an adhesive organic material.

A ninth feature of the present invention is a core, which is mounted in a cavity of a casting die and which forms an inner surface of a cast product cast by the casting die, and the core is hollow as opening one side thereof.

A tenth feature of the present invention is a core, which is mounted in a cavity of a casting die and which forms an inner surface of a cast product cast by the casting die, and a surface of the core is coated with copper plating and a solder coating is formed on the copper plating.

An eleventh feature of the present invention is a casting method using a core, comprising: a step of setting a forming die for formation of outer surface containing an organic material and a core containing an organic material, in a cavity of a casting die; a step of pouring a molten metal into the cavity of the casting die to form a cast product; a step of taking the cast product, the forming die, and the core out of the casting die; and a step of subjecting the cast product, the forming die, and the core to a salt bath treatment in a molten salt to decompose the organic materials in the forming die and the core into sludge of inorganic materials, and gas.

A twelfth feature of the present invention is a casting method using a core, comprising: a step of setting a core containing an organic material, in a cavity of a casting die; a step of pouring a molten metal into the cavity of the casting die to form a cast product; a step of taking the cast product and the core out of the die; and a step of subjecting the cast product and the core to a salt bath treatment in a molten salt to decompose the organic material in the core to sludge of inorganic materials, and gas.

A thirteenth feature of the present invention is a hollow piston for an aluminum internal combustion engine, which comprises a top wall, and a side wall opening one side thereof and having a space inside thereof, and which has a circular metal plate buried in the top wall.

DETAILED DESCRIPTION OF THE INVENTION

First Embodiment

Figure 1:
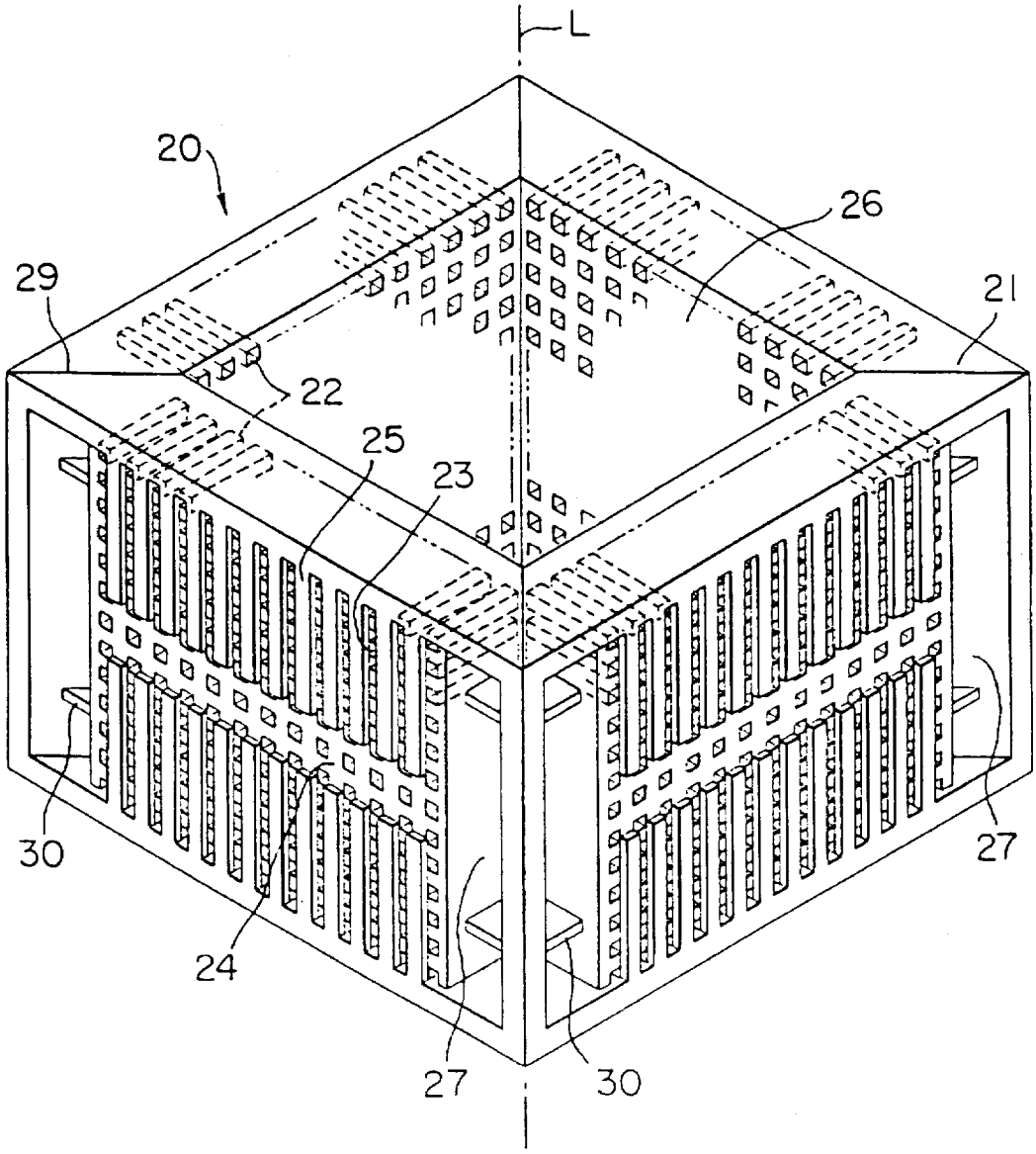
FIG. 1 is a perspective view to show a forming die in a shape of an outer surface in the first embodiment of the present invention.

A first embodiment of the present invention is described below referring to the drawings. FIG. 1 to FIG. 6 are drawings to show the first embodiment of the present invention.

Figure 2:
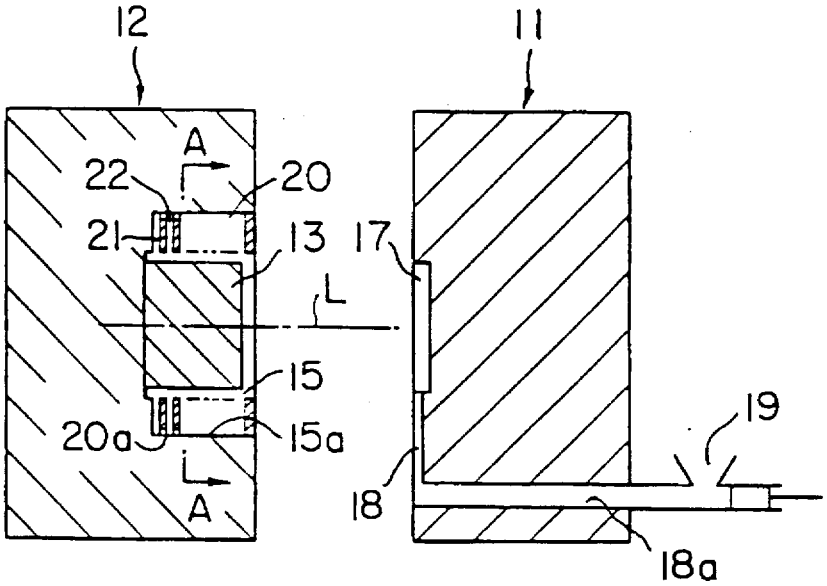
FIG. 2 is a sectional side view of a moving die and a stationary die to show a state in which the forming die is set in a cavity.
Figure 3A:
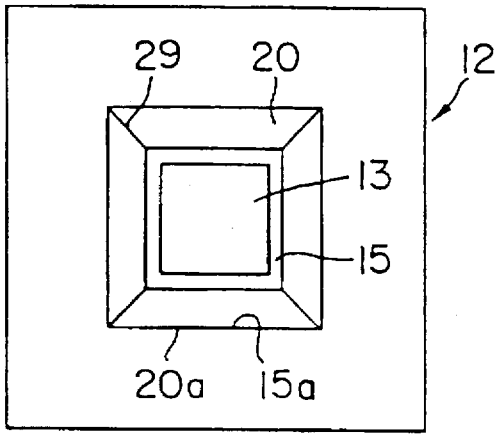
FIG. 3A is a front view to show the moving die and stationary die.
Figure 3B:
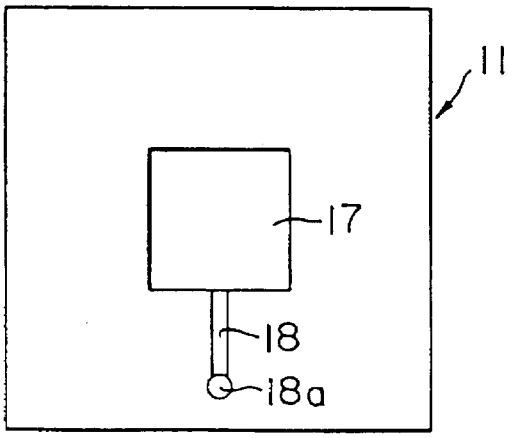
FIG. 3B is a front view to show the stationary die.

First, an aluminum diecast casting apparatus is schematically described referring to FIG. 2 and FIGS. 3A and 3B. As shown in FIG. 2 and FIGS. 3A and 3B, the aluminum diecast casting apparatus is provided with a stationary die 11 and a moving die 12 arranged as movable relative to the stationary die 11, and a cavity 15 is formed in the moving die 12. Also, the stationary die 11 is arranged so as to hermetically seal the cavity 15 in the moving die 12, and, further, a recess 17 is formed in a surface on the moving die 12 side, of the stationary die 11. This recess 17 communicates with a gate 18, and, further, the gate 18 communicates with a guide path 18*a* having an input port 19 for molten aluminum.

Figure 6:
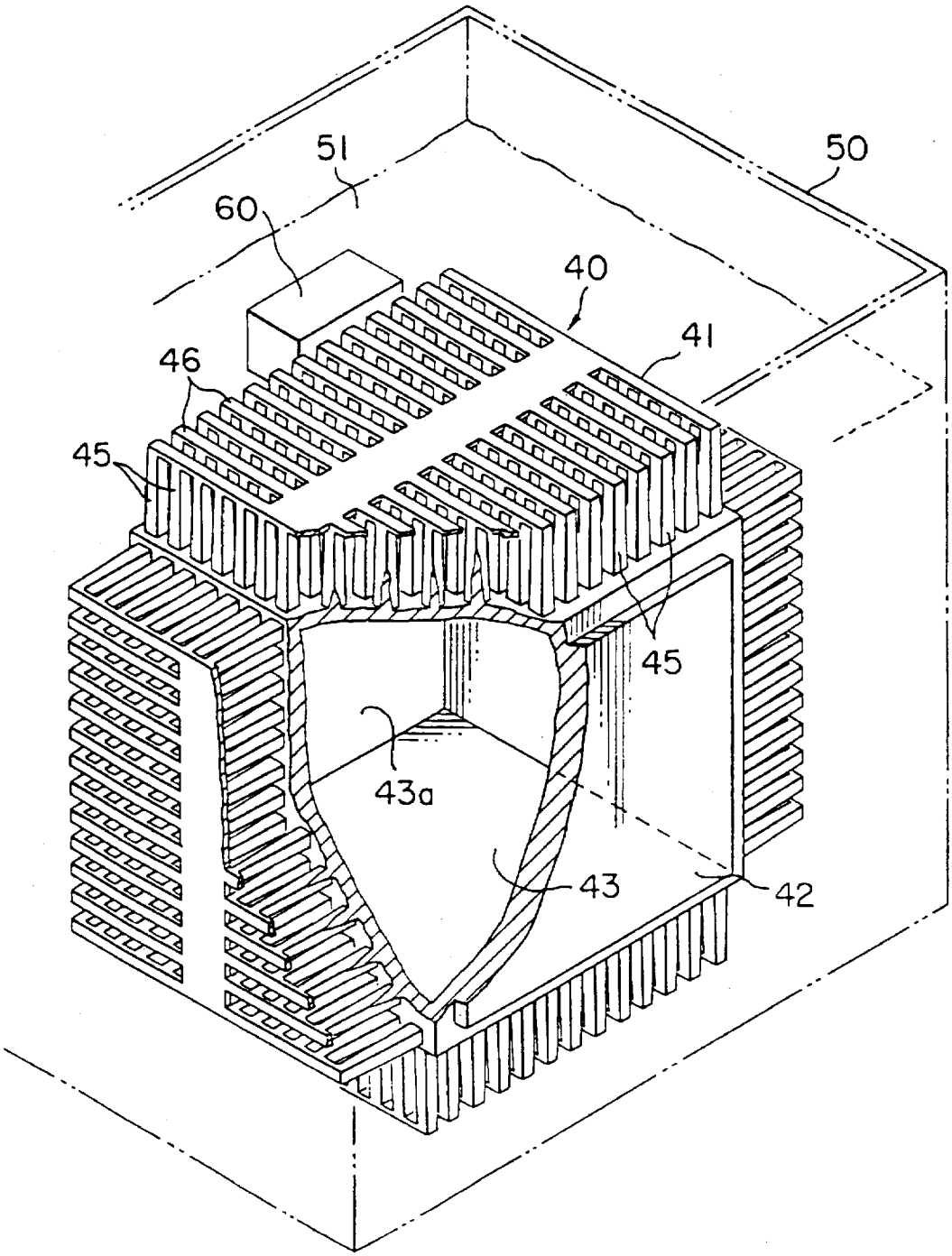
FIG. 6 is a perspective view to show an aluminum cast product.

Inside the cavity 15 in the moving die 12, a metal core 13 projects from the moving die 12, and this metal core 13 forms a space 43 in an aluminum cast product 40 as detailed later (FIG. 6). Here, the stationary die 11, moving die 12, and metal core 13 all are made of steel.

As shown in FIG. 3A and FIG. 3B, the cavity 15 in the moving die 12 is square when observed from the side of stationary die 11, and the forming die 20 for formation of outer surface, which forms the outer surface of aluminum cast product 40, is fit into the square cavity 15. In this case, the forming die 20 is formed in a shape of a square barrel corresponding to the square shape of cavity 15, and four side surfaces 20*a* of the forming die 20 become mount surfaces to come into contact with four side surfaces 15*a* of the cavity 15. FIG. 3A is a drawing of the moving die 12 as observed from the side of stationary die 11, while FIG. 3B a drawing of the stationary die 11 as observed from the side of moving die 12.

As shown in FIG. 3A, the square-barrel forming die 20 is composed of four parts connected to each other on joint surfaces 29.

Figure 4:
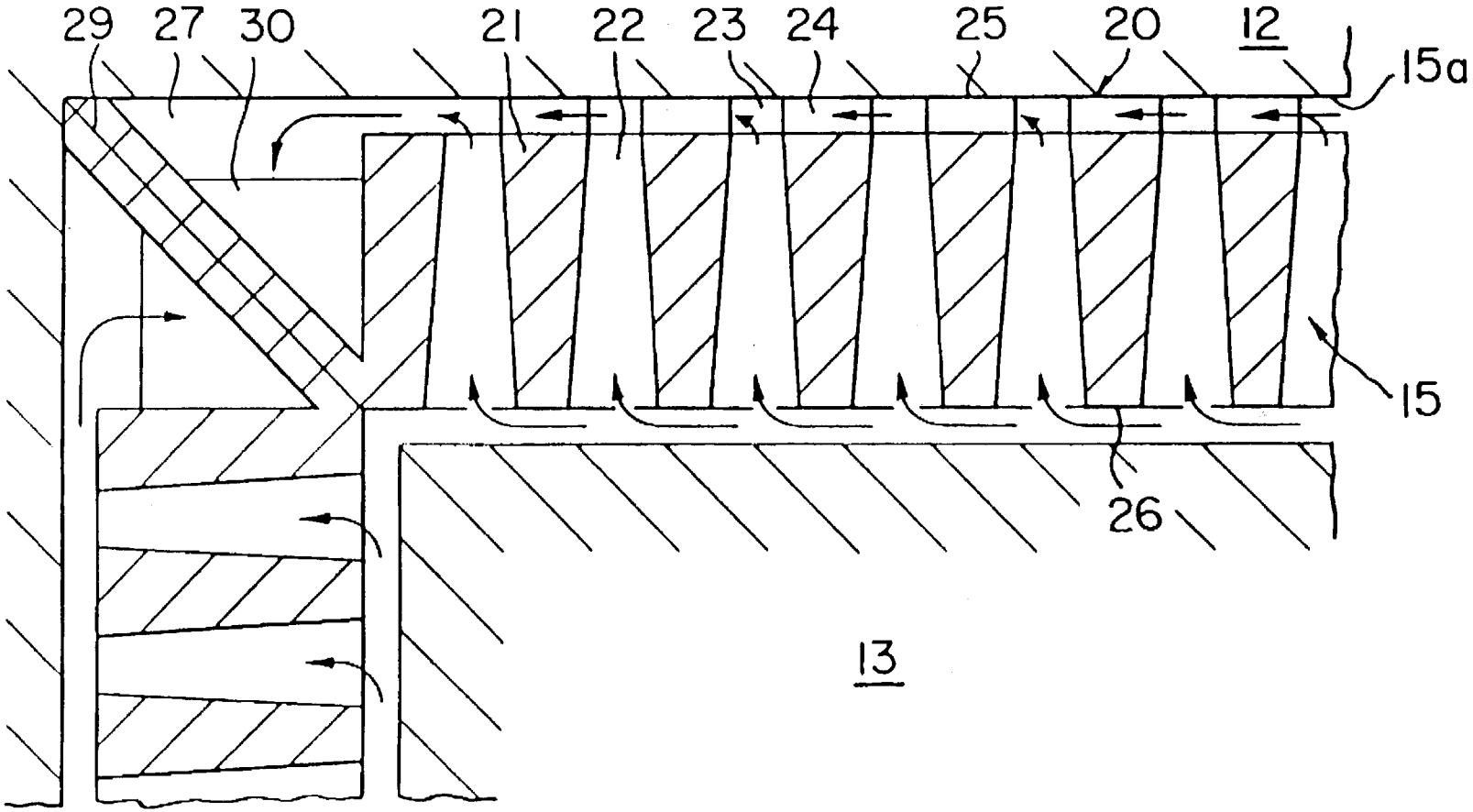
FIG. 4 is an enlarged sectional view along the direction of line A in FIG. 2.
Figure 5:
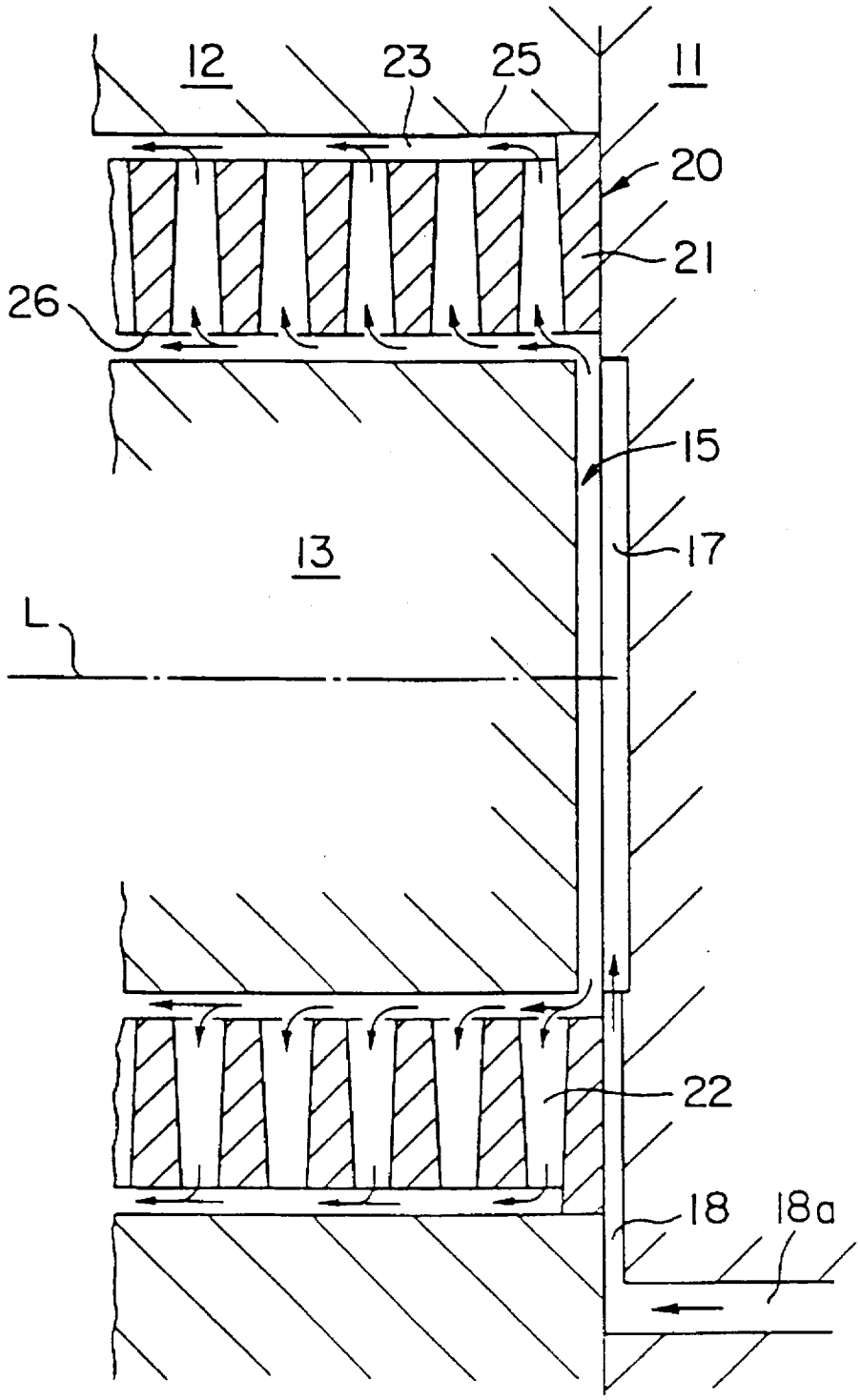
FIG. 5 is an enlarged sectional side view as seen in the same direction as in FIG. 2 to show the inside of the cavity in the moving die.

The forming die 20 for formation of outer surface is next described referring to FIG. 1, FIG. 4, and FIG. 5. As shown in FIG. 1, FIG. 4, and FIG. 5, the forming die 20 is shaped in a square barrel and is wholly made of a plastic, for example a polycarbonate.

The forming die 20 consists of a forming die body 21, and the forming die body 21 has mount surfaces 25 to contact the side surfaces 15*a* of cavity 15, and inner side surfaces 26 facing inside the cavity 15. Also, the forming die body 21 is provided with a plurality of through holes penetrating between the mount surfaces 25 and the inner side surfaces 26. Among them, the inner side surfaces 26 of the forming die body 21 form the outer surface of a case body 41 of the aluminum cast product 40 (FIG. 6), and the through holes 22 form outwardly projecting portions 45 in the aluminum cast product 40.

Further, there are grooves 23 and meeting grooves 24 formed on the mount surfaces 25 of the forming die body 21. Among them, the grooves Z3 extend in parallel with the center axis L of the square-barrel forming die 20, while the meeting grooves 24 extend perpendicular to the grooves 23. The through holes 22 penetrating the forming die body 21 are arranged in a checkerboard array in length and width in the forming die body 21, and the through holes 22 communicate with the grooves 23 provided on the mount surfaces 25 of the forming die body 21. In detail, the grooves 23 are provided every row of through holes 22, and the meeting grooves 24 extend perpendicular to the grooves 23 nearly in the central portion of the mount surfaces 25 of the forming die body 21.

In this arrangement, molten aluminum passes from inside the cavity 15 through the through holes 22 in the forming die 20 to first flow into the respective grooves 23 and thereafter to meet each other at the meeting grooves 24, then flowing into air traps 27 provided at the corners of the forming die 20. There are eight air traps 27 in total in the entire forming die 20, one each for either corner of one mount surface 25, which function to receive gas such as air inside the cavity 15 during casting. Reinforcement plates 30 for reinforcing the forming die 20 are provided at the air traps 27. Since the aluminum cast product 40 inside the air traps 27 has a lot of porosities, corresponding portions are removed after casting of the product 40.

Next described is a casting method using the forming die for formation of outer surface, constructed in the above structure.

First, as shown in FIG. 2, the plastic, square-barrel, forming die 20 is set in the cavity 15 in the moving die 12. In this case, the center axis L of the forming die 20 is coincident with the center axis of the metal core 13.

Next, the moving die 12 is moved toward the stationary die 11 before the cavity 15 of the moving die 12 is hermetically closed by the stationary die 11. In this sate, molten aluminum is put through the input port 19 into the guide path 18*a*, so that molten aluminum is injected from the guide path 18*a* through the gate 18 into the cavity 15. Molten aluminum flowing from the gate 18 into the cavity 15 is injected in a spray form, and the temperature is about 600° C.

As shown in FIG. 4 and FIG. 5, molten aluminum flowing from the gate 18 into the cavity 15 hits the metal core 13 then to flow toward the forming die 20. In the forming die 20 molten aluminum passes through the through holes from the inner side surface 26 side of the forming die body 21 toward the mount surface 25 side of the forming die body 21 so as to hit the side surfaces 15*a* of the cavityn 15 (the moving die 12). After that, molten aluminum passes inside the grooves 23 extending in parallel with the center axis L of the forming die 20 on the mount surfaces 25 and then enters the meeting grooves 24 extending perpendicular to the grooves 23. Molten aluminum is gathered by the meeting grooves 24 to flow through the meeting grooves 24 into the eight air traps 27 provided in the forming die 20.

During the flow of the molten aluminum, the gas such as air inside the cavity 15 is pushed by molten aluminum from the through holes 22 into the grooves 23 and then flows from the grooves 23 through the meeting grooves 24 into the air traps 27.

Next, molten aluminum filled in the cavity 15 is rapidly cooled by the stationary die 11 and moving die 12 to form the aluminum cast product 40.

In this case, heat transfer occurs also from molten aluminum to the polycarbonate forming die 20. However, because the thermal conductivity of polycarbonate forming die 20 is normally far smaller than that of the steel stationary die 11 and moving die 12 (for example, the thermal conductivity of polycarbonate is $4.6\times10^{-4}$ cal/s° cm°C. while the thermal conductivity of iron is 0.18 cal/scm° cm°C.), an amount of heat transfer from molten aluminum to the forming die 20 becomes extremely small. Thus, the polycarbonate forming die 20 is not melted during casting, and the aluminum cast product 40 excellent in accuracy of shape can be formed accordingly.

The forming die 20 will not be melted even with slow escape of heat from a thick portion of the aluminum product, if the surface of the forming die 20 corresponding to the thick portion of aluminum cast product 40 is coated with very-high-temperature-resistant silicone rubber not shown.

Next, the moving die 12 is separated from the stationary die 11, and the aluminum cast product 40 and forming die 20 are taken together out of the cavity 15 formed in the moving die 12.

As shown in FIG. 6, the aluminum product 40 is immersed together with the forming die 20 in a solvent 51 in a container 50. In FIG. 6, the aluminum product 40 is shown without the forming die 20 for convenience sake. Immersing the aluminum cast product 40 and forming die 20 in the solvent 51 as described, the polycarbonate forming die 20 can be dissolved in the solvent 51 to be removed. Also, setting a supersonic generator 60 in the solvent 51 in the container 50, supersonic waves can be generated in the solvent 51, whereby the forming die 20 can be dissolved and removed more quickly.

The solvent for dissolving to remove the polycarbonate forming die 20 is one selected from the following hydrocarbon solvents.

Methylene chloride (dichloromethane or methylene chloride), NMP (N-methyl-2-olefin), DMP (NN-dimethylformamide), MFK (methyl ethyl ketone), ethyl acetate (ester).

As shown in FIG. 6, the aluminum cast product 40 is used as a heat radiation case in which an electric component or the like (not shown) is set and which radiates heat generated by the electric component to the outside, but it can also be used for other purposes. The aluminum cast product 40 has the case body 41 inside which the space 43 is formed opening at one side 43*a*, and a lot of outwardly projecting portions 45 project outwardly from the case body 41 on four side surfaces of the case body 41. A projection 42 slightly projecting to the outside is provided on the bottom of the case body 41.

Among them, the space 43 in the case body 41 is formed by the metal core 13, while the outer surface of the case body 41 (the base surface of the outwardly projecting portions 45) is formed by the inner side surfaces 26 of the forming die 20. Also, a lot of outwardly projecting portions 45 projecting from the case body 41 are formed by the through holes 22 in the forming die 20, and further, the projection 42 on the bottom portion of the case body 41 is formed by the recess 17 in the stationary die 11.

Further, the outwardly projecting portions 45 are connected to each other at distal ends thereof by connection plates 46, and the connection plates 46 are formed by the grooves 23 and meeting grooves 24 in the forming die 20.

After that, the connection plates 46 may be ground with necessity, and by grinding the connection plates 46, cast parts in the connection plates 46 and air traps 27 can be removed. In another case, where the connection plates 46 are not ground, the outwardly projecting portions 45 are reinforced by the connection plates 46 with regard to the strength. Even in the case where the connection plates 46 are not ground, the cast parts in the air traps 27 are removed because there are porosities therein.

According to the present embodiment as described, the forming die 20 can be dissolved and removed from the aluminum cast product 40 simply by immersing the aluminum cast product 40 together with the forming die 20 into the solvent 51 after casting of the aluminum cast product 40 using the polycarbonate forming die 20. Thus, the aluminum cast product 40 can be easily and simply obtained in a complicated shape of outer surface having a lot of outwardly projecting portions 45 on the four side surfaces of case body 41, without grinding or cutting.

A modification of the present invention is next described. The above embodiment showed the forming die 20 shaped in the square barrel in contact with the four side surfaces of cavity 15, but without a need to be limited to this, a quarter of the square-barrel forming die split on the borders of joint surfaces 29 may be used mounting it only on one side surface of cavity 15. In this case, the forming die 20 is mounted through one mount surface on the one side surface of cavity 15.

Also, the embodiment showed an example in which the polycarbonate forming die 20 was dissolved and removed from the aluminum cast product 40 with the solvent 51, but without a need to be limited to this, it can be removed from the aluminum cast product 40 after the aluminum cast product 40 and forming die 20 are heated together up to about 280° to 350° C. to bring the entire forming die 20 into a semi-molten state. Since polycarbonate has the softening point of about 160° C. and the melting point of 380° to 400° C., the forming die 20 becomes semi-melted by heating the forming die 20 and the aluminum cast product 40 together up to 280° to 350° C., whereby the forming die 20 can be easily removed from the aluminum cast product 40. It is also possible that after the forming die 20 is removed in the semi-molten state, the forming die 20 is further removed by the solvent 51 for perfect removal.

Figure 10:
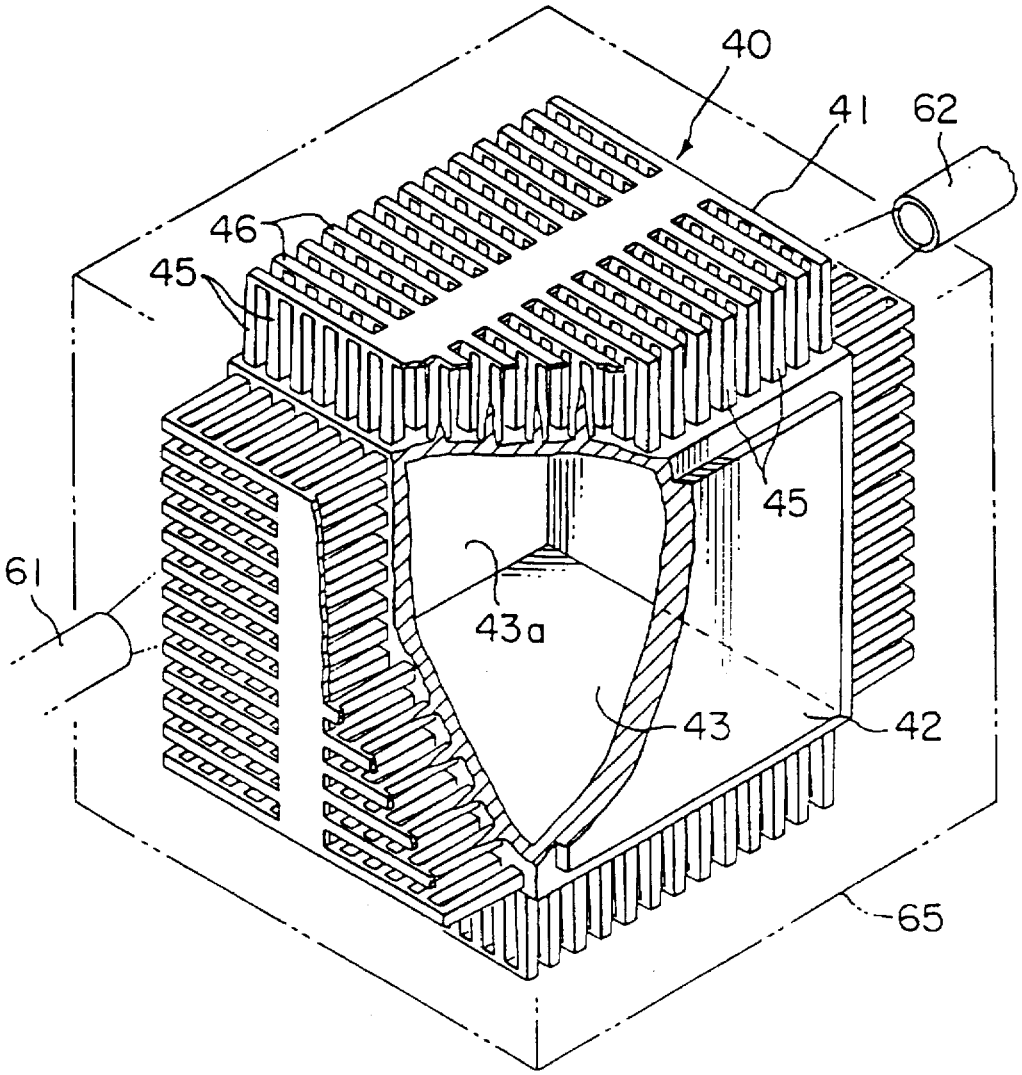
FIG. 10 is a drawing to show a state in which the forming die is being removed from the aluminum cast product.

In another arrangement, as shown in FIG. 10, the forming die 20 can be peeled off from the aluminum cast product 40 by shot blast. In this case, a shot blast apparatus 61 is set close to the aluminum cast product 40 and forming die 20 and then a lot of shots are ejected (blasted) onto the outer surface of the aluminum cast product 40. Then the polycarbonate forming die 20 is peeled off by the thus ejected shots to be removed.

During the shot blast operation with the shot blast apparatus, the aluminum cast product 40 may be heated up to about 200° C., whereby the peeling-off removal of the forming die 40 becomes easier. The shots may be aluminum powder, glass powder, silica powder, graphite powder, salt powder, or anti-rust metal powder.

Further, the forming die 20 may be peeled off and removed from the aluminum cast product 40 by high-temperature and high-pressure steam. In this case, a steam spraying apparatus 62 is set close to the outer surface of the aluminum cast product and then high-temperature and high-pressure steam (for example steam at 300° C. to 500° C.) is sprayed through a nozzle of the steam spraying apparatus. The thus sprayed steam peels off the polycarbonate forming die 20, thus removing it.

Furthermore, as shown in FIG. 10, the forming die 20 may be removed from the cast product 40 in a furnace 65 as heating the aluminum cast product 40 and the forming die 20 to about 400° C. in the furnace 65 shown by the doubled-dashed chain line to melt the forming die 20 completely. In this case, the shot blast apparatus 61 and the steam spraying apparatus 62 become unnecessary in FIG. 10.

The above embodiment showed an example in which the forming die 20 was made of polycarbonate, but without a need to be limited to it, the forming die 20 may be one which is constructed of a thermoplastic inner resin and a heat-resistant resin covering the entire surface of the inner resin.

In this case, the thermoplastic inner resin may be selected from fluororesins (polyfluoroethylene resins) such as ethylene tetrafluoride, polyimide resins, polyamideimide resins, polysulfone resins, vinyl chloride resins, polyamide resins (nylon resins), polypropylene resins, polyethylene resins, polyester resins (Tetron resins), or polysulfonic acid resins.

The heat resistant resin covering the entire surface of the inner resin may be the silicone rubber as described previously or a silicone resin.

Further, the forming die 20 may be made of a material obtained by mixing particles of a thermoplastic resin such as a polypropylene resin with particles of a heat-resistant resin such as a silicone resin and baking the mixture to harden. Also, the forming die may be made of a material obtained by mixing the polypropylene resin particles with either calcium carbonate particles, calcium sulfate particles, or calcium silicate particles and baking the mixture to harden.

Further, a biodegradable plastic may be used for the forming die 20. Here, the biodegradable plastic means a plastic which is decomposed into low-molecular-weight compounds giving no negative effects to the environment, in nature in connection with microorganisms.

The biodegradable plastic can be classified into the complete degradation type and partial degradation type. The complete degradation type plastic may include plastics of naturally-occurring polymers consisting of a complex of starch and modified polyvinyl alcohol, starch and polycaprolactone, or chitosan and cellulose; fermentation product plastics consisting of a microorganism-produced polyester or a microorganism-derived cellulose; and synthetic plastics consisting of an aliphatic polyester. The partial degradation type plastic may include plastics of a mixture of starch in polyethylene, and alloys of polycaprolactone and a general-purpose plastic.

When the biodegradable plastic forming die is used, the forming die 20 can be readily discarded after peeled off to be removed from the aluminum cast product 40 after cast.

Also, the forming die 20 may be made of paper. The paper forming die 20 may be obtained by pressurizing to dehydrate slurry pulp under a pressure of about 70 kg/cm$^2$ and thereafter drying the resultant for about 24 hours.

When the forming die 20 made of paper is used, heat transfer also occurs from molten aluminum to the forming die 20 during casting. However, because the thermal conductivity of the paper forming die 20 is generally smaller than that of the steel stationary die 11 and moving die 12, an amount of heat transfer from aluminum melt 55 to the paper forming die 20 becomes very small. Since oxygen is rare inside the cavity 15 filled with molten aluminum, the surface of the paper forming die 20 is slightly burnt during casting to be carbonized, but the forming die 20 will never be burnt, thus forming the aluminum cast product 40 excellent in accuracy of shape. Also, the insulation effect of the paper forming die 20 can prevent sudden temperature drop of aluminum, thereby preventing a strain from being caused by the temperature drop in the aluminum cast product 40. After cast, the paper forming die 20 can be burnt up to remove by heating the aluminum cast product 40 and paper forming die 20.

Furthermore, a die made of a rubber may be used as the forming die 20 in addition to the plastic one. Namely, the entire forming die 20 may be made of a rubber material.

The rubber material generally includes a natural rubber, a styrene butadiene rubber, a polyisoprene rubber, a polybutadiene rubber, a polyethylene-propyrene rubber, butyl rubber, neoprene, a acrylonitrile-butadiene rubber, or a polysulfide rubber. The entire forming die 20 is preferably made of a heat-resistant silicone rubber. The forming die made of the rubber material may be removed from the cast product 40 by heating to bring it into a molten state after casting, or it may be removed from the cast product 40 by dissolving it with a solvent. Further, the forming die 20 produced of the rubber material may be removed from the cast product 40 by shot blast treatment, or it may be removed from the cast product 40 by spraying high-temperature and high-pressure steam.

In the above embodiment the aluminum diecasting method was described as a diecasting method, but the present invention can be applied to any other diecasting method, such as the gravity diecasting method, the low pressure diecasting method, and the precision diecasting method. Further, the cast product may be not only of aluminum, but also of lead, zinc, magnesium, manganese or an alloy thereof.

As described above, according to the present invention, the cast product having a complicated shape of outer surface can be readily and simply obtained just by, after producing the cast product using the forming die, taking out the cast product and the forming die from the casting die and thereafter removing the forming die from the cast product. In this case, because the shape of the outer surface of the cast product is formed by the forming die, grinding or cutting etc. does not have to be employed for forming the complicated shape of outer surface.

Second Embodiment

A second embodiment of the present invention is next described. In the second embodiment, the forming die 20 is made of powder graphite and a plastic material, for example a polycarbonate material, for combining powder graphite with each other, but the other parts are substantially the same as those in the first embodiment shown in FIG. 1 to FIG. 6 and FIG. 10.

A method for producing such a forming die 20 is first described. The forming die 20 is produced by injection molding using a graphite-added plastic pellet material. First, production procedures of the graphite-added plastic pellet material will be described schematically.

Figure 8:
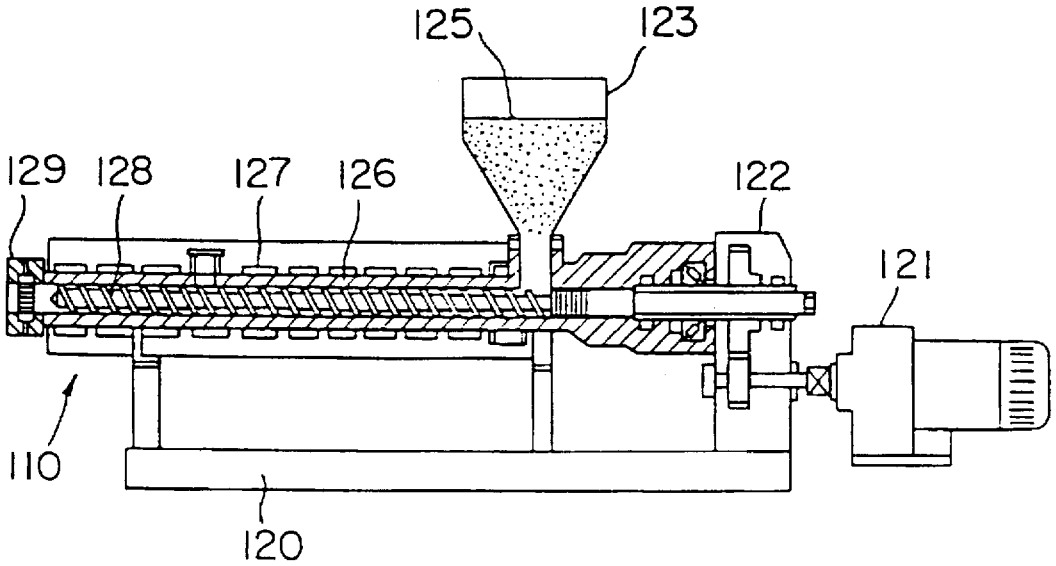
FIG. 8 is a detail drawing to show an extruder.

As shown in FIG. 8, a raw material 125 consisting of polycarbonate pellets and powder graphite is put into a hopper 123 in an extruder 110. A weight ratio between the polycarbonate pellets and powder graphite in the hopper 123 is in the range of 90:10 to 10:90 corresponding to a weight ratio of a polycarbonate component and a graphite component in a graphite-added plastic pellet material 117 as described below. Next, the raw material 125 in the hopper 123 is fed to a cylinder 126, and the raw material 125 is pressurized in the cylinder 126 with rotation of a screw 128 and heated by a heater 127.

When the raw material 125 is heated and compressed in the cylinder 126, the polycarbonate pellets melt to be mixed with powder graphite and the mixture flows out through a die 111 (FIG. 7) from a head 129 of the extruder 110.

Since graphite does not chemically react with synthetic resins under environmental conditions below 1000° C., the polycarbonate and graphite exist independently of each other while keeping respective specific properties in the mixture of polycarbonate and graphite.

Figure 7:
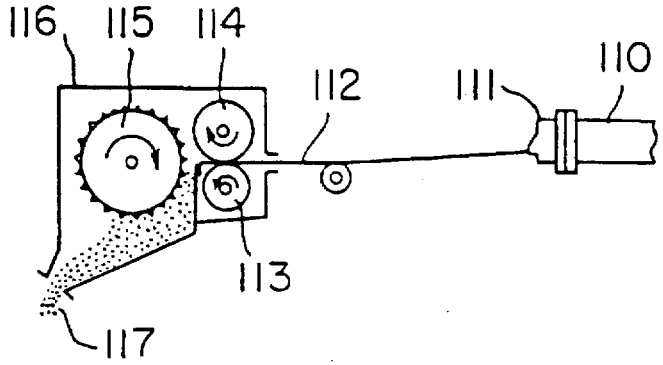
FIG. 7 is a drawing to show a method for producing a plastic pellet material containing graphite in the second embodiment of the present invention.

Next, the polycarbonate and graphite mixed in the extruder 110, as shown in FIG. 7, is fed from the die 111 to a pelletizer 116 forming a strand mixture 112. In the pelletizer 116 the strand mixture 112 is fed by feed rollers 113, 114 to a rotary knife 115, and the mixture is finely broken by the rotary knife 115 to obtain the graphite-added plastic pellet material 117 with a diameter of 1 to 2 mm.

This graphite-added plastic pellet material 117 is a mixture of the polycarbonate component and graphite component, and the weight ratio between the polycarbonate component and graphite component is in the range of 90:10 to 10:90 as described previously. If the weight ratio between the polycarbonate component and graphite component is greater than 90:10 with regard to the polycarbonate component, the releasability becomes poor for products obtained by injection molding.

If the graphite component is more than 10:90 in the weight ratio between the polycarbonate component and graphite component, the toughness becomes poor for products obtained by injection molding.

Incidentally, the combination of the polycarbonate component with the graphite component is determined as follows. If injection-molded articles are formed in a simple structure and a large volume, a combination of the polycarbonate component and graphite component is selected in the range where the volume % of graphite is relatively large, from the following table. In this case, for example, supposing a combination with the volume % of graphite being 70% is selected, 1540 g of graphite and 360 g of polycarbonate are mixed with each other. The following table shows formulations (g) of graphite and polycarbonate corresponding to each volume % of graphite when the total volume is 1000 cm$^3$.

On the other hand, if injection-molded articles are formed in a complex structure and a small volume, a combination between the polycarbonate component and graphite component is selected in the range where the volume % of graphite is relatively small.

TABLE 1

Formulation of Graphite and Polycarbonate

| Vol % of Graphite | Graphite (g) | Resin (g) |
|---|---|---|
| 0 | 0.0 | 1200.0 |
| 1 | 22.0 | 1188.0 |
| 2 | 44.0 | 1176.0 |
| 3 | 66.0 | 1164.0 |
| 4 | 88.0 | 1152.0 |
| 5 | 110.0 | 1140.0 |
| 6 | 132.0 | 1128.0 |
| 7 | 154.0 | 1116.0 |
| 8 | 176.0 | 1104.0 |
| 9 | 198.0 | 1092.0 |
| 10 | 220.0 | 1080.0 |
| 11 | 242.0 | 1068.0 |
| 12 | 264.0 | 1056.0 |
| 13 | 286.0 | 1044.0 |
| 14 | 308.0 | 1032.0 |
| 15 | 330.0 | 1020.0 |
| 16 | 352.0 | 1008.0 |
| 17 | 374.0 | 996.0 |
| 18 | 396.0 | 984.0 |
| 19 | 418.0 | 972.0 |
| 20 | 440.0 | 960.0 |
| 21 | 462.0 | 948.0 |
| 22 | 484.0 | 936.0 |
| 23 | 506.0 | 924.0 |
| 24 | 528.0 | 912.0 |
| 25 | 550.0 | 900.0 |
| 26 | 572.0 | 888.0 |
| 27 | 594.0 | 676.0 |
| 28 | 616.0 | 864.0 |
| 29 | 638.0 | 852.0 |
| 30 | 660.0 | 840.0 |
| 31 | 682.0 | 828.0 |
| 32 | 704.0 | 816.0 |
| 33 | 726.0 | 804.0 |
| 34 | 748.0 | 792.0 |
| 35 | 770.0 | 780.0 |
| 36 | 792.0 | 768.0 |
| 37 | 814.0 | 756.0 |
| 38 | 836.0 | 744.0 |
| 39 | 858.0 | 732.0 |
| 40 | 880.0 | 720.0 |
| 41 | 902.0 | 708.0 |
| 42 | 924.0 | 696.0 |
| 43 | 946.0 | 684.0 |
| 44 | 968.0 | 672.0 |
| 45 | 990.0 | 660.0 |
| 46 | 1012.0 | 648.0 |
| 47 | 1034.0 | 636.0 |
| 48 | 1056.0 | 624.0 |
| 49 | 1078.0 | 612.0 |
| 50 | 1100.0 | 600.0 |
| 51 | 1122.0 | 588.0 |
| 52 | 1144.0 | 576.0 |
| 53 | 1166.0 | 564.0 |
| 54 | 1188.0 | 552.0 |
| 55 | 1210.0 | 540.0 |
| 56 | 1232.0 | 528.0 |
| 57 | 1254.0 | 516.0 |
| 58 | 1276.0 | 504.0 |
| 59 | 1298.0 | 492.0 |
| 60 | 1320.0 | 480.0 |
| 61 | 1342.0 | 468.0 |
| 62 | 1364.0 | 456.0 |
| 63 | 1386.0 | 444.0 |
| 64 | 1408.0 | 432.0 |
| 65 | 1430.0 | 420.0 |
| 66 | 1452.0 | 408.0 |
| 67 | 1474.0 | 396.0 |
| 68 | 1496.0 | 384.0 |
| 69 | 1518.0 | 372.0 |
| 70 | 1540.0 | 360.0 |
| 71 | 1562.0 | 348.0 |
| 72 | 1584.0 | 336.0 |
| 73 | 1606.0 | 324.0 |

TABLE 1-continued

Formulation of Graphite and Polycarbonate

| Vol % of Graphite | Graphite (g) | Resin (g) |
|---|---|---|
| 74 | 1628.0 | 312.0 |
| 75 | 1650.0 | 30.0 |
| 76 | 1672.0 | 288.0 |
| 77 | 1694.0 | 276.0 |
| 78 | 1716.0 | 264.0 |
| 79 | 1738.0 | 252.0 |
| 80 | 1760.0 | 240.0 |
| 81 | 1782.0 | 228.0 |
| 82 | 1804.0 | 216.0 |
| 83 | 1826.0 | 204.0 |
| 84 | 1848.0 | 192.0 |
| 85 | 1870.0 | 180.0 |
| 86 | 1892.0 | 168.0 |
| 87 | 1914.0 | 156.0 |
| 88 | 1936.0 | 144.0 |
| 89 | 1958.0 | 132.0 |
| 90 | 1980.0 | 120.0 |
| 91 | 2002.0 | 108.0 |
| 92 | 2024.0 | 96.0 |
| 93 | 2046.0 | 84.0 |
| 94 | 2068.0 | 72.0 |
| 95 | 2090.0 | 60.0 |
| 96 | 2112.0 | 48.0 |
| 97 | 2134.0 | 36.0 |
| 98 | 2156.0 | 24.0 |
| 99 | 2178.0 | 12.0 |
| 100 | 220.0 | 0.0 |

Figure 9:
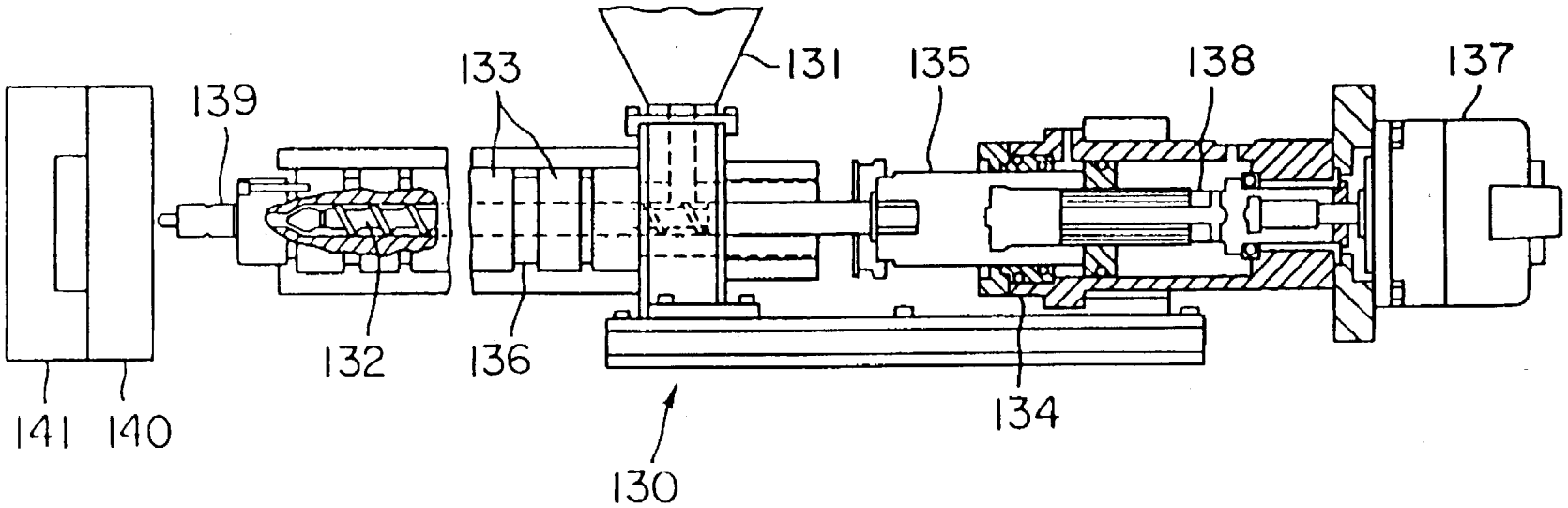
FIG. 9 is a drawing to show a method for producing the forming die.

Next described referring to FIG. 9 is a method for producing the forming die 20, using the graphite-added plastic pellet material 117 thus obtained.

As shown in FIG. 9, an injection molding machine 130 has an injection ram 135 arranged as slidable in an injection cylinder 134, and an oil hydraulic motor 137 driving to rotate the injection ram 135 through a drive shaft 138. A screw 132 is connected with the injection ram 135, and the screw 132 is set in a barrel 136. Further, the graphite-added plastic pellet material 117 is supplied from the hopper 131 to the screw 132. A nozzle 139 is provided at the distal end of screw 132, and the nozzle 139 is connected to an injection die composed of a stationary die 140 and a moving die 141.

Next described is the injection molding method of the forming die. First, the graphite-added plastic pellet material 117 is put into the hopper 131, and then the oil hydraulic motor 137 starts rotating the screw 132 through the injection ram 135. During this time, the graphite-added plastic pellet material 117 is supplied into the screw 132, whereby the polycarbonate component in the graphite-added plastic pellet material 117 is melted by the rotation of screw 132. Then the mixture in which powder graphite is mixed in the melted polycarbonate is injected through the nozzle 139 into the cavity between the stationary die 140 and moving die 141, thereby obtaining the forming die 20 made of polycarbonate and powder graphite.

Polycarbonate among the components of the forming die 20 has characteristics of excellent heat resistance and high toughness. On the other hand, powder graphite is a material of the hexagonal system and has the hardness of 1.5 and the relative density of 2.2. Graphite has excellent heat resistance and also has excellent lubricity (releasability) from the crystal structure thereof. Also, graphite has the considerable mechanical strength at high temperatures and has such a characteristic that it is soluble in neither inorganic solvents nor organic solvents.

Further, polycarbonate and graphite do not chemically react with each other as described previously, and exist with respective specific properties.

From these points, the forming die 20 made of polycarbonate and powder graphite becomes an injection-molded article excellent in heat resistance and in lubricity. In this case, out of the components of the forming die 20, polycarbonate functions to bond powder graphite to each other.

As described, the forming die 20 made of polycarbonate and powder graphite as shown in FIG. 1 is obtained.

When the forming die 20 shown in FIG. 1 is set in the cavity 15 in the moving die 12 shown in FIG. 2 and the cavity 15 is filled with molten aluminum, molten aluminum filled in the cavity 15 is rapidly cooled by the stationary die 11 and moving die 12 to form the aluminum cast product 40.

In this case, heat transfer occurs also from molten aluminum to the forming die 20 made of powder graphite and polycarbonate. However, because the thermal conductivity of the forming die 20 made of powder graphite and polycarbonate is far smaller than that of the steel stationary die 11 and moving die 12, an amount of heat transfer from molten aluminum to the forming die 20 becomes extremely small. Thus, the forming die 20 made of powder graphite and polycarbonate is never melted during casting, and the aluminum cast product 40 excellent in accuracy of shape can be formed accordingly.

Next, the moving die 12 is separated from the stationary die 11, and the aluminum cast product 40 is taken out together with the forming die 20 from the cavity 15 formed in the moving die 12.

In this case, because the forming die 20 has excellent lubricity and releasability because of the graphite component, the forming die 20 can be easily and simply taken together with the aluminum cast product 40 out of the cavity 15, while preventing a part of the forming die 20 from being deposited on or adhering to the inside of the cavity 15. Accordingly, the inside of the cavity 15 does not have to be cleaned every aluminum diecasting, whereby the aluminum diecasting can be completely automatized. Next, the aluminum cast product 40 and forming die 20 are heated at about 300° C., whereby the polycarbonate component in the forming die 20 melts partially to flow out of the outer surface of the aluminum cast product 40.

As shown in FIG. 6, the aluminum product 40 is afterward immersed together with the forming die 20 in the solvent 51 in the container 50. In FIG. 6, the aluminum product 40 is shown without the forming die 20 for convenience' sake. Thus immersing the aluminum cast product 40 and forming die 20 in the solvent 51, the remaining polycarbonate component of the forming die 20 is dissolved in the solvent 51 to be completely removed from the aluminum cast product 40. On the other hand, because the graphite component in the forming die 20 is excellent in lubricity and releasability, the graphite component is easily and simply removed from the aluminum cast product 40 to precipitate on the bottom in the solvent 51. Also, the polycarbonate component dissolved in the solvent 51 floats on the surface of solvent 51.

Because of this, the graphite component precipitating on the bottom of solvent 51 can be easily and simply separated in the solvent from the dissolved polycarbonate component floating on the surface of solvent 51, thus facilitating disposal.

Also, setting a supersonic generator 60 in the solvent 51 in the container 50, supersonic waves can be generated in the solvent 51, whereby the forming die 20 can be dissolved and removed more quickly.

According to the present embodiment as described, the forming die 20 can be dissolved and removed from the aluminum cast product 40 simply by immersing the aluminum cast product 40 together with the forming die 20 into the solvent 51 after casting of the aluminum cast product 40 using the forming die 20 made of powder graphite and polycarbonate. Thus, the aluminum cast product 40 can be easily and simply obtained in a complicated shape of outer surface having a lot of outwardly projecting portions 45 on the four side surfaces of case body 41, without grinding or cutting.

A modification of the present invention is next described. The above embodiment showed an example in which the forming die 20 was the forming die 20 made of powder graphite and polycarbonate, but without a need to be limited to this, polycarbonate may be replaced by another thermoplastic resin. In this case, the thermoplastic inner resin may be selected from fluororesins (polyfluoroethylene resins) such as ethylene tetrafluoride, polyimide resins, polyamide-imide resins, polysulfone resins, vinyl chloride resins, polyamide resins (nylon resins), polypropylene resins, polyethylene resins, polyester resins (Tetron resins), or polysulfonic acid resins.

In another modification, the forming die 20 is composed of a plurality of parts, wherein portions having a thick and simple shape among the parts are arranged to include a more graphite component but a less plastic component while portions having a thin and complex shape are arranged to include a less graphite component and a more plastic component. As in this modification, when the portions having a thick and simple shape are arranged to include a lot of the graphite component, the forming die 20 can be easily removed from the aluminum cast product 40 with a smaller amount of usage of the solvent. The above embodiment showed an example in which the forming die 20 was removed by heating the aluminum cast product 40 and forming die 20 and thereafter immersing them in the solvent 51, but the forming die 20 may be removed employing either the heating removal or the solvent removal.

The above embodiment showed an example in which the forming die 20 is composed of powder graphite and a plastic material for binding powder graphite with each other, but without a need to be limited to this, the forming die 20 may be composed of powder graphite and a rubber material for binding powder graphite with each other. The rubber material generally includes a natural rubber, a styrene butadiene rubber, a polyisoprene rubber, a polybutadiene rubber, a polyethylene-propyrene rubber, a butyl rubber, neoprene, an acrylonitrile-butadiene rubber, or a polysulfide rubber, among which a heat-resistant silicone rubber is preferably used.

In the case where the forming die 20 is made of powder graphite and the rubber material, a graphite-added rubber pellet material is first produced, and the forming die is then produced using the graphite-added rubber pellet material. The forming die 20 made of powder graphite and the rubber material may be removed from the cast product 40 by dissolving it with a solvent or by heating to bring it into a molten state, after casting.

As described above, according to the present invention, the forming die can be removed from the cast product simply by, after casting the cast product using the forming die, taking out the cast product and forming die out of the casting die and thereafter immersing the cast product and forming die in the solvent, so that even a cast product having a complex shape of outer surface can be obtained easily and simply. In this case, because the graphite component of the forming die is excellent in lubricity and releasability, the cast product and forming die can be easily taken out of the casting die. Also, simply by immersing the cast product and forming die in the solvent, the plastic component in the forming die is dissolved in the solvent while the graphite component flows into the solvent. In the solvent, graphite precipitates on the bottom while the dissolved plastic component floats on the surface of solvent, whereby they can be separated easily from each other in the solvent.

Third Embodiment

A third embodiment of the present invention is described below referring to the drawings. FIG. 11 to FIG. 15 are drawings to show the third embodiment of the present invention.

Figure 11:
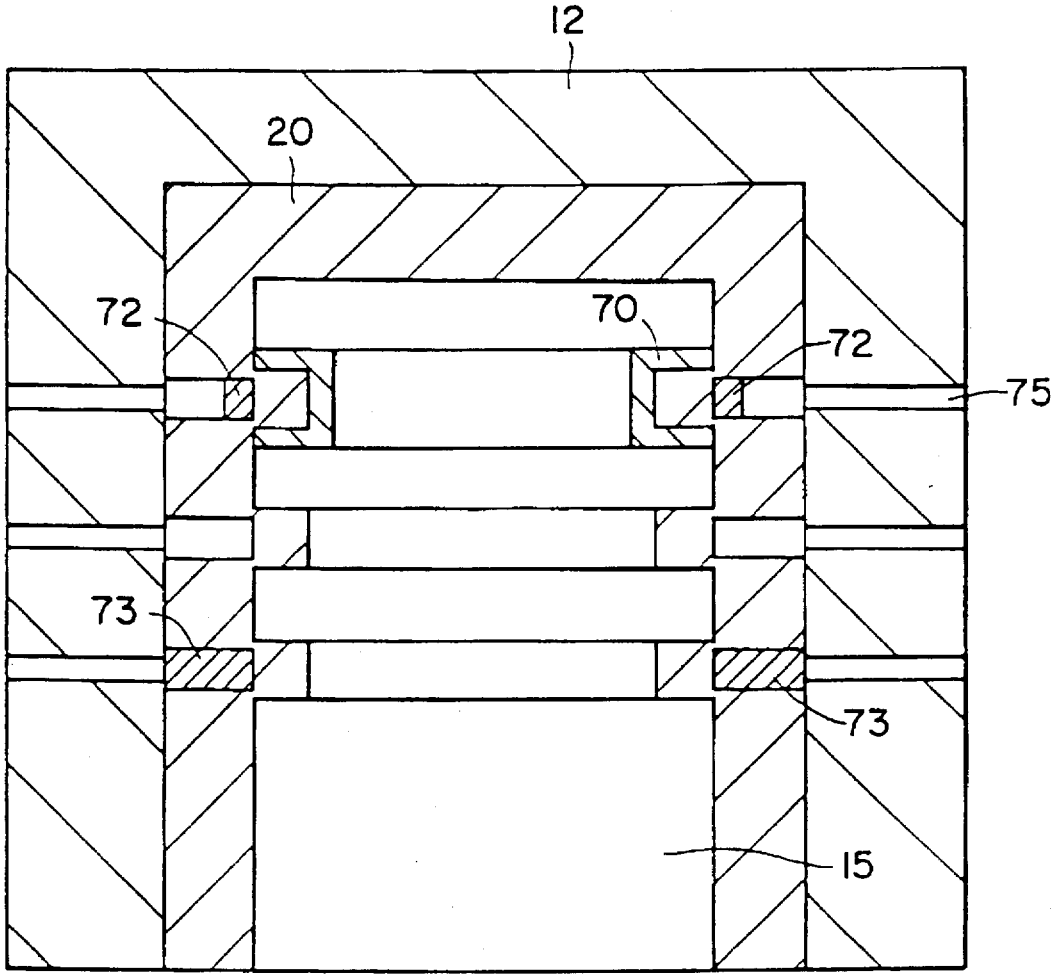
FIG. 11 is a drawing to show a state in which the forming die is set in the cavity of the moving die in the second embodiment of the present invention.
Figure 12:
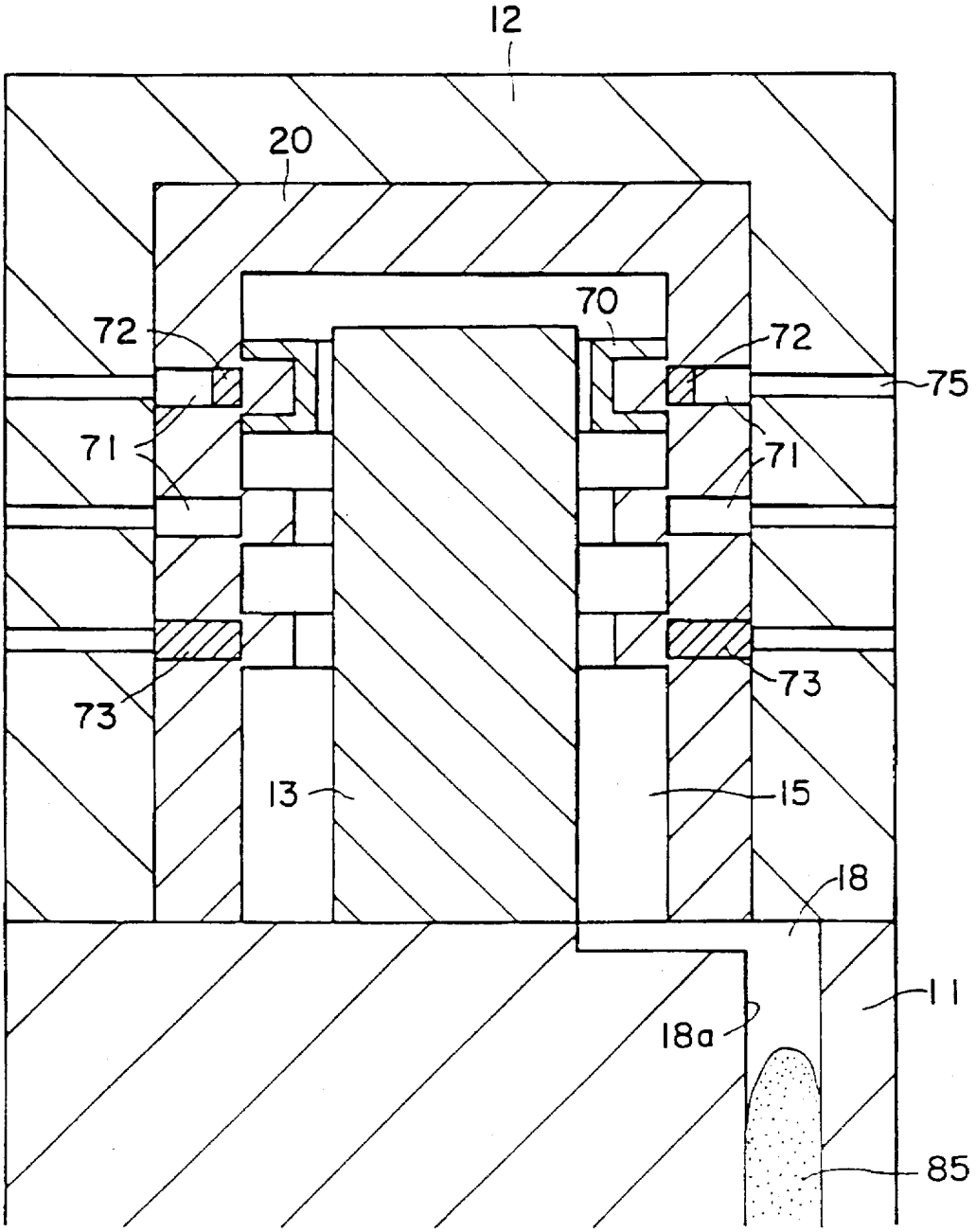
FIG. 12 is a drawing to show a state in which the moving die is in close contact with the stationary die.
Figure 13:
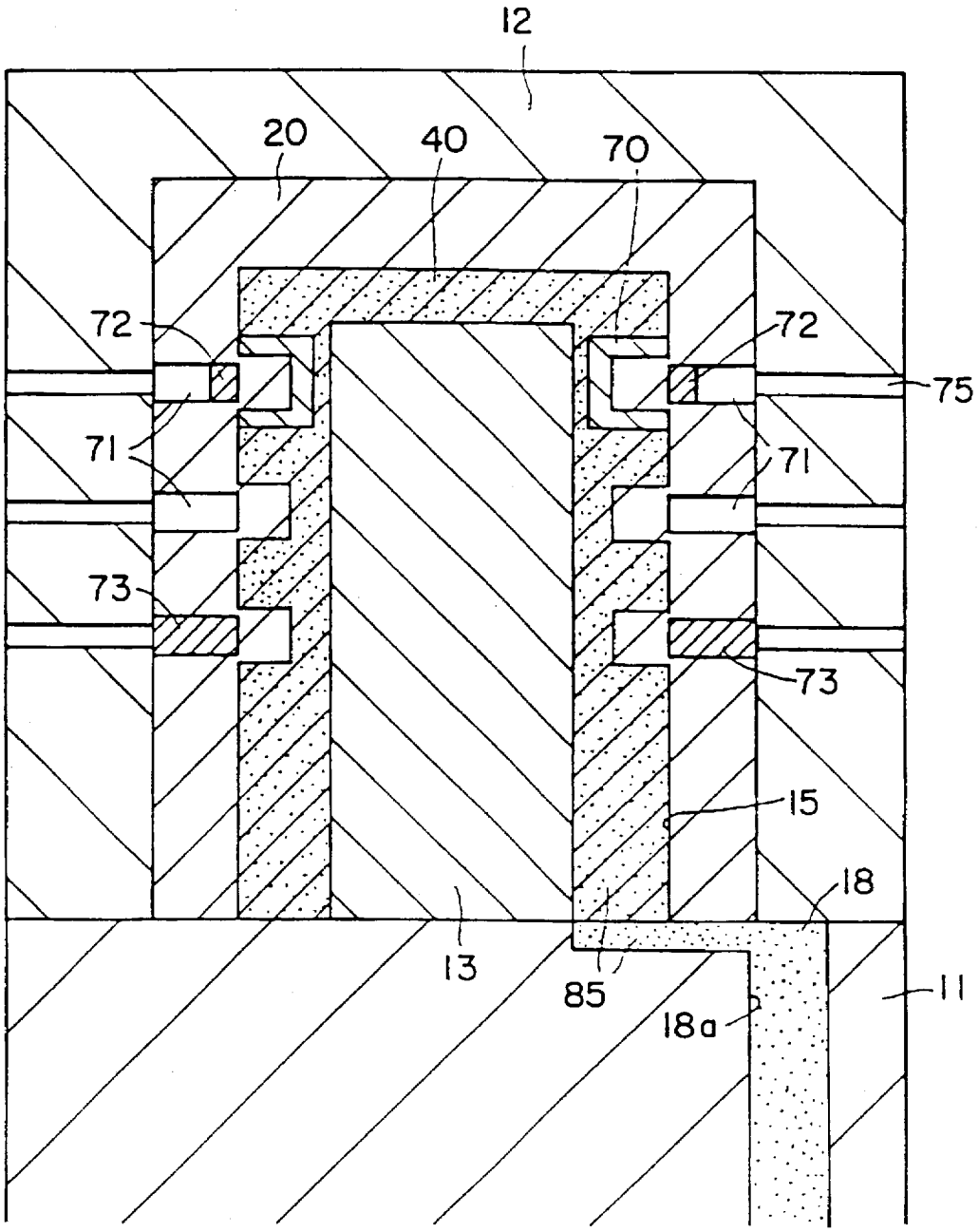
FIG. 13 is a drawing to show a state in which a molten metal is filled in the cavity of the moving die.

First, an aluminum diecast casting apparatus is schematically described referring to FIG. 11 to FIG. 13. As shown in FIG. 11 to FIG. 13, the aluminum diecast casting apparatus is provided with a stationary die 11 and a moving die 12 arranged as movable relative to the stationary die 11, and a cavity 15 is formed in the moving die 12. Also, the stationary die 11 is arranged so as to hermetically seal the cavity 15 in the moving die 12.

A gate 18, which communicates with the cavity 15, is formed in the stationary die and, further, a guide path 18*a* having an input port 19 for molten aluminum communicates with the gate 18.

Figure 14:
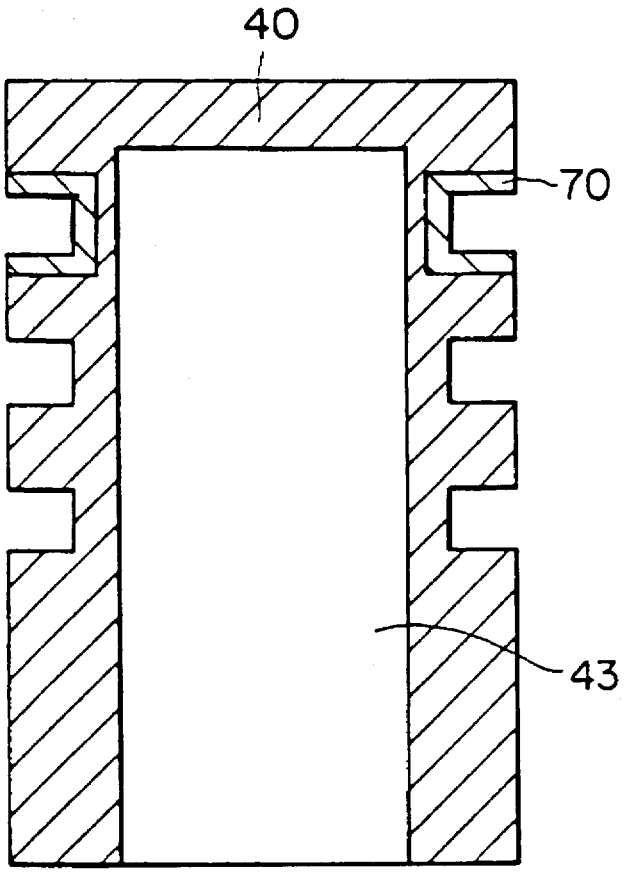
FIG. 14 is a drawing to show a cast product in which a steel ring is fit.

The stationary die 11 is provided with a metal core 13 projecting into the cavity in the moving die 12, and this metal core 13 forms a space 43 in an aluminum cast product 40 as detailed later (FIG. 14). Here, the stationary die 11, moving die 12, and metal core 13 all are made of steel.

The forming die 20 for formation of outer surface, which forms an outer surface of the aluminum cast product 40, is set into the cavity 15 in the moving die 12. The cavity 15 in the moving die 12 is cylindrical when observed from the side of stationary die 11, and the forming die 20 is almost cylindrical in correspondence with the cylindrical shape of the cavity 15.

Next described is the material of the forming die 20. The forming die 20 is comprised of powder graphite and an organic material having an adhesive function to bind the powder graphite. The organic material to bind the powder graphite can be a thermosetting synthetic resin such as a phenol resin, a urea resin, a melamine resin, an unsaturated polyester resin, a silicone resin, etc. The thermosetting synthetic resin is one obtained generally by forming initial, linear polymer molecules, and further raising the temperature to form bondings between them (crosslinking). As a result, a three-dimensional (stereoscopic) network is formed to increase the molecular weight, whereby it come to have such a property that it does not soften when again heated.

Incidentally, a weight ratio between powder graphite and the thermosetting synthetic resin is in the range of 90:10 to 10:90.

In addition, a thermoplastic synthetic resin, for example, a polycarbonate may also be used as the organic material to bind powder graphite, and a natural adhesive such as starch, paste, etc. may also be used.

Powder graphite is a material of the hexagonal system and has the hardness of 1.5 and the relative density of 2.2. Graphite has excellent heat resistance and also has excellent lubricity (releasability) from the crystal structure thereof. Also, graphite has the considerable mechanical strength at high temperatures and has such a characteristic that it is soluble in neither inorganic solvents nor organic solvents.

As shown in FIG. 11, a metal material different in quality from the aluminum cast product 40, for example, a steel ring 70 made of steel is preliminarily set on the inner surface of the forming die 20. The steel ring has a U-shaped section and is circumferentially set on the inner surface of the forming die 20. When the aluminum cast product 40 is used as a piston for piston internal combustion engine, the steel ring 70 formes a piston-ring groove.

Further, as shown in FIG. 12, the outer surface of the forming die 20 is provided with a plurality of cylindrical vent holes 71. The vent holes 71 serve to let gas generated from the forming die 20 upon casting flow out, and each of the vent holes 71 extends along a radial direction from the outer surface of the forming die 20 toward the center of the forming die 20. Also, the moving die 12 is provided with vent ports 75, which guide the gas from the forming die 20 to the outside corresponding to the vent holes 71.

Some vent holes 71 in the forming die 20 are filled with a metal filling 72 in the bottom thereof, and the metal filling 72 reinforces the forming die 20. Further, some other vent holes 71 are filled with a fusible filling 73 comprised of a low-melting point metal or low-melting point resin, and the fusible filling 73 reinforces the forming die 20. The fusible filling 73 is arranged to melt by heat from the forming die 20 when the forming die is heated upon casting, and then to flow out through the vent ports 75.

Next described is a casting method using the forming die constructed in the above structure. First, as shown in FIG. 11, the forming die 20 is set in the cavity 15 in the moving die, and then the moving die 12 is moved toward the stationary die 11 before the cavity 15 of the moving die 12 is hermetically closed by the stationary die 11 (FIG. 12). In this sate, the metal core 13 projects into the cavity 15 from the stationary die 11. Then, molten aluminum 85 is charged through the guide path 18*a* and the gate 18 into the cavity 15 (FIG. 13). The molten aluminum 85 filled in the cavity 15 is rapidly cooled by the stationary die 11 and moving die 12 to form the aluminum cast product 40. In this case, the outer surface of the aluminum cast product 40 is formed by the inner surface of the forming die 20.

Here, heat transfer occurs also from the molten aluminum 85 to the forming die 20 during the casting. When the forming die 20 is made of powder graphite and the thermosetting synthetic resin, the thermosetting synthetic resin is further cured by heating, whereby the forming die 20 does not melt or soften during casting.

However, the forming die 20 containing the thermosetting synthetic resin generates gas by rapid heating, but the gas generated from the forming die 20 is discharged from the vent holes 71 through the vent ports 75 to the outside. Further, the fusible filling 73 in the vent holes 71 flows outward through the vent ports 71 because of heating of the forming die 20. Then, the gas generated from the forming die 20 also flows outward through the vent holes 71 from which the fusible filling 73 flowed out, and then through the vent ports 75.

As described above, the thermoplastic resin may be used instead of the thermosetting resin. In this case, the forming die 20 is comprised of powder graphite and the thermoplastic synthetic resin. Since the thermal conductivity of the forming die 20 composed of graphite and the thermoplastic synthetic resin is far smaller than that of the steel stationary die 11 and moving die 12, an amount of heat transfer from molten aluminum to the forming die 20 becomes extremely small. Thus, the forming die 20 does not melt or soften during casting. Here, the molding die 20 containing the thermoplastic synthetic resin generates gas, but the gas is discharged from the vent hole 71 through the vent port 75 to the outside. Further, after the fusible filling 73 in the vent holes 71 flows out through the vent ports 71, the generated gas also flows out through the vent ports 75 from the vent holes 71 from which the fusible filling 73 has flowed out.

Next, the moving die 12 is separated from the stationary die 11, and the aluminum cast product 40 and forming die 20 are taken together out of the cavity 15 formed in the moving die 12.

In this case, because the forming die 20 has excellent lubricity and releasability because of the graphite component, the forming die 20 can be easily and simply taken together with the aluminum cast product 40 out of the cavity 15, while preventing a part of the forming die 20 from being deposited on or adhering to the inside of the cavity 15.

Figure 15:
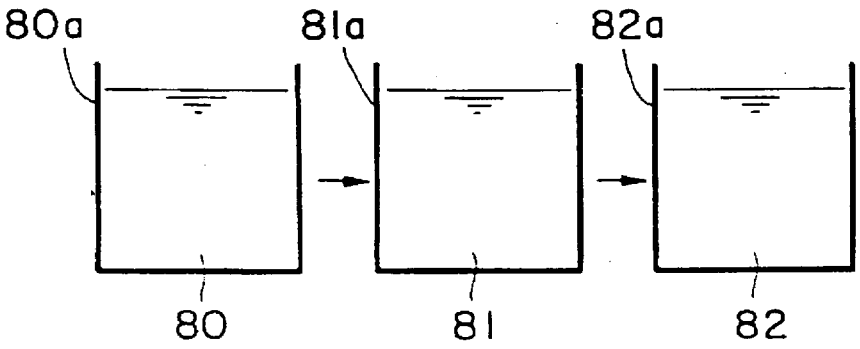
FIG. 15 is a drawing to show treatment steps for removing the forming die from the cast product.

Then, the aluminum cast product 40 and the forming die 20 are subjected to a salt bath treatment in a molten salt 80 stored in a tank 80*a*, as shown in FIG. 15. This salt bath treatment in the molten salt 80 decomposes the organic material binding powder graphite with each other, such as the thermosetting synthetic resin, the thermoplastic synthetic resin, or the natural adhesive in the forming die 20.

As the molten salt 80, an alkaline salt (trade name: DGS, No. 4, No. 5, or No. 10) manufactured by KOLENE Company, U.S.A. is used, for example.

When heated to a predetermined temperature, such an alkaline salt becomes liquefied. The salt bath treatment in the liquid alkaline salt oxidizes the organic material such as the thermosetting synthetic resin, the thermoplastic synthetic resin, or the natural adhesive in the forming die 20 to form carbon dioxide gas and sludge mainly composed of $Na_2CO_3$. Among them, the carbon dioxide gas is discharged from the molten salt 80, and the sludge precipitates on the bottom of the tank 80*a*. At the same time, powder graphite in the forming die 20 precipitates on the bottom of the tank 80*a*. The sludge and graphite precipitating on the bottom of the tank 80*a* are removed as the case requires.

Heating conditions and a treating period of the salt bath treatment differ depending on the type of the alkaline salt, and it is preferred that the heating temperature be in the range of from 380° C. to 460° C. and that the treating period be a few ten seconds.

The forming die 20 is removed from the aluminum cast product 40 by the salt bath treatment in the molten salt 80, and then the aluminum cast product 40 is pulled up from the tank 80*a*. Next, the aluminum cast product 40 is post-treated in diluted nitric acid 81 (1% concentration) stored in a tank 81a. An oxidized layer is formed on the surface of the aluminum cast product 40 by the salt treatment in the molten salt 80, but it is removed from the surface of the aluminum cast product 40 by the treatment with diluted nitric acid 81. At the same time, the surface of the aluminum cast product 40 is neutralized.

Then, the aluminum cast product 40 is washed with high-temperature (about 80° C.) water 82 stored in a tank 82*a*, thereby obtaining the aluminum cast product 40 from which the forming die 20 is completely removed. In this case, the steel ring 70 is left on the outer surface of the aluminum cast product 40 (FIG. 14).

As described above, according to the present embodiment, the forming die 20 is readily removed from the cast product 40 by casting the aluminum cast product 40 using the forming die 20, removing the cast product 40 and the forming die 20 from the stationary die 11 and the moving die 12, and then subjecting the cast product 40 and the forming die 20 to the salt bath treatment in the molten salt 80. The cast product 40 is then subjected to the oxidation treatment in the diluted nitric acid 81 and thereafter washed in high-temperature water 82. Accordingly, the cast product 40 having a complicated shape of outer surface can be readily and simply obtained.

According to the present embodiment, the outer surface of the cast product can be readily formed by the forming die upon casting. The forming die is then removed from the cast product, whereby the cast product having a desired shape of outer surface can be readily obtained.

Fourth Embodiment

Figure 16:
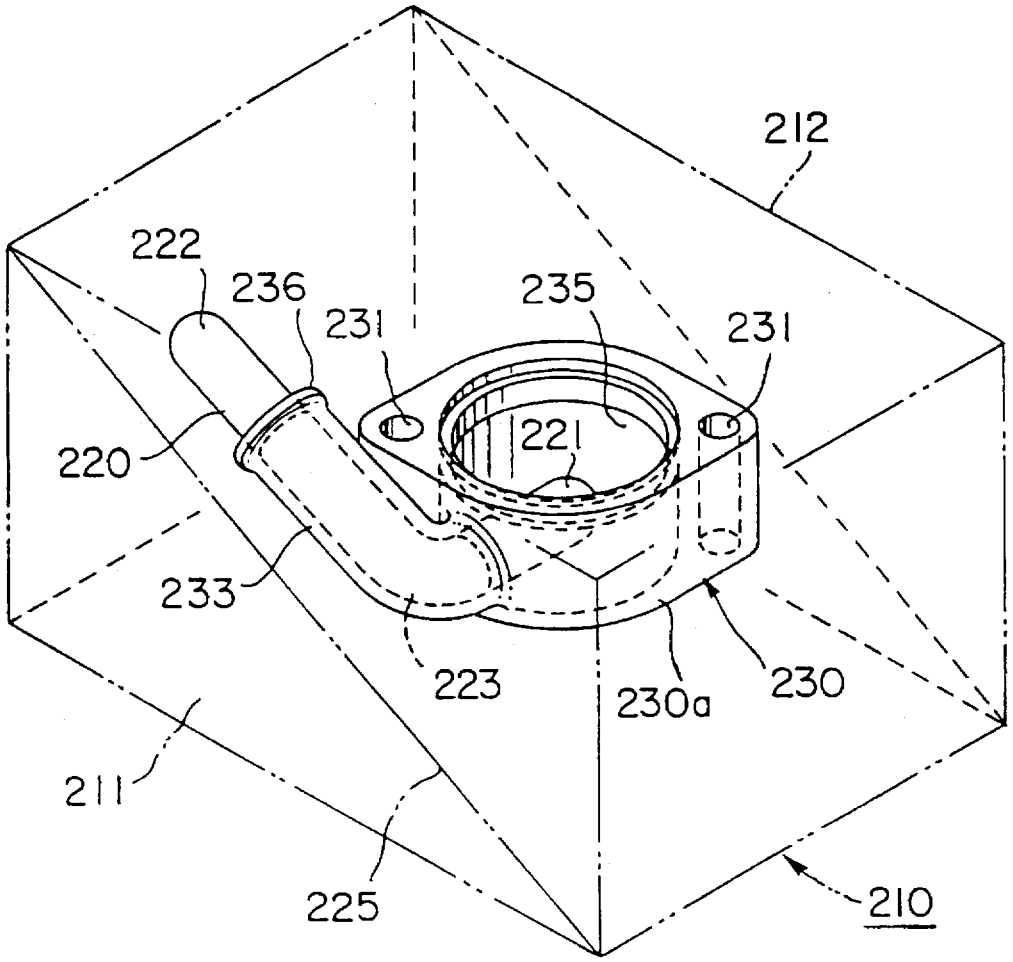
FIG. 16 is a perspective view to show a state in which the core for casting of the shape of the inner surface is set in the stationary die and the moving die.
Figure 17:
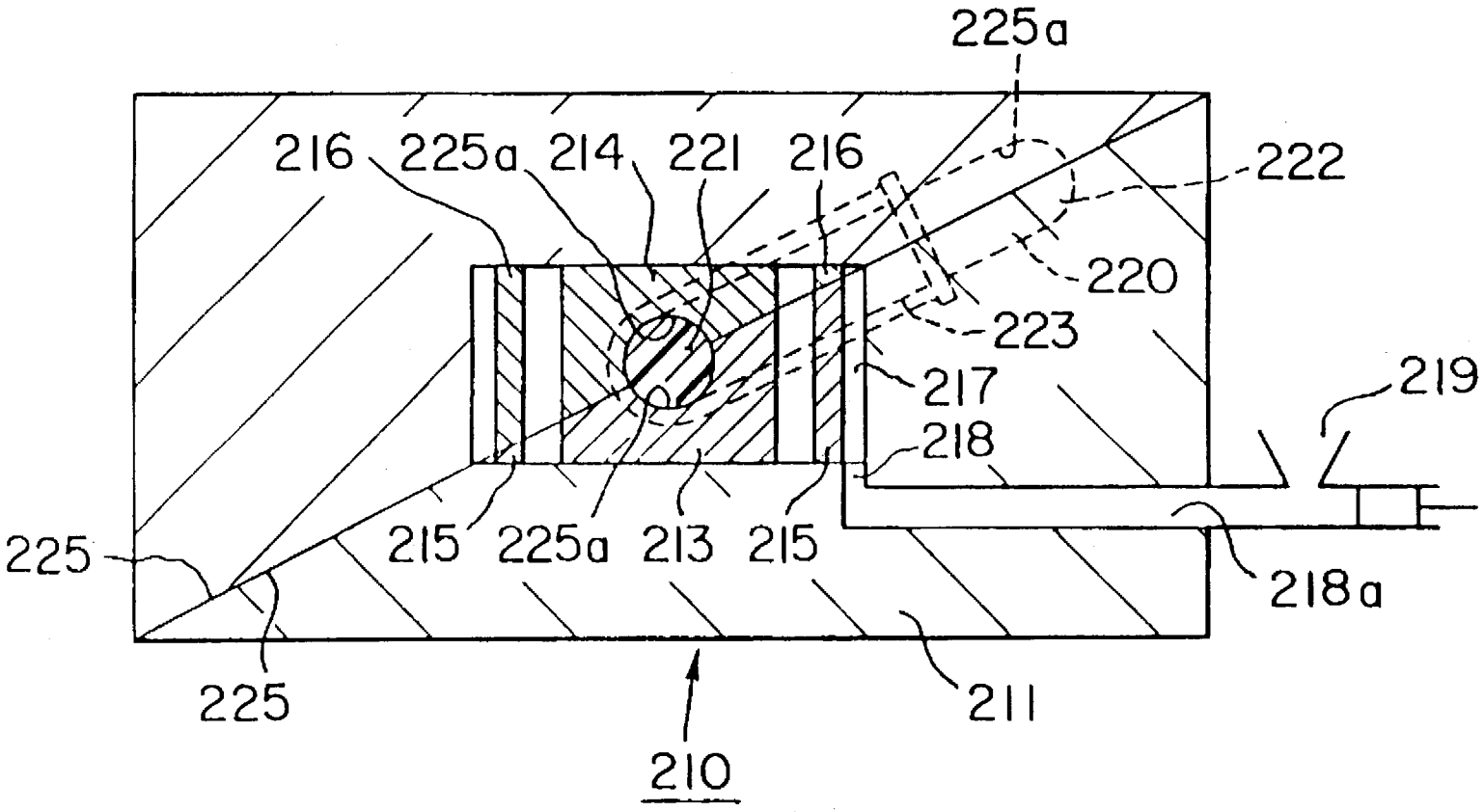
FIG. 17 is a sectional side view of the moving die and the stationary die to show a state in which the casting core is set therein.
Figure 18:
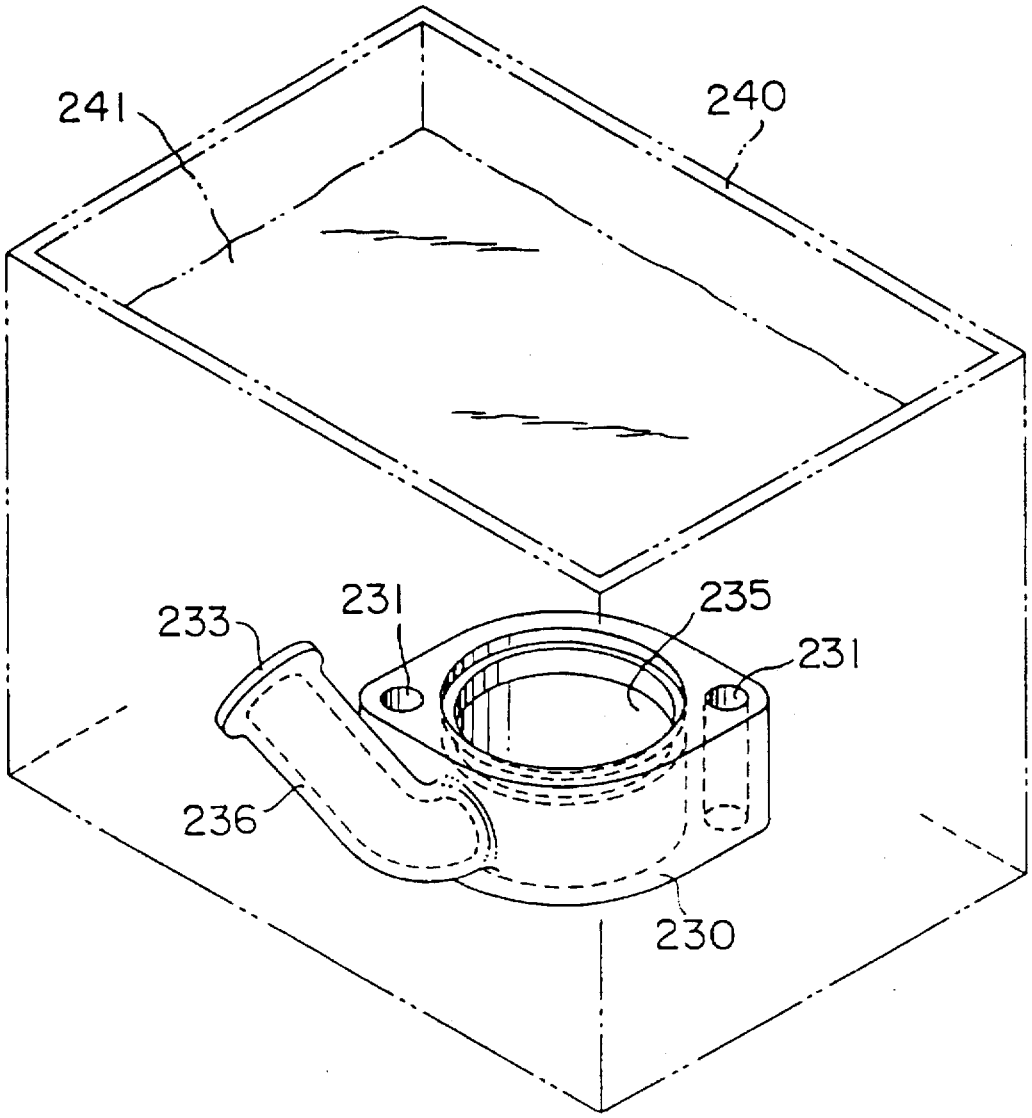
FIG. 18 is a perspective view to show a state in which an aluminum cast product is immersed in a solvent.

A fourth embodiment of the present invention is described below referring to the drawings. FIG. 16 to FIG. 18 are drawings to show an embodiment of the present invention.

First, an aluminum diecast casting apparatus is schematically described referring to FIG. 16 and FIG. 17. As shown in FIG. 16 and FIG. 17, the aluminum diecast casting apparatus 210 is provided with a stationary die 211 and a moving die 212 arranged as movable relative to the stationary die 211, and a cavity 217 is formed in the stationary die 211 and moving die 212. Further, the casting die is composed of the stationary die 211 and moving die 212.

Namely, as shown in FIG. 16 and FIG. 17, the stationary die 211 and moving die 212 are in close contact with each other at inclined planes 225, 225 thereof to form the cavity 217 hermetically sealed in the stationary die 211 and the moving die 212. The cavity 217 is a portion for forming an aluminum cast product 230 described below.

Further, the stationary die 211 is provided with projecting portions 213, 215 projecting on the cavity 217 side, and, likewise, the moving die 212 is provided with projecting portions 214, 216 projecting on the cavity 217 side. Among them, the projecting portions 213, 214 come into contact with each other at the inclined planes 225, 225 to constitute a metal core 213, 214 for forming a hollow portion 235 in the aluminum cast product 230. In addition, the projecting portions 215, 216 come into contact with each other at the inclined planes 225, 225 to constitute metal cores 215, 216 for forming through holes 231, 231 in the aluminum cast product 230.

Further, the inclined planes 225, 225 of the stationary die 211 and moving die 212 are provided each with mount grooves 225*a*, 225*a* for a casting core 220 described below to be mounted therein. The casting core 220 forms a tube portion 233 projecting from a cast product body 230*a* of the aluminum cast product 230, and is bent in an L-shape. The casting core 220 has a base end portion 221 located in the inside of the stationary die 211 and moving die 212, an outer portion 222 located near the outer surfaces of the stationary die 211 and moving die 212, and an intermediate portion 223 located between the base end portion 221 and the outer portion 222. Among them, the base end portion 221 of the casting core 220 is mounted in the mount grooves 225*a*, 225*a* formed in the projecting portions 213, 214 of the stationary die 211 and moving die 212, and the outer portion 222 is set in mount grooves 225*a*, 225*a* formed on the outer sides of the inclined planes 225, 225 of the stationary die 211 and moving die 212. Further, the intermediate portion 223 is in contact with neither of the mount grooves 225*a*, 225*a* in the stationary die 211 and moving die 212 as being kept in a floating state in the cavity 217, whereby the tube portion 233 of the aluminum cast product 230 is formed around the circumference of the intermediate portion 223.

Furthermore, a gate 218, which communicates with the cavity 217, is formed in the stationary die 211 and, further, the gate 218 communicates with a guide path 218*a* having an input port 219 for molten aluminum.

Next, the casting core 220 will be described in detail. The casting core 220 is comprised of powder graphite and a plastic material bonding the powder graphite with each other, for example, a polycarbonate material. The casting core 220 is produced by injection molding using a graphite-added plastic pellet material. The graphite-added plastic pellet material and the core 220 are produced substantially by the same methods as the production procedures described in the second embodiment (FIG. 7 to FIG. 9).

Namely, as shown in FIG. 8 in the second embodiment, the raw material 125 consisting of polycarbonate pellets and powder graphite is put into the hopper 123 in the extruder 110. A weight ratio between the polycarbonate pellets and powder graphite in the hopper 123 is in the range of 90:10 to 10:90 corresponding to a weight ratio of a polycarbonate component and a graphite component in a graphite-added plastic pellet material 117 as described below. Next, the raw material 125 in the hopper 123 is sent to the cylinder 126, and the raw material 125 is pressurized in the cylinder 126 with rotation of the screw 128 and heated by the heater 127.

When the raw material 125 is heated and compressed in the cylinder 126, the polycarbonate pellets melt to be mixed with powder graphite and the mixture flows out through the die 111 (FIG. 7) from the head 129 of the extruder 110.

Since graphite does not chemically react with any synthetic resin under environmental conditions below 1000° C., the polycarbonate and graphite exist independently of each other while keeping respective specific properties in the mixture of polycarbonate and graphite.

Next, as shown in FIG. 7, the polycarbonate and graphite mixed in the extruder 110 is fed in the form of a strand mixture 112 from the die 111 to the pelletizer 116. In the pelletizer 116 the strand mixture 112 is fed by feed rollers 113, 114 to the rotary knife 115, and the mixture is finely broken by the rotary knife 115 to obtain the graphite-added plastic pellet material 117 in diameters of 1 to 2 mm.

This graphite-added plastic pellet material 117 is a mixture of the polycarbonate component and graphite component, and the weight ratio between the polycarbonate component and the graphite component is in the range of 90:10 to 10:90 as described previously. If the polycarbonate component is more than 90:10 of the weight ratio between the polycarbonate component and the graphite component, the releasability from the casting dies 211, 212 and the releasability from the aluminum cast product 230 become slightly degraded for the casting core 220 obtained by injection molding.

If the graphite component is more than 10:90 of the weight ratio between the polycarbonate component and the graphite component, the toughness becomes degraded for the casting core 220 obtained by injection molding.

Incidentally, the combination of the polycarbonate component with the graphite component in the graphite-added pellets 117 can be determined as follows. If the casting core 220 is formed in a simple structure and a large volume, a combination of the polycarbonate component with the graphite component is selected in the range where the volume % of graphite is relatively large, from Table 1 in the second embodiment. In this case, for example, supposing a combination with the volume % of graphite being 70% is selected, 1540 g of graphite and 360 g of polycarbonate are mixed with each other.

On the other hand, if the casting core 220 is formed in a complex structure and a small volume, a combination of the polycarbonate component with the graphite component is selected in the range where the volume % of graphite is relatively small.

The casting die 220 using the graphite-added plastic pellet material 117 thus obtained is next produced as shown in FIG. 9.

As shown in FIG. 9, the injection molding machine 130 has the injection ram 135 arranged as slidable in the injection cylinder 134, and the oil hydraulic motor 137 driving to rotate the injection ram 135 through the drive shaft 138. The screw 132 is connected with the injection ram 135, and the screw 132 is set in the barrel 136. Further, the graphite-added plastic pellet material 117 is supplied from the hopper 131 to the screw 132. The nozzle 139 is provided at the distal end of screw 132, and the nozzle 139 is connected to the injection die composed of the stationary die 140 and the moving die 141.

Next described is the production method of the casting core 220. As shown in FIG. 9, the graphite-added plastic pellet material 117 is first put into the hopper 131, and then the oil hydraulic motor 137 starts rotating the screw 132 through the injection ram 135. During this time, the graphite-added plastic pellet material 117 is supplied into the screw 132, whereby the polycarbonate component in the graphite-added plastic pellet material 117 is melted by the rotation of screw 132. Then the mixture in which powder graphite is mixed in the melted polycarbonate is injected through the nozzle 139 into the cavity between the stationary die 140 and the moving die 141, thereby obtaining the casting core 220 made of polycarbonate and powder graphite.

The polycarbonate component among the components of the casting core 220 has characteristics of excellent heat resistance, excellent adhesion under high-temperature environment, and high toughness. On the other hand, powder graphite is a material of the hexagonal system and has the hardness of 1.5 and the relative density of 2.2. The graphite component has excellent heat resistance, and also has excellent lubricity and releasability from the crystal structure thereof. Also, the graphite component has the considerable mechanical strength at high temperatures and has such a characteristic that it is soluble in neither inorganic solvents nor organic solvents.

Further, polycarbonate and graphite do not chemically react with each other as described previously, and can exist with respective specific properties. From these points, the casting core 220, obtained by kneading to bind powder graphite with polycarbonate, becomes a core for casting excellent in heat resistance and in lubricity. In this case, among the components of the casting core 220, polycarbonate functions to bond powder graphite to each other.

Next described is an aluminum diecast casting method using the casting core 220 constructed in the above structure.

First, as shown in FIG. 16 and FIG. 17, the casting core 220 is set in the cavity 217 in the stationary die 211. In this case, the base end portion 221 of the casting core 220 is set in the mount groove 225*a* formed in the inclined plane 225 of the projecting portion 213 in the stationary die 211, and the outer portion 222 is set in the mount groove 225*a* formed in the outer side of the inclined plane 225 of the stationary die 211.

Next, the moving die 212 is moved toward the stationary die 211, so that the inclined plane 225 of the stationary die 211 and the inclined plane 225 of the moving die 212 come into close contact with each other before the cavity 217 in the stationary die 211 and moving die 212 is hermetically closed. In this case, the intermediate portion 222 of the casting core 220 is in contact with neither one of the mount grooves 225*a* of the stationary die 211 and moving die 212, in the floating state in the cavity. Further, the base end portion 221 of the casting core 220 is set in the metal core composed of the projecting portions 213, 214.

In this state, molten aluminum is put through the input port 219 into the guide path 218*a*, so that molten aluminum is injected from the guide path 218*a* through the gate 218 into the cavity 217. Molten aluminum flowing from the gate 218 into the cavity 217 is injected in a spray form, and the temperature is about 600° C.

As shown in FIG. 16 and FIG. 17, molten aluminum, flowing from the gate 218 into the cavity 217, then spreads in the cavity 217. In this case, the cavity 217 forms the aluminum cast product 230 composed of the cast product body 230*a* and the tube portion 233 having a flange portion 236. Among them, the tube portion 233 is formed around the circumference of the intermediate portion 222 of the cast core 220. Further, the hollow portion 35 is formed by the metal core 213, 214 of the stationary die 211 and moving die 212, and the through holes 231, 231 are formed by the metal cores 215, 216.

Then, molten aluminum filled in the cavity 217 is rapidly cooled by the stationary die 211 and moving die 212.

In this case, heat transfer occurs also from molten aluminum to the side of casting core 220 made of powder graphite and polycarbonate. However, because the thermal conductivity of the casting core 220 made of powder graphite and polycarbonate is far smaller than that of the steel stationary die 211 and moving die 212, an amount of heat transfer from molten aluminum to the casting core 220 becomes extremely small. Further, because of instantaneous injection casting specific to the diecast casting, the casting core 220 made of powder graphite and polycarbonate does not melt during casting, and the aluminum cast product 230 excellent in accuracy of shape can be formed accordingly.

If the surface of the casting core 220 near thick portions of the aluminum cast product 230 formed by the casting core 220, for example, near the flange portion 236, is coated with a very-high-temperature-resistant silicon rubber not shown, the casting core 220 will not melt even if escape of heat, for example, from the flange portion 236 becomes slow.

Next, the moving die 212 is separated from the stationary die 211, and the aluminum cast product 230 and casting core 220 are taken together out of the cavity 217 formed in the stationary die 211 and moving die 212.

In this case, because the casting core 220 has excellent heat resistance, lubricity, and releasability because of the graphite component, the casting core 220 can be easily and simply taken together with the aluminum cast product 230 out of the cavity 217, while preventing a part of the casting core 220 from being deposited on or adhering to the inside of the cavity 217. Accordingly, the inside of the cavity 217 does not have to be cleaned every aluminum diecasting, whereby the aluminum diecasting can be completely automatized. Next, the aluminum cast product 230 and casting core 220 are heated at about 300° C., whereby the polycarbonate component in the casting core 220 melts and partly flows out.

As shown in FIG. 18, the aluminum product 230 is next immersed together with the casting core 220 in a solvent 241 in a container 240. In FIG. 18, the aluminum cast product 230 is shown without the casting core 220 for convenience' sake. Thus immersing the aluminum casting product 230 and casting core 220 in the solvent 241, the remaining polycarbonate component in the casting core 220 is dissolved in the solvent 241 to be completely removed from the aluminum cast product 230. On the other hand, because the graphite component in the casting core 220 is excellent in lubricity and releasability, it is easily and simply removed from the aluminum cast product 230 to precipitate on the bottom in the solvent 241. Also, the polycarbonate component dissolved in the solvent 241 comes up to the surface of solvent 241.

Because of this, the graphite component precipitating on the bottom of solvent 241 can be easily and simply separated in the solvent from the dissolved polycarbonate component floating on the surface of solvent 241, thus facilitating disposal.

Also, setting a supersonic generator (not shown) in the solvent 241 in the container 240, supersonic waves can be generated in the solvent 241, whereby the casting core 220 can be dissolved and removed more quickly.

The following hydrocarbon solvent is used as the solvent for dissolving to remove the casting core 220.

Methylene chloride (dicohloromethane or methylene chloride), NMP (N-methyl-2-olefin), DMA (NN-dimethylformamide), MEK (methyl ethyl ketone), ethyl acetate (ester).

According to the present embodiment as described, the casting core 220 can be dissolved and removed from the aluminum cast product 230 simply by immersing the aluminum cast product 230 together with the casting core 220 into the solvent 241 after casting of the aluminum cast product 230 using the casting core 220 made of powder graphite and polycarbonate. Thus, the aluminum cast product 230 can be easily and simply obtained as provided with the tube portion 233 projecting from the product body 230*a*.

(Modifications)

Modifications of the present embodiment are next described. The above embodiment showed an example in which the casting core 220 was the one made of powder graphite and polycarbonate, but without a need to be limited to this, polycarbonate may be replaced by another thermoplastic resin. In this case, the thermoplastic inner resin may be selected from fluororesins (polyfluoroethylene resins) such as ethylene tetrafluoride, polyimide resins, polyamide-imide resins polysulfone resins, vinyl chloride resins, polyamide resins (nylon resins), polypropylene resins, polyethylene resins, polyester resins (Tetron resins), or polysulfonic acid resins.

In another modification, the casting core 220 is composed of a plurality of parts, wherein thick and simple portions among the parts are arranged to include a more graphite component but a less plastic component while thin and complex portions are arranged to include a less graphite component and a more plastic component. When the thick and simple portions are arranged to include an increased amount of the graphite component as described, the casting core 220 can be easily removed from the aluminum cast product 230 even with a smaller amount of usage of the solvent.

In the above embodiment the aluminum diecasting method was described as a diecasting method, but the present invention can be applied to any other diecasting method, such as the gravity diecasting method, the low pressure diecasting method, and the precision diecasting method. Further, the cast product may be not only of aluminum, but also of lead, zinc, magnesium, manganese or an alloy thereof.

Further, the method for removing the casting core 220 from the aluminum cast product 230 may be, for example, such a method that the aluminum cast product 230 and casting core 220 are heated in a furnace to bring the plastic component in the casting core 220 into a molten state whereby the plastic component is made to flow together with the graphite component out from the aluminum cast product 230. Also, the casting core 220 can be pulled out of the aluminum cast product 230 as heating the aluminum cast product 230 and casting core 220 by a burner to bring the plastic component in the casting core 220 into a molten state.

As described above, according to the present embodiment, the cast product having a complicated shape can be easily and simply obtained just by, after producing the cast product using the casting core, taking out the cast product and casting core from the casting die and thereafter removing the casting core from the cast product. In this case, because the graphite component in the casting core is excellent in lubricity and releasability, the cast product and the casting core can be easily taken out of the casting die.

Fifth Embodiment

A fifth embodiment of the present invention is described below referring to the drawings. FIG. 19 to FIG. 25 are drawings to show an embodiment of the present invention.

Figure 19:
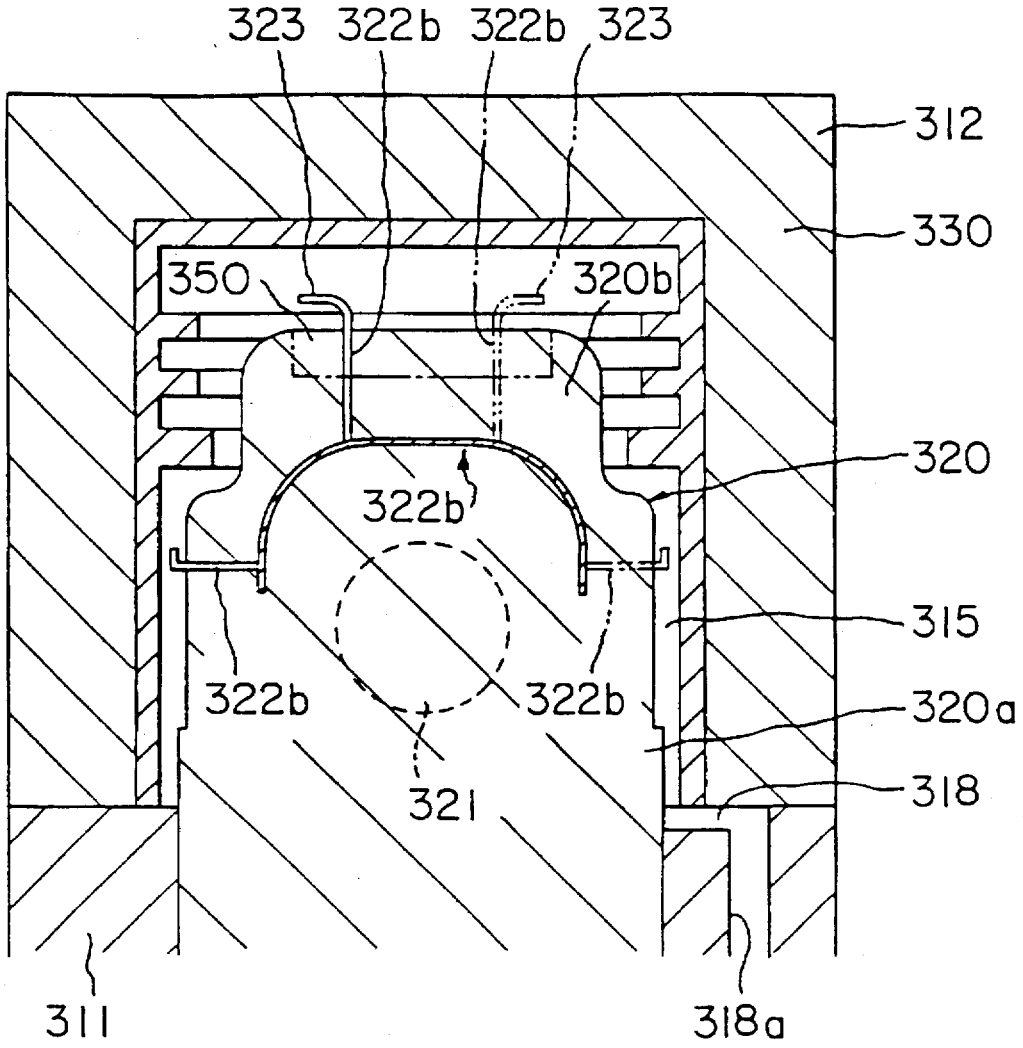
FIG. 19 is a drawing to show a state in which the moving die is in close contact with the stationary die in the casting method using a plastic core, in the fifth embodiment of the present invention.
Figure 20:
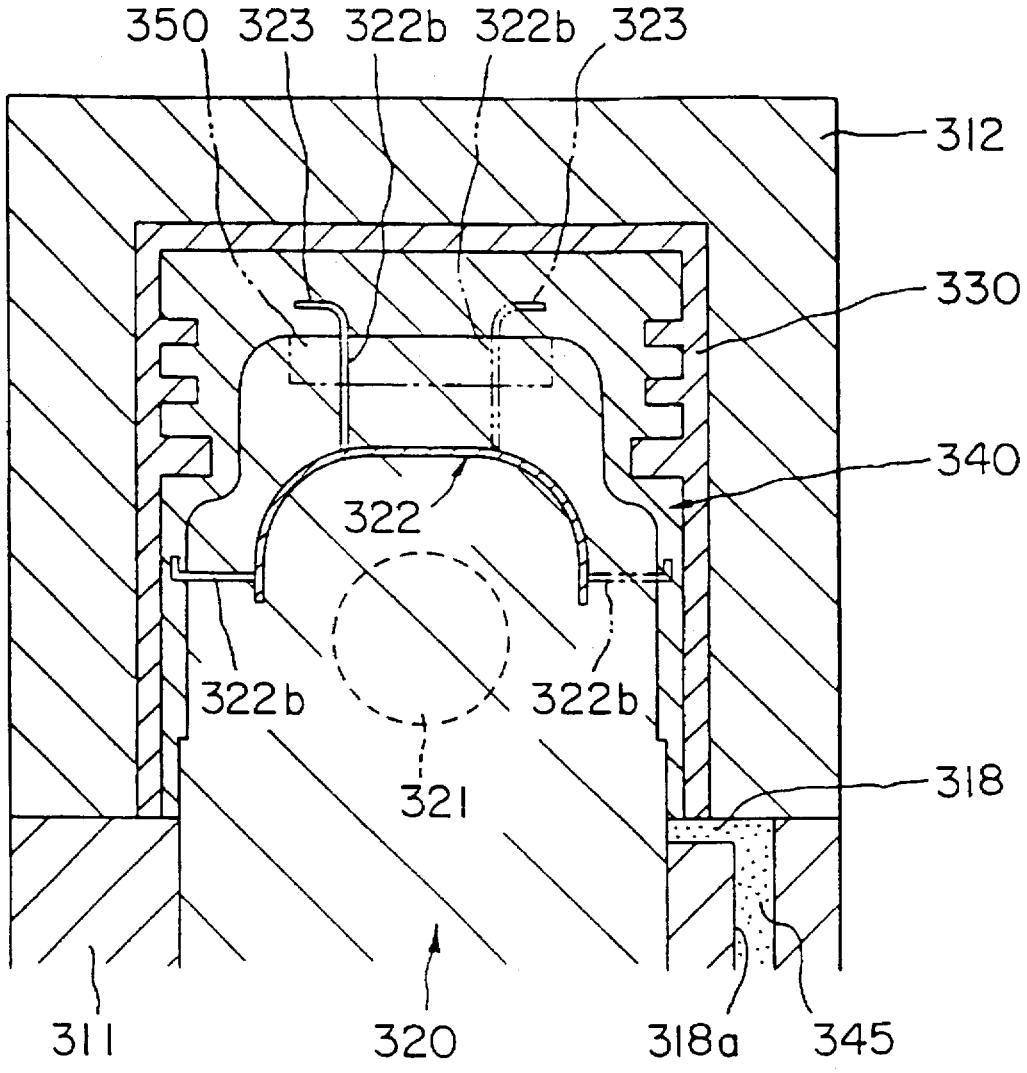
FIG. 20 is a drawing to show a state in which a molten metal is filled in the cavity of the moving die.

First, an aluminum diecast casting apparatus is schematically described referring to FIG. 19 and FIG. 20. As shown in FIG. 19 and FIG. 20, the aluminum diecast casting apparatus is provided with a stationary die 311 and a moving die 312 arranged as movable relative to the stationary die 311, and a cavity 315 is formed in the moving die 312. Also, the stationary die 311 is arranged to hermetically seal the cavity 315 in the moving die 312.

Further, a gate 318, which communicates with the cavity 315, is formed in the stationary die 311 and, a guide path 318*a* having an input port for molten aluminum communicates with the gate 318.

Figure 24:
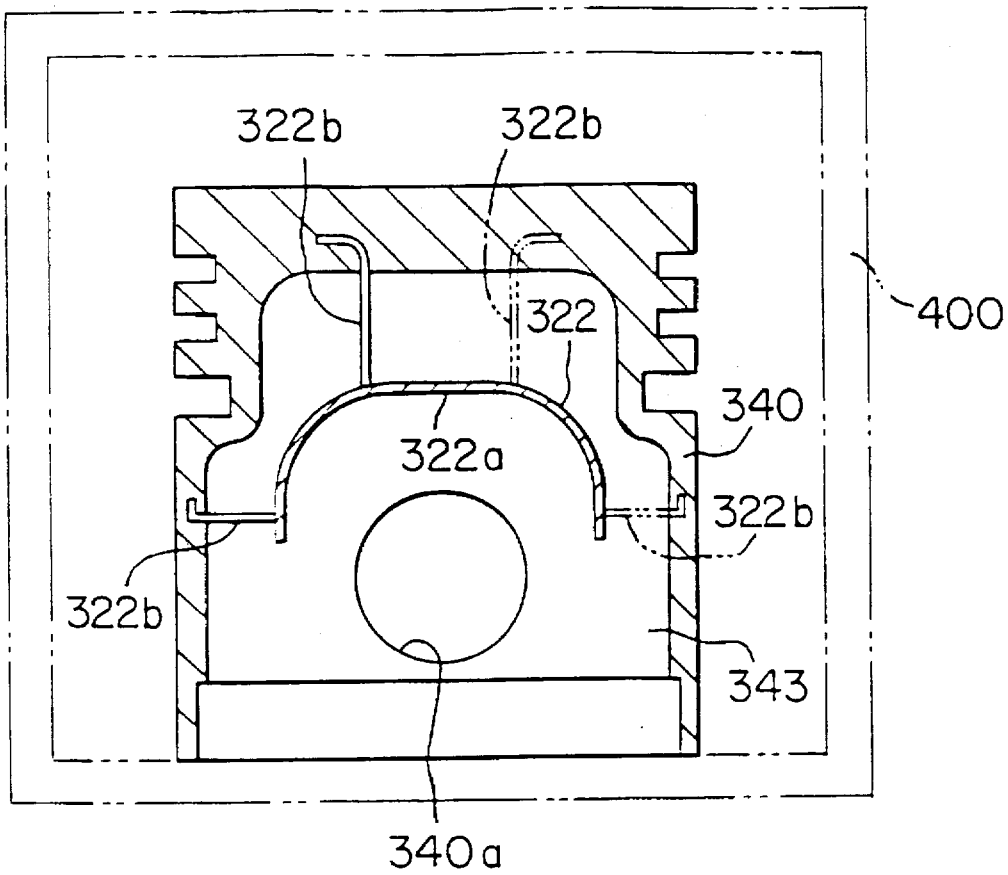
FIG. 24 is a drawing to show a cast product provided with the metal molded article.

The stationary die 311 is provided with a core 320 projecting into the cavity 315 in the moving die 312, and this core 320 forms a space 343 in an aluminum cast product 340 as detailed later (FIG. 24). Here, the stationary die 311 and moving die 312 all are made of steel.

A forming die 330 for formation of outer surface, which forms an outer surface of the aluminum cast product, is set into the cavity 315 in the moving die 312. The cavity 315 in the moving die 312 is cylindrical when observed from the side of stationary die 311, and the forming die 330 is substantially cylindrical in correspondence with the cylindrical shape of the cavity 315. Likewise, the core 320 is also substantially cylindrical.

Next described is the material for the core 320 and forming die 330. The core 320 and forming die 330 are comprised of the same material and of powder graphite and an organic material having an adhesive function to bind the powder graphite. The organic material to bind the powder graphite can be a plastic, e.g., a thermosetting synthetic resin such as a phenol resin, a urea resin, a melanin resin, an unsaturated polyester resin, a silicone resin, etc.

The thermosetting synthetic resin is one obtained generally by forming initial, linear polymer molecules and further raising the temperature to form bondings between them (crosslinking). As a result, a three-dimensional (stereoscopic) network is formed to increase the molecular weight, whereby it comes to have such a property that it does not soften when again heated.

Incidentally, a weight ratio between the powder graphite and the thermosetting synthetic resin is in the range of 90:10 to 10:90.

Powder graphite is a material of the hexagonal system and has the hardness of 1.5 and the relative density of 2.2. Graphite has excellent heat resistance and also has excellent lubricity (releasability) from the crystal structure thereof. Also, graphite has the considerable mechanical strength at high temperatures and has such a characteristic that it is soluble in neither inorganic solvents nor organic solvents.

Figure 21:
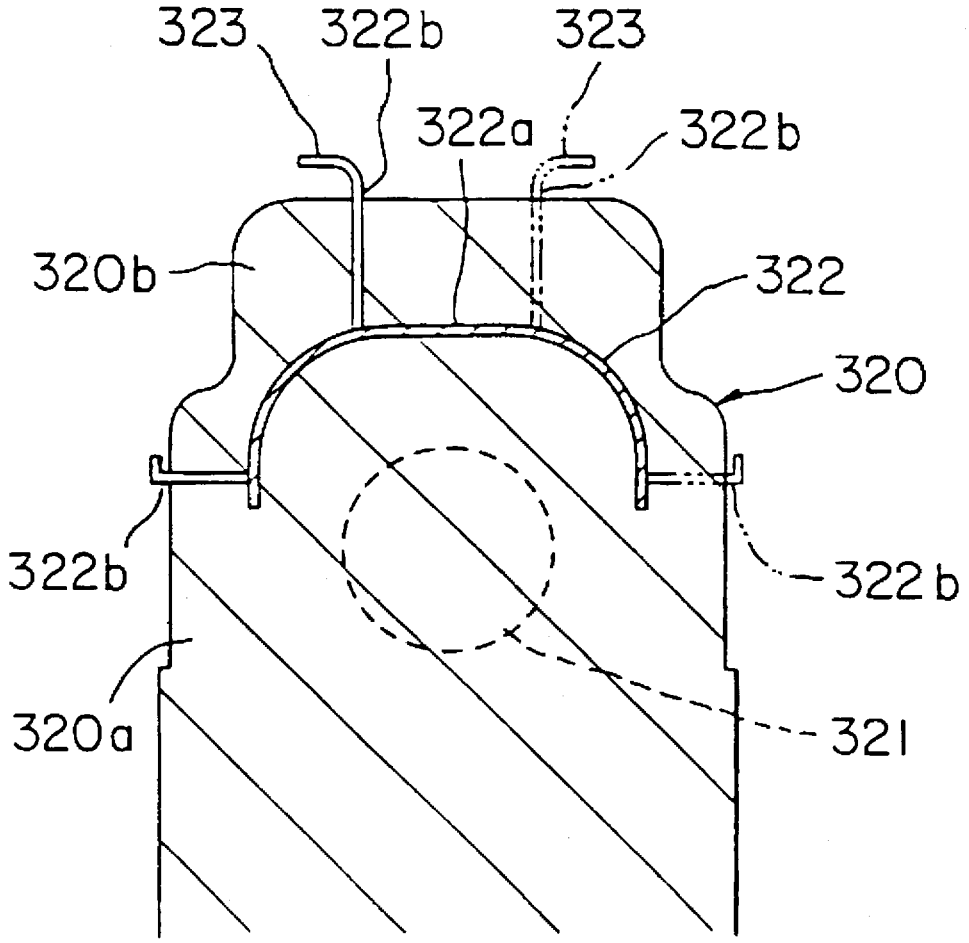
FIG. 21 is a sectional view of the core, in which a metal molded article is preliminarily buried.
Figure 22:
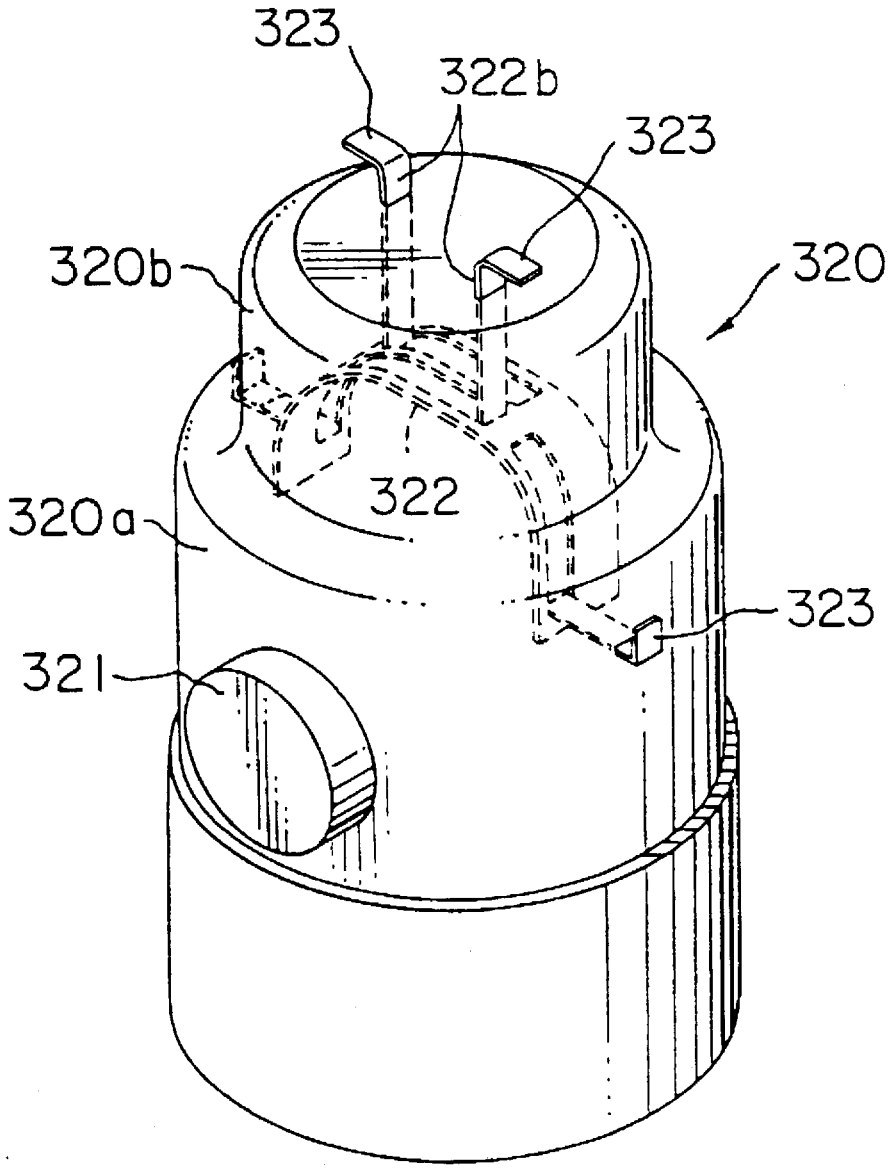
FIG. 22 is a perspective view of the core, in which a metal molded article is preliminarily buried.

Incidentally, as shown in FIG. 21 and FIG. 22, the core 320 has a large diameter portion 320a located on the side of stationary die 311, a small diameter portion 320*b* located on the side of moving die 312, and a projecting portion 321, formed on the large diameter portion 320*a* for forming a through hole 340*a* (FIG. 24) in the aluminum cast product 340. Further, a metal molded article different in quality from the aluminum cast product 340, for example, a copper molded article 322 is preliminarily buried inside the small diameter portion 320*b* in the core 320. When the aluminum cast product 340 is used as a piston, the copper molded article 322 can be used as a radiator plate.

Figure 23A:
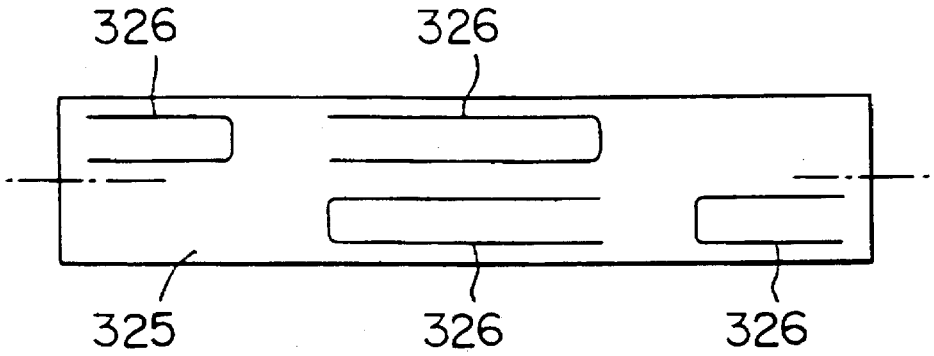
FIGS. 23A, 23B, and 23C are drawings to show producing steps of the metal molded article.
Figure 23B:
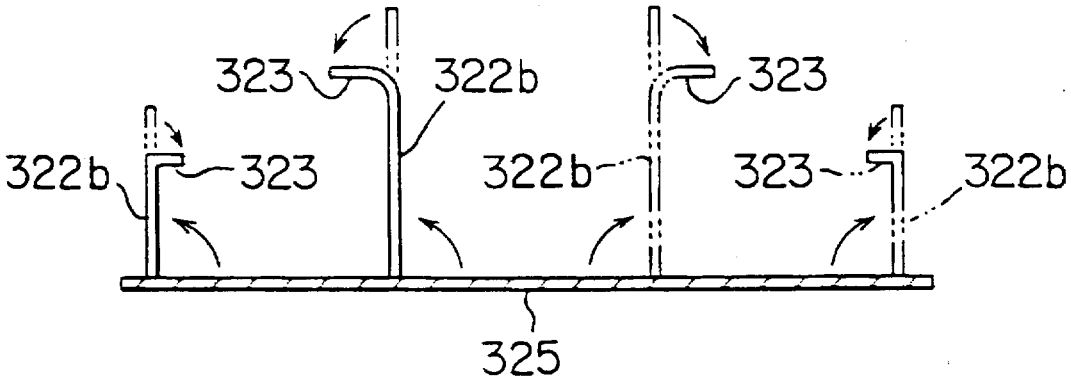
Figure 23C:
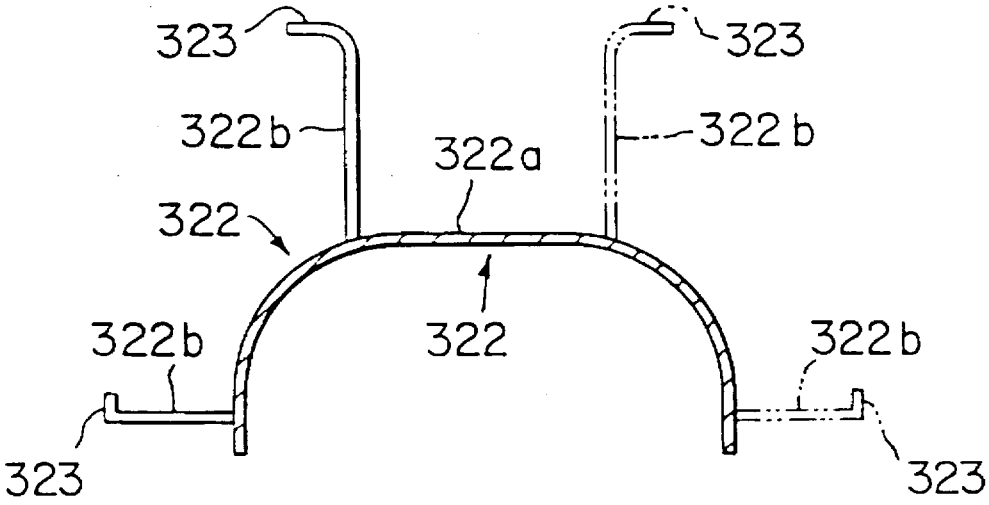

The copper molded article 322 is produced as follows. Namely, as shown in FIG. 23A, leg portions 322*b* are made to stand up along cut lines 326 from a copper plate 325, and a distal end of each leg portion 322*b* is bent. Then, as shown in FIG. 23C the copper plate 325 is bent in such a manner that the leg portions 322*b* are out, thereby forming the copper molded article 322 composed of the body 322*a* and the leg portions 322*b*.

The copper molded article 322 is set in a resin forming die (not shown) and then a material for the core 320 is filled into the resin forming die. As shown in FIG. 21 and FIG. 22, the core 320 having the copper molded article 322 preliminarily buried therein is obtained by this procedure. In this case, the body 322*a* in the copper molded article 322 is completely buried in the core 320, but the distal ends 323 of the leg portions 322*b* project out from the core 320.

Next described is a casting method using the core 320 constructed in the above structure. First, as shown in FIG. 19, the core 320 is set in the stationary die 311, and the forming die 330 is set in the cavity 315 in the moving die 312. Then, the moving die 312 comes to fit to the stationary die 311, so that the cavity 315 in the moving die 312 is hermetically sealed by the stationary die 311. In this case, the core 320 projects into the cavity 315 in the moving die 312 from the side of stationary die 311.

Then, molten aluminum 345 is charged through the guide path 318*a* and the gate 318 into the cavity 315 (FIG. 20). The molten aluminum 345 filled in the cavity 315 is rapidly cooled, thereby forming the aluminum cast product 340 by the casting method. In this case, a shape of the inner surface of the aluminum cast product 340 is formed by a shape of the outer surface of the core 320, and a shape of the outer surface of the aluminum cast product 340 is formed by a shape of the inner surface of the forming die 330.

Here, heat transfer also occurs from the molten aluminum 345 to the core 320 and forming die 330 during the casting. The core 320 and the forming die 330 both are made of powder graphite and the thermosetting synthetic resin, and the thermosetting synthetic resin is further cured by the heat. Therefore, the core 320 and die 330 do not melt or soften during casting.

Next, the moving die 312 is separated from the stationary die 311, and the aluminum cast product 340 is taken together with the core 320 and forming die 330 out of the cavity 315 in the moving die 312.

In this case, since the core 320 and forming die 330 have excellent lubricity and releasability because of the graphite component, the core 320 and forming die 330 can be easily and simply taken together with the aluminum cast product 340 out of the stationary die 311 and moving die 312, while preventing a part of the core 320 or forming die 330 from being deposited on or adhering to the stationary die 311 or moving die 312.

Figure 25:
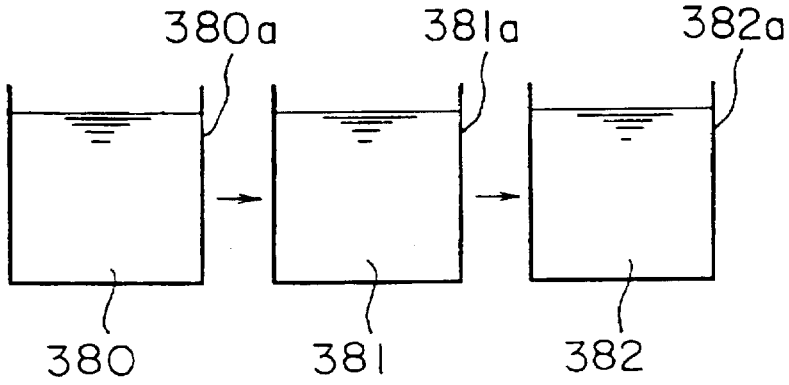
FIG. 25 is a drawing to show treating steps for removing the forming die from the cast product.

Then, as shown in FIG. 25, the aluminum cast product 340, core 320 and forming die 330 are subjected to a salt bath treatment in a molten salt 380 stored in a tank 380*a*. This salt bath treatment in the molten salt 380 decomposes the organic material comprised of the thermosetting synthetic resin in the core 320 and forming die 330.

As the molten salt 380, an alkaline salt (trade name: DGS, No. 4, No. 5 or No. 10) manufactured by KOLENE Company, U.S.A. is used, for example.

Such an alkaline salt becomes liquefied when heated to a predetermined temperature. The salt bath treatment in the liquid alkaline salt oxidizes the organic material comprised of the thermosetting synthetic resin in the core 320 and forming die 330 to form carbon dioxide gas and sludge mainly composed of $Na_2CO_3$. Among them, the carbon dioxide gas is discharged from the molten salt 380, and the sludge precipitates on the bottom of the tank 380*a*. At the same time, powder graphite in the core 320 and forming die 330 precipitates on the bottom of the tank 380*a*.

The sludge and graphite, precipitating on the bottom of the tank 380*a*, are removed as occasion demands.

Heating conditions and a treating period of the salt bath treatment differ depending on the type of the alkaline salt, and it is preferred that the heating temperature be in the range of from 380° C. to 460° C. and that the treating period be a few ten seconds.

The core 320 and forming die 330 are removed from the aluminum cast product 340 by the salt bath treatment in the molten salt 380, and then the aluminum cast product 340 is pulled up from the tank 380*a*. Next, the aluminum cast product 340 is post-treated in diluted nitric acid 381 (1% concentration) stored in a tank 381*a*. An oxidized layer is formed on the surface of the aluminum cast product 340 by the salt bath treatment in the molten salt 380, but it is removed from the surface of the aluminum cast product 340 by the treatment in diluted nitric acid 381. At the same time, the surface of the aluminum cast product 340 is neutralized.

Then, the aluminum cast product 340 is washed with high-temperature (about 80° C.) water 382 stored in a tank 382*a*, thereby obtaining the aluminum cast product (piston) 340 from which the core 320 and forming die 330 are completely removed. In this case, the through hole 340*a* is formed in the aluminum cast product 340 by the projecting portion 321, and the metal molded article 322 composed of the body 322*a* and the leg portion 322b is formed in the space 343 in the aluminum cast product 340 (FIG. 22). This metal molded article 340 functions as a radiation plate c the piston 340.

As described above, according to the present embodiment, the core 320 and forming die 330 can be readily removed from the cast product 340, by after casting the aluminum cast product 340 using the core 320 and form die 330, taking the cast product 340, core 320, and forming die 330 from the stationary die 311 and the moving die 312, and then subjecting the cast product 340, core 320, and forming die 330 to the salt bath treatment in the molten salt 380. The cast product 340 is then subjected to the oxidation treatment in the diluted nitric acid 381 and thereafter is washed in high-temperature water 382. Accordingly, the cast product 340 having complicated shapes of inner and outer surfaces can be readily and simply obtained.

The above embodiment showed a case in which the forming die 330 was set in the cavity 315 in the moving die 312, but forming die 330 is not necessarily set therein. If the forming die 330 is not set, the core 320 may be comprised of powder graphite and an organic material for binding the powder graphite with each other, and, for example, a thermoplastic synthetic resin such as polycarbonate, or a natural adhesive such as starch, paste, etc. may be used as the organic material. In this case, heat of the molten aluminum 345 filled in the cavity 315 during casting transfers to the side of moving die 312 with large thermal conductivity, so that the core 320 does not soften or melt.

Then, the aluminum cast product 340 and core 320 are subjected to the salt bath treatment in the molten salt 380. In this case, the thermoplastic synthetic resin or natural adhesive contained in the core 320 is oxidized to be decomposed into carbon dioxide gas and sludge mainly containing $Na_2CO_3$.

Incidentally, if the forming die 330 is not set in the cavity 315 in the moving die 312, a metal buried portion 350 made of steel may be buried in a portion of the core 320 corresponding to a thick portion of the cast product 340 in order to prevent shrinkage of the cast product 340 (FIG. 19). The metal buried portion 350 is exposed to outside the core 320, and thermal conductivities are made even between the metal buried portion 350 located inside the cast product 340 and the moving die (made of steel) 312 located outside the cast product 340, whereby shrinkage of the cast product 340 can be prevented.

In addition, after being taken from the stationary die 311 and the moving die, the cast product 340, the core 320 and the forming die 330 may be heated in a furnace 400 (FIG. 24) so as to. flow the organic materials in the forming die 330 and the core 320. As a result, the forming die 330 and the core 320 are removed from the cast product 340. The cast product 340 is then subjected to the salt bath treatment in the molten salt 380 to decompose the rests of the organic materials of the forming die 330 and the core 320. Next, the cast product 340 is subjected to the oxidation treatment in the diluted nitric acid 381 and thereafter is washed in the high-temperature water 382.

Figure 39A:
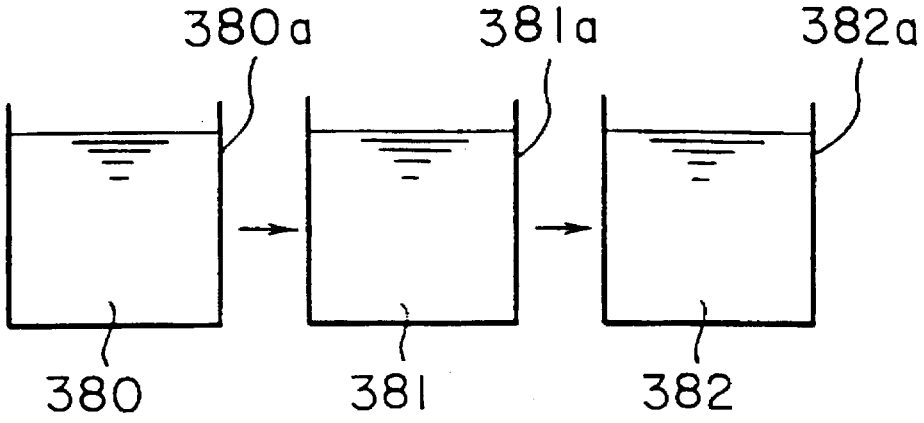
FIGS. 39A and 39B are drawings to show treating steps for removing the forming die from the cast product.
Figure 39B:
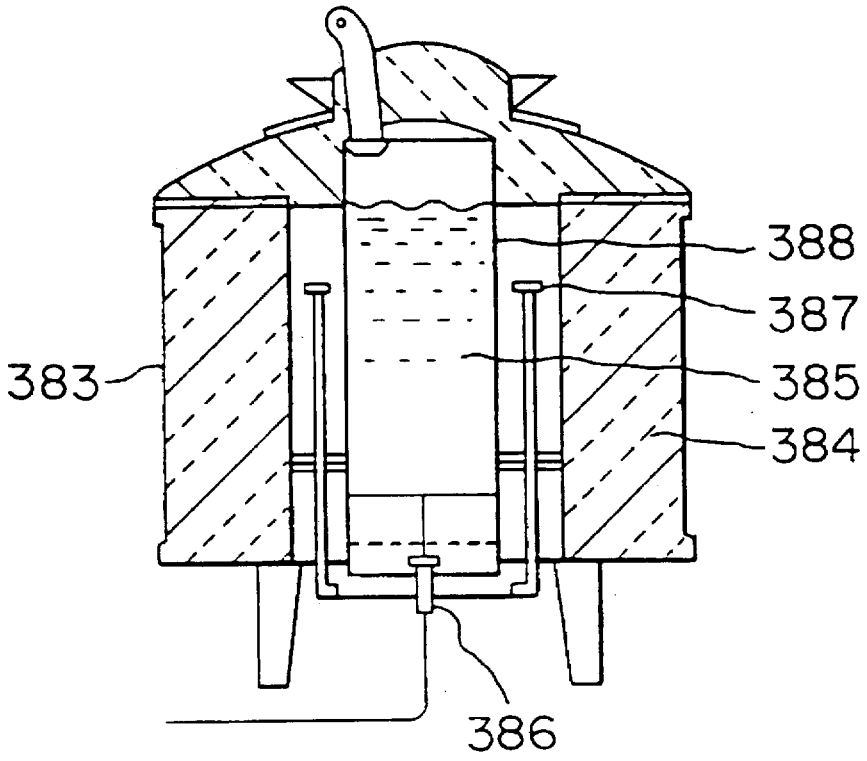

In this case, instead of being subjected to the salt bath treatment, the cast product 340 can be heat-treated in a fluidized layer 385 comprising alumina fine particles (or sand fine particles) to decompose the rests of the organic materials of the forming die 330 and the core 320 (FIG. 39B).

Otherwise, the cast product 340 can be immersed in a solvent to dissolve the rests of the organic materials of the forming die 330 and the core 320.

The solvent for dissolving to remove the organic materials is one selected from the following hydrocarbon solvents.

Methylene chloride (dichloromethane or methylene chloride), NMP (N-methyl-2-olefin), DMP (NN-dimethylformamide), MFK (methyl ethyl ketone), ethyl acetate (ester).

In the case of setting either of the forming die 330 and the core 320 in the cavity 315, after being heated in the furnace 400, the cast product 340 and either of them are subjected to the salt bath treatment, heat-treated in a fluidized layer 381 or immerse in the solvent to remove the rests of the organic materials of the forming die 330 and the core 320.

According to the present embodiment, the inner surface of the cast product can be readily formed by the core upon casting. The core is then removed from the cast product, whereby the cast product having a desired shape of inner surface can be readily obtained. Also, the inner surface and outer surface of the cast product can be readily formed by the core and forming die upon casting. The core and forming die are then removed from the cast product, whereby the cast product having desired shapes of inner and outer surfaces can be readily obtained.

Sixth Embodiment

A sixth embodiment of the present invention is described below referring to the drawings. FIG. 26 to FIG. 40B are drawings to show embodiments of a core, a casting method using the core, and a hollow piston according to the present invention.

Figure 27:
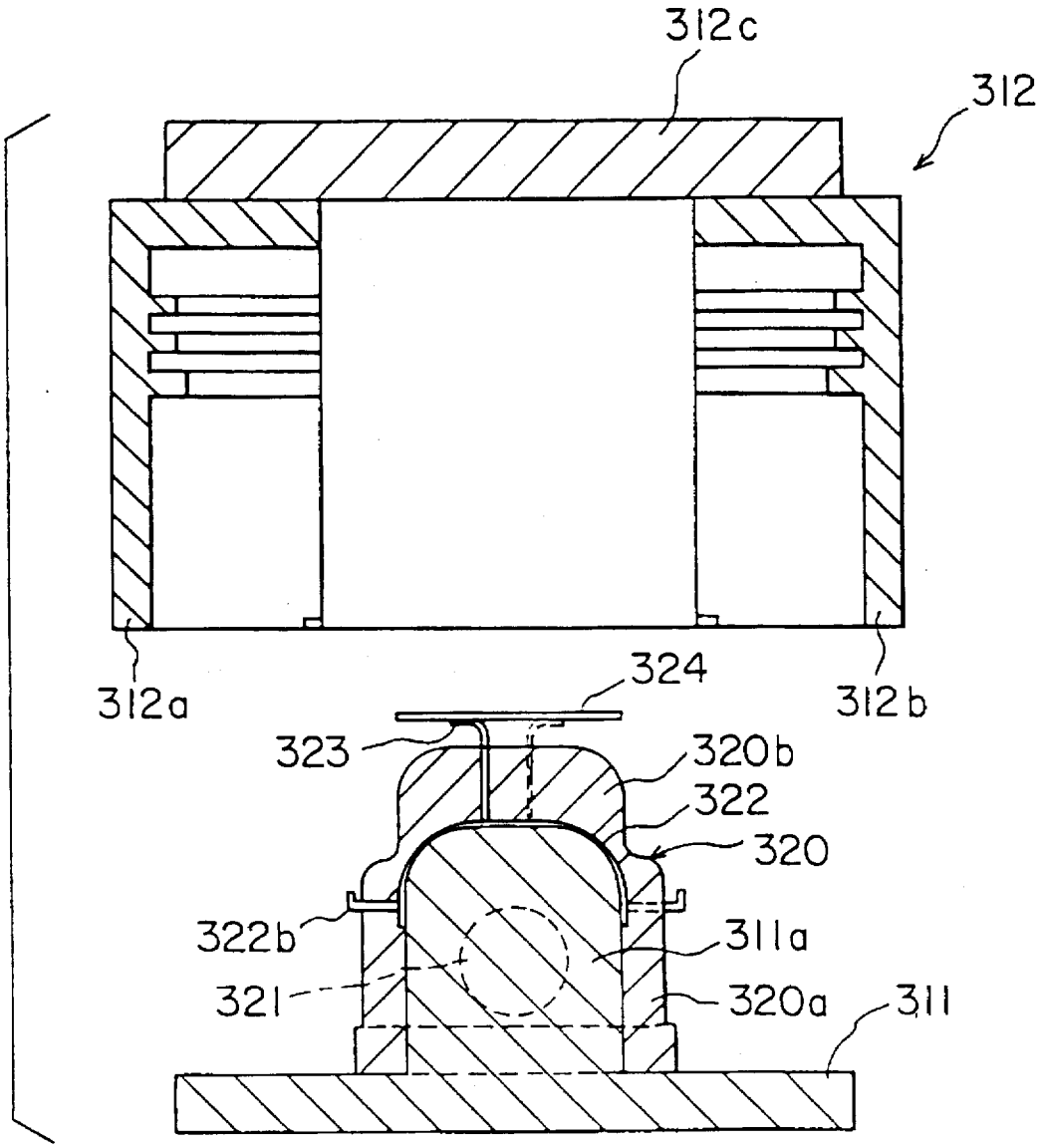
FIG. 27 is a sectional view to show a state in which the core is set in the stationary die.
Figure 28:
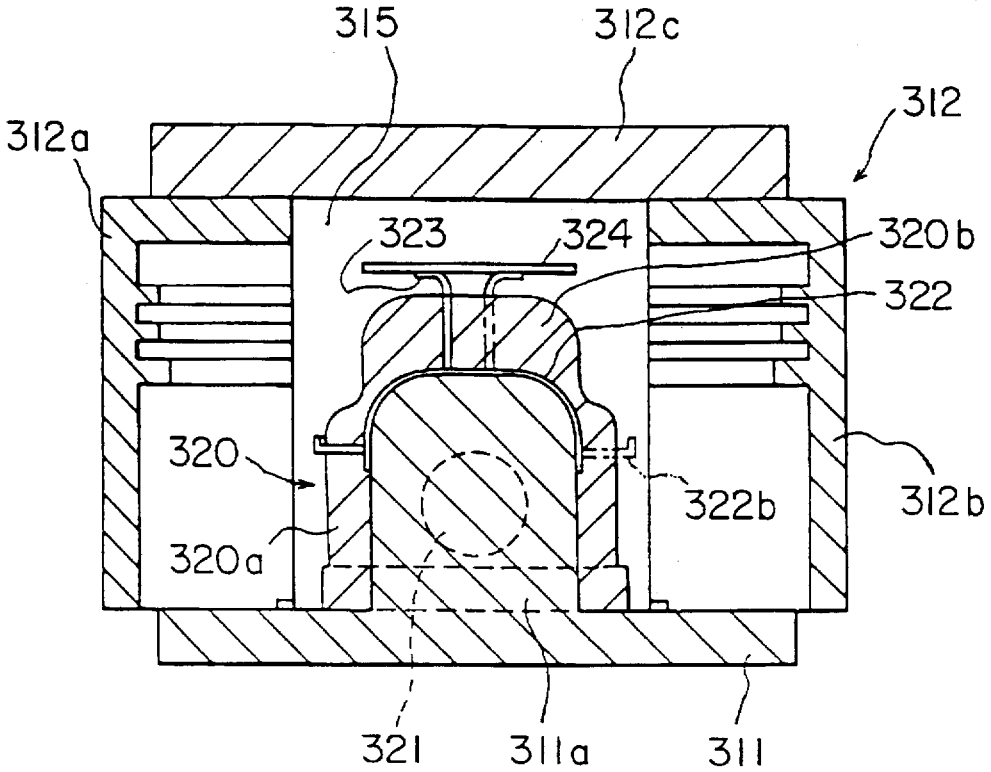
FIG. 28 is a sectional view to show a state in which the moving die is in close contact with the stationary die.
Figure 29:
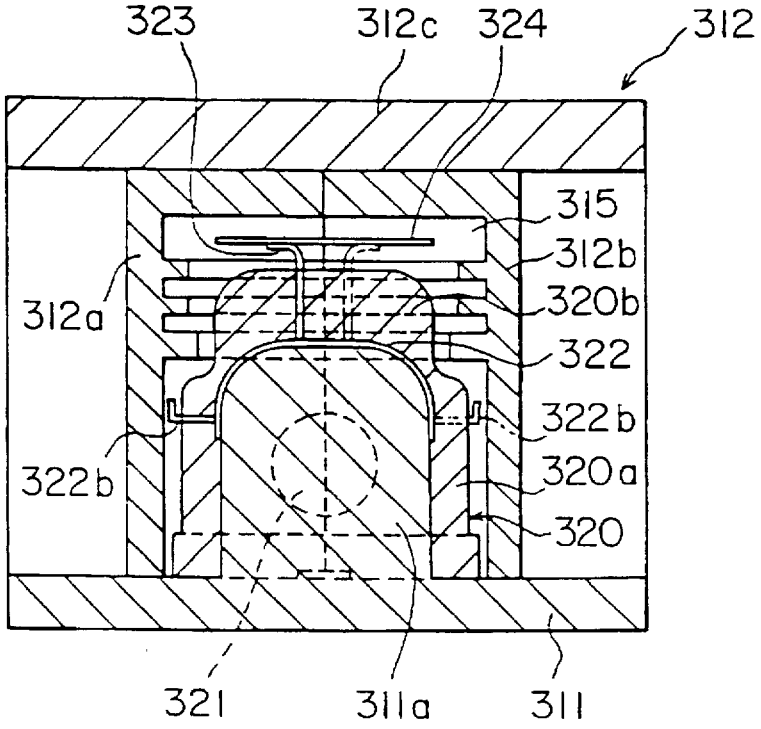
FIG. 29 is a sectional view to show a state in which split dies of the moving die are in close contact with each other.
Figure 35:
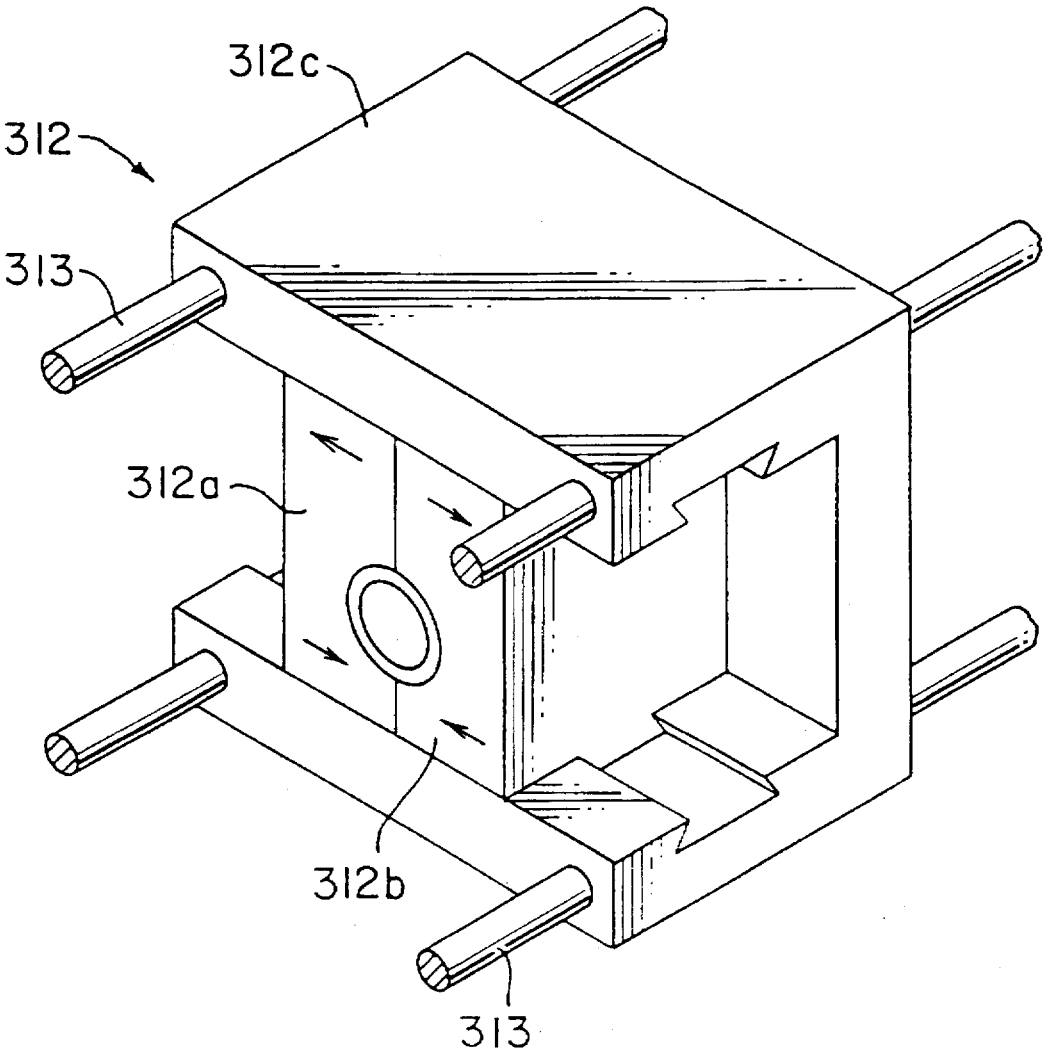
FIG. 35 is a perspective view to show the moving die.

First, an aluminum diecast casting apparatus is schematically described referring to FIG. 26 to FIG. 32, and FIG. 35. As shown in FIG. 29, FIG. 30A, and FIG. 30B, the aluminum diecast casting apparatus is provided with a stationary die 311 having a mount projection 311*a* and a moving die 312 arranged as movable relative to the stationary die 311. The moving die 312 is composed of an outer frame 312*c* and split dies 312*a*, 312*b* arranged as movable in the outer frame 312*c*. As shown in FIG. 35, the outer frame 312*c* is arranged to move along guides 313 away from or toward the stationary die 311. Also, the split dies 312*a*, 312*b* are arranged to leave or approach each other in directions perpendicular to the guides 313. A cavity 315 is formed between the split dies 312*a*, 312*b*, and the stationary die 311 is arranged to hermetically seal the cavity 315 in the split dies 312*a*, 312*b*.

Figure 30A:
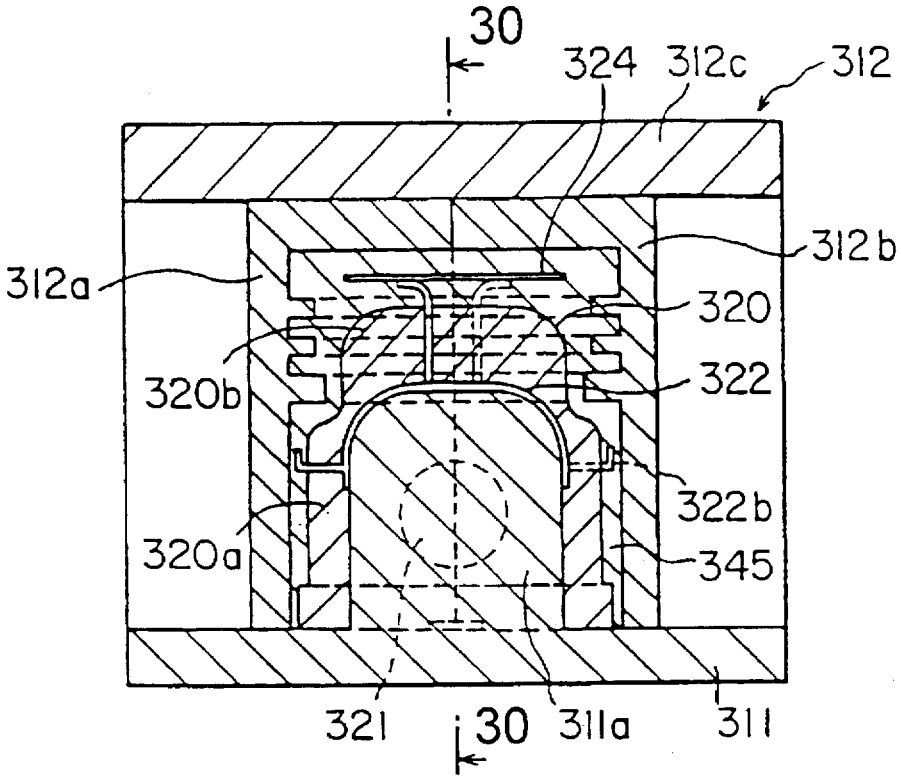
FIGS. 30A and 30B are drawings to show a state in which a molten metal is filled in the cavity of the moving die.
Figure 30B:
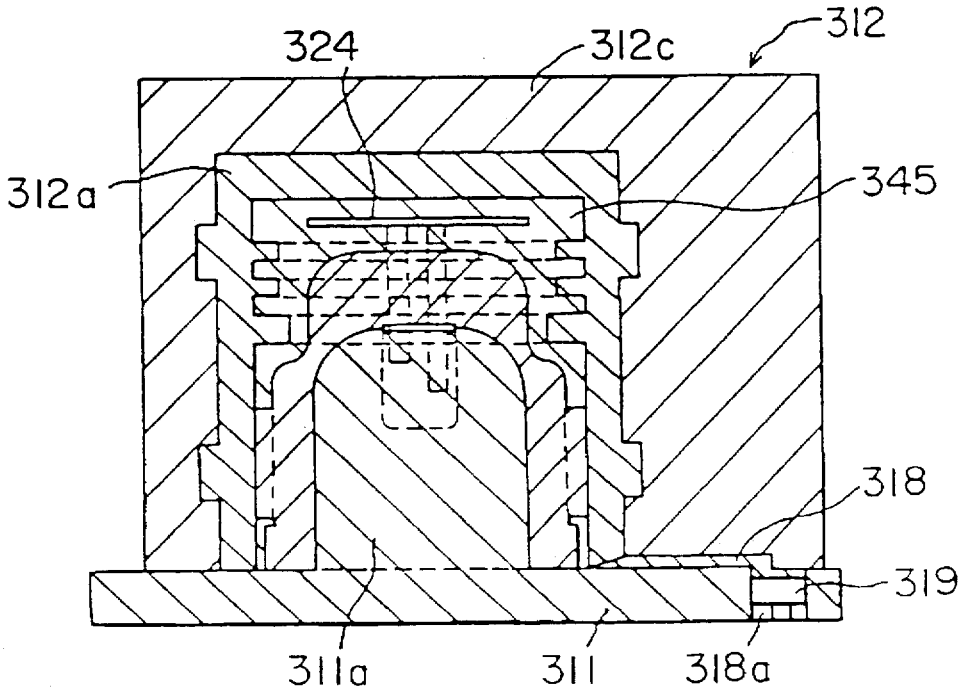

Further, as shown in FIGS. 30A and 30B, a gate 318, which communicates with the cavity 315, is formed in the outer frame 312*c* and, further, a guide path 318*a* having an input port for molten aluminum, which communicates with the gate 318, is formed in the stationary die 311. The guide path 318*a* is further provided with an extrusion piston 319 for extruding molten aluminum into the cavity 315. Here, FIG. 30A shows a state in which molten aluminum 345 is injected into the cavity 315, and FIG. 30B is a sectional view along the B-line.

Furthermore, as shown in FIG. 29, FIG. 30A, and FIG. 30B, a core 320 projecting into the cavity 315 in the moving die 312 is set in fit on the mount projection 311*a* of the stationary die 311, and the core 320 forms a space 343 in the aluminum cast product 340 (FIG. 34) described below. The stationary die 311 having the mount projection 311*a*, and the moving die 312 composed of the split dies 312*a*, 312*b* and the outer frame 312*c*, all are made of steel.

The cavity 315 in the moving die 312 is cylindrical when observed from the side of stationary die 311, and the core 320 is substantially cylindrical in correspondence with the cylindrical shape of the cavity 315.

Next described is a material for the core 320. The core 320 is comprised of powder graphite and an organic material having an adhesive function to bind the powder graphite. The organic material to bind the powder graphite can be a thermosetting synthetic resin such as a phenol resin, a urea resin, a melamine resin, an unsaturated polyester resin, a silicone resin, etc.

The thermosetting synthetic resin is one obtained generally by forming initial, linear polymer molecules and further raising the temperature to form bondings between them (crosslinking). As a result, a three-dimensional (stereoscopic) network is formed to increase the molecular weight, whereby it comes to have such a property that it does not soften when again heated.

A weight ratio between powder graphite and the thermosetting synthetic resin is in the range of 90:10 to 10:90 in this embodiment.

Further, powder graphite is a material of the hexagonal system and has the hardness of 1.5 and the relative density of 2.2. Graphite has excellent heat resistance and also has excellent lubricity (releasability) from the crystal structure thereof. Also, graphite has the considerable mechanical strength at high temperatures and has such a characteristic that it is soluble in neither inorganic solvents nor organic solvents.

Figure 34:
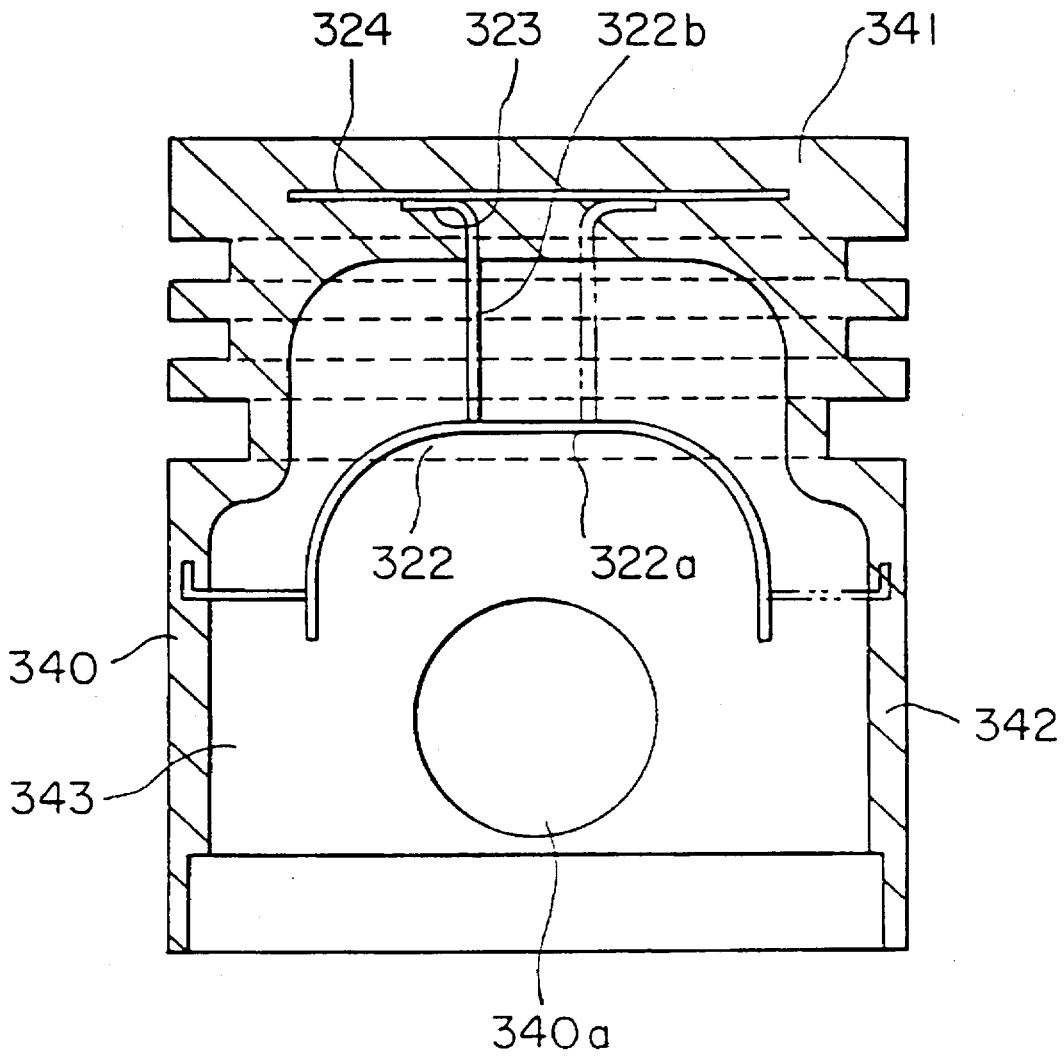
FIG. 34 is a sectional view to show the aluminum cast product provided with a copper molded article.
Figure 37:
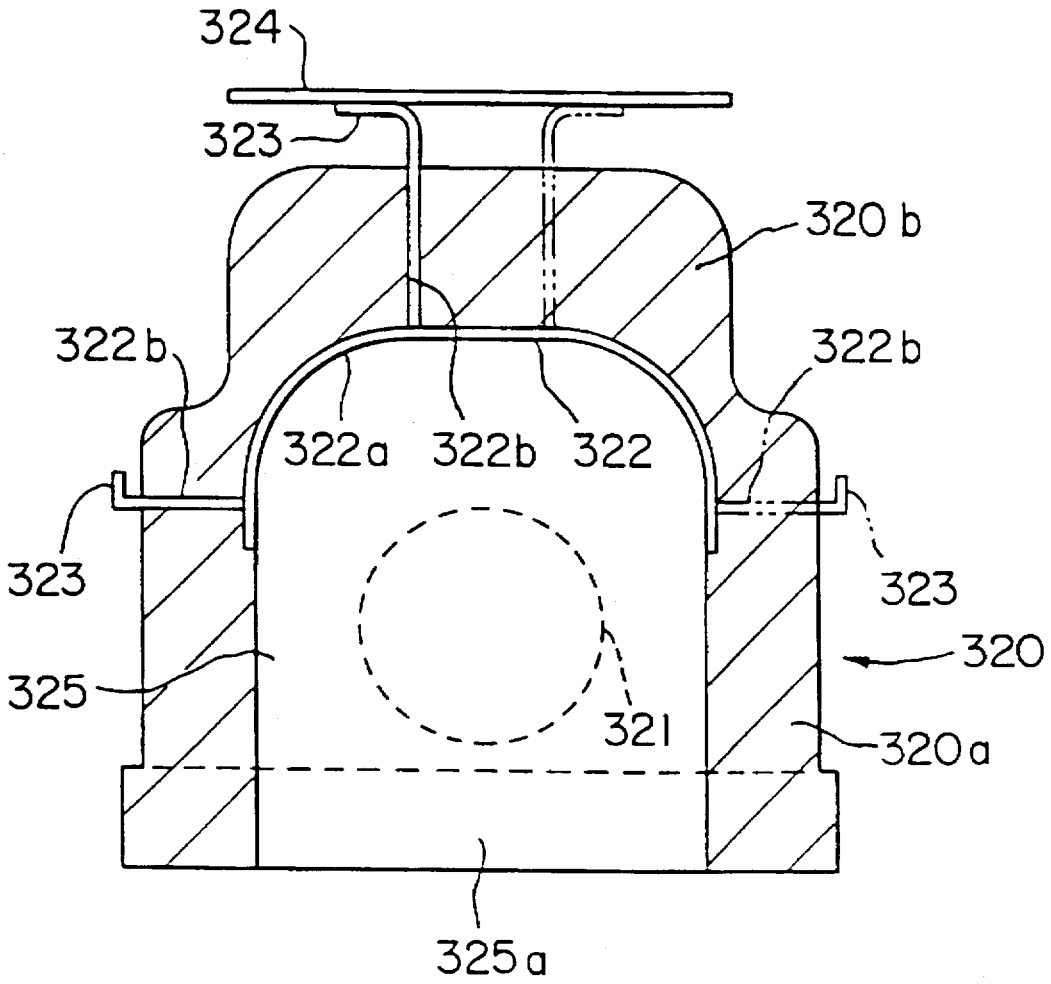
FIG. 37 is a sectional view to show the core in which the copper molded article is preliminarily buried
Figure 38:
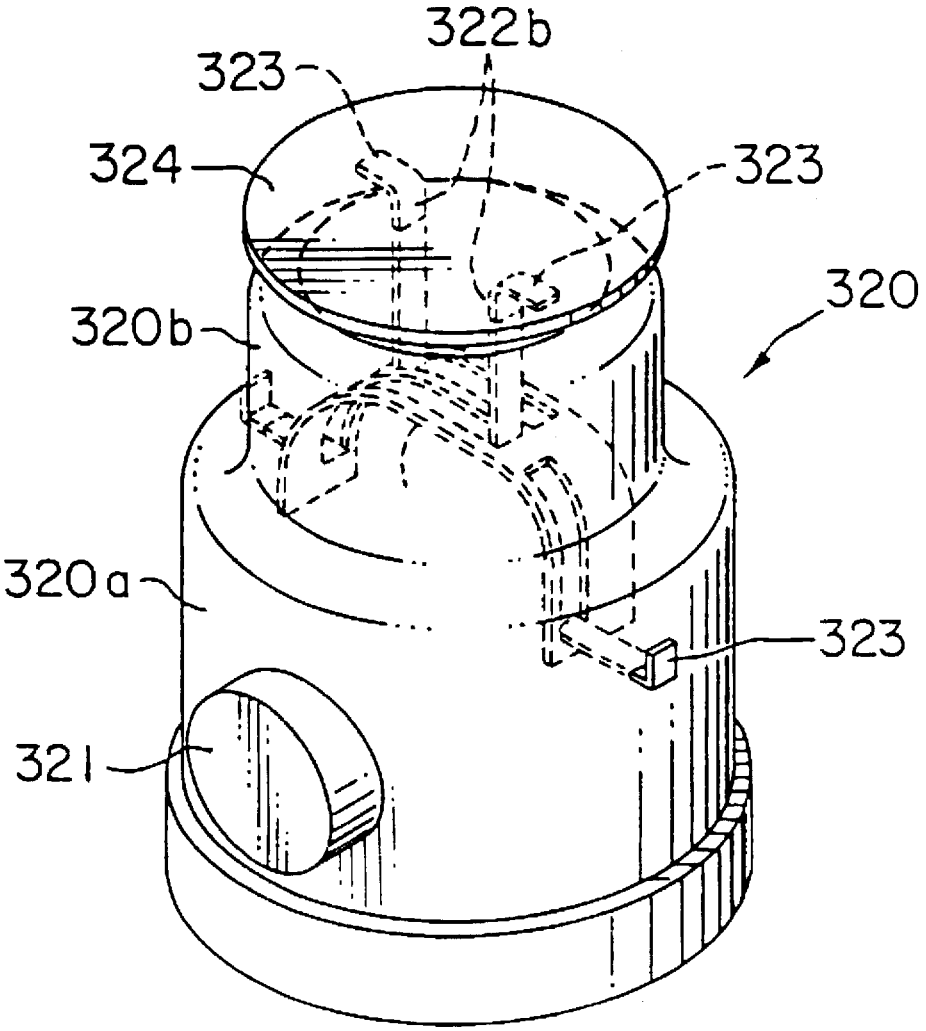
FIG. 38 is a perspective view to show the core in which the copper molded article is preliminarily buried.

Incidentally, as shown in FIG. 37 and FIG. 38, the core 320 has a large diameter portion 320*a* located on the side of stationary die 311, a small diameter portion 320*b* located on the side of moving die 312, and a projecting portion 321, formed on the large diameter portion 320*a*, for forming a through hole 340a in the aluminum cast product 340 (FIG. 34). Further, a hollow portion 325 is formed inside the core 320, as opening one side 325*a*. The core 320 is mounted onto the mount projection 311*a* of the stationary die 311 from the side of the opening one side 325*a*.

Further, a metal molded article different in quality from the aluminum cast product 340, for example, a copper molded article 322, is preliminarily buried inside the core 320. When the aluminum cast product 340 is used as a hollow piston for an internal combustion engine, the copper molded article 322 can be used as a radiator apparatus. This copper molded article 322 is composed of a body 322*a* set along the inner surface of hollow portion 325 in the core 320, leg portions 322*b* extending outwardly from the body 322*a*, and a copper circular plate 324 connected to distal ends 323 of the leg portions 322*b* above the core 320, as shown in FIG. 37 and FIG. 38.

Figure 36A:
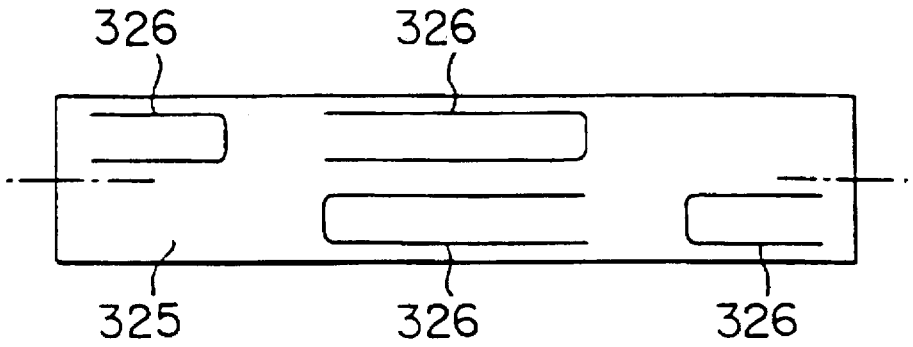
FIGS. 36A, 36B, and 36C are drawings to show producing steps of the copper molded article.
Figure 36B:
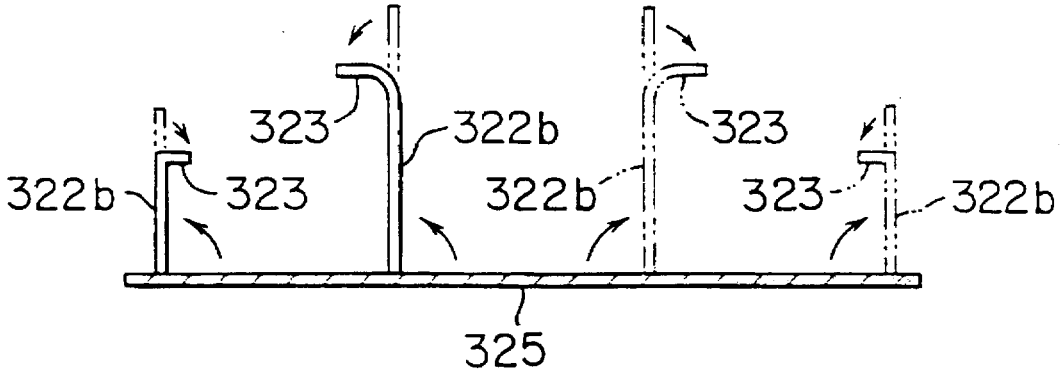
Figure 36C:
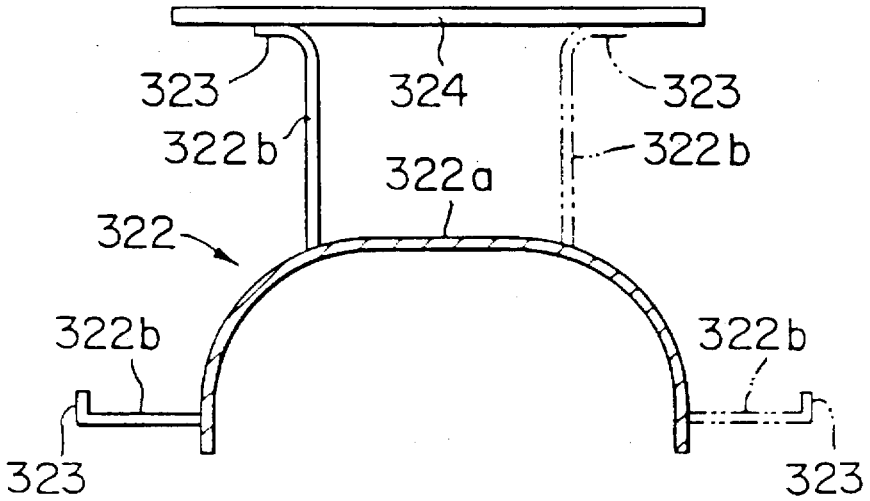

The copper molded article 322 is produced as follows. Namely, as shown in FIGS. 36A and 3322 the leg portions 322*b* are made to stand up along cut lines 326 from a copper plate 325, and then, the distal end 323 of each leg portion 322*b* is bent. Then, as shown in FIG. 36C, the copper plate 325 is bent in such a manner that the leg portions 322*b* are out, and the copper circular plate 324 is connected to the distal end 323 of each leg portion 322*b*. The copper molded article 322 composed of the body 322*a* , leg portions 322*b*, and copper circular plate 324 is produced in this manner.

Next, a solder coating layer is formed over the entire surface of the copper molded article 322. The solder coating layer has a function to melt during casing to enhance bonding strength between the aluminum cast product 340 and the copper molded article 322. Therefore, the solder coating layer may be arranged not to be formed over the entire surface of the copper molded article 322, but to be formed on parts of the copper molded article 322 being in contact with the aluminum casting product 340.

The copper molded article 322 is set in a resin molding die (not shown), and then a material for the core 320 is filled into the resin forming die. As shown in FIG. 37 and FIG. 38, the core 320 in which the copper molded article 322 is preliminarily buried therein is obtained by this procedure. In this case, the body 322*a* of the copper molded article 322 is arranged along the inner surface of the hollow portion 325 in the core 320 and the leg portions 322*b* extend outwardly from the body 322*a* with the distal ends 323 thereof projecting out from the core 320. Further, the copper circular plate 324 is connected to the distal ends 323 of the leg portions 322*b* above the core 320.

Figure 26:
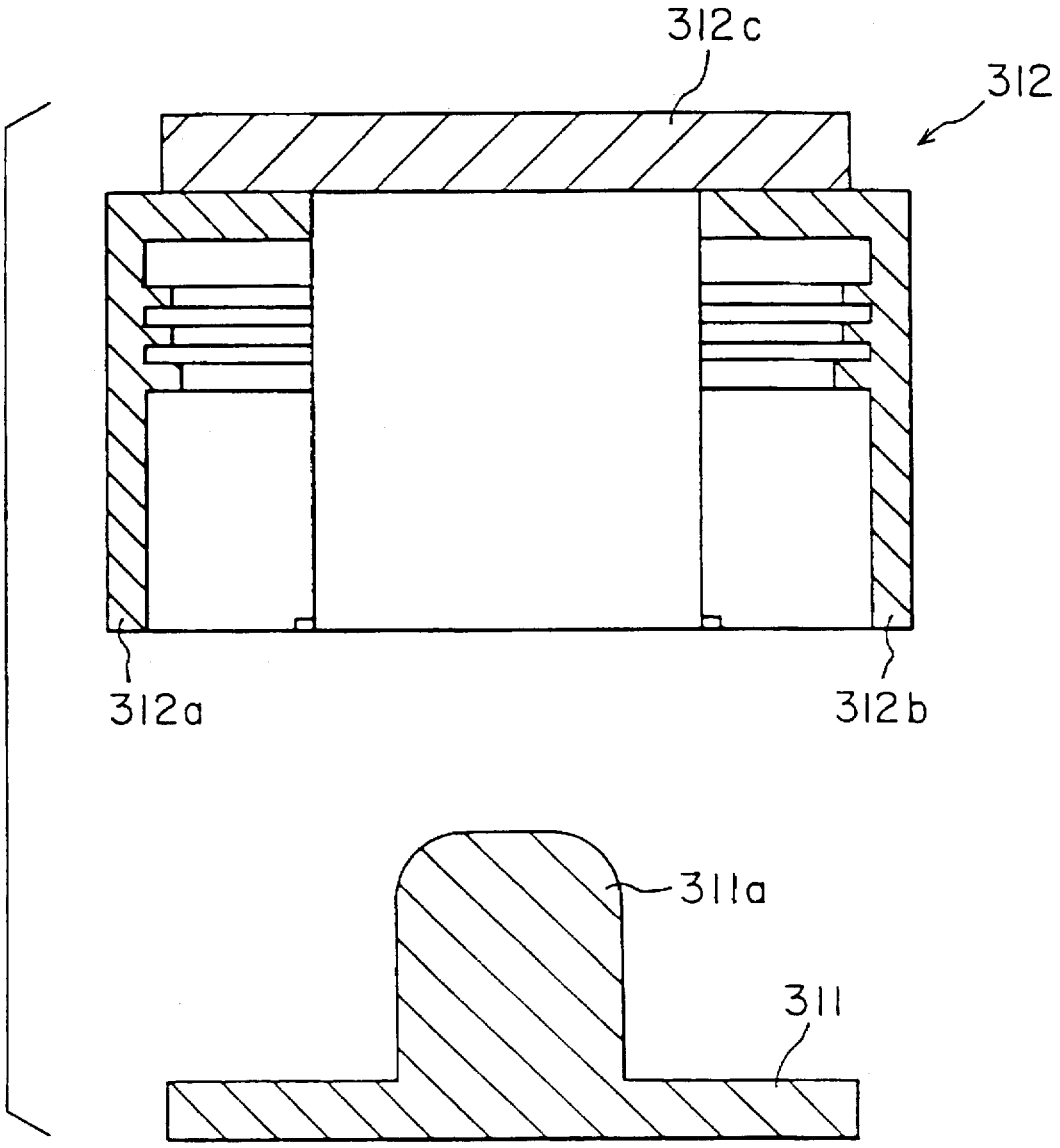
FIG. 26 is a drawing to show the stationary die and the moving die in the sixth embodiment of the present invention.

Next described is a casting method using the core 320 constructed in the above structure. First prepared, as shown in FIG. 26, are the stationary die 311 having the mount projection 311*a*, and the moving die 312 provided with a pair of split dies 312*a*, 312*b* inside the outer frame 312*c*. Then, as shown in FIG. 27, the core 320 is set on the mount projection 311*a* of the stationary die 311. The outer frame 312*c* in the moving die 312 moves toward the stationary die 311 along the guide 313 (FIG. 35), and then the split dies 312*a*, 312*b* in the moving die 312 comes into contact with the stationary die 311.

In this case, as shown in FIG. 28, the core 320 projects from the side of stationary die 311 between the split dies 312*a*, 312*b* in the moving die 312. In FIG. 28, the split dies 312*a*, 312*b* in the moving die 312 are retracted to positions where they are separate from each other in the outer frame 312*c*. Then, as shown in FIG. 29, the split dies 312*a*, 312*b* approaches each other in the outer frame 312*c*, so that the split dies 312*a*, 312*b* come into close contact with each other to form the cavity 315 between the split dies 312*a*, 312*b*. At the same timer the cavity 315 is hermetically sealed by the stationary die 311.

Next, as shown in FIGS. 30A and 30B, the extrusion piston 319 is driven to charge molten aluminum 345 into the cavity 315 through the guide path 318*a* and the gate 318. The molten aluminum 345 filled in the cavity 315 is rapidly cooled by the split dies 312*a*, 312*b* in the moving die 312, whereby the aluminum cast product 340 is formed by this casting method. Here, heat transfer occurs also from the molten aluminum 345 to the core 320. Since the thermal conductivity of the core 320 comprised of powder graphite and the thermosetting resin is smaller than that of the steel moving die 312, the heat transfer to the core 320 is smaller than that to the moving die 312.

Furthermore, since the core 320 is comprised of powder graphite and the thermosetting resin cured by heat, it becomes further cured by heat when the thermosetting resin is heated. Therefore, the core 320 does not soften or melt upon casting.

Figure 31:
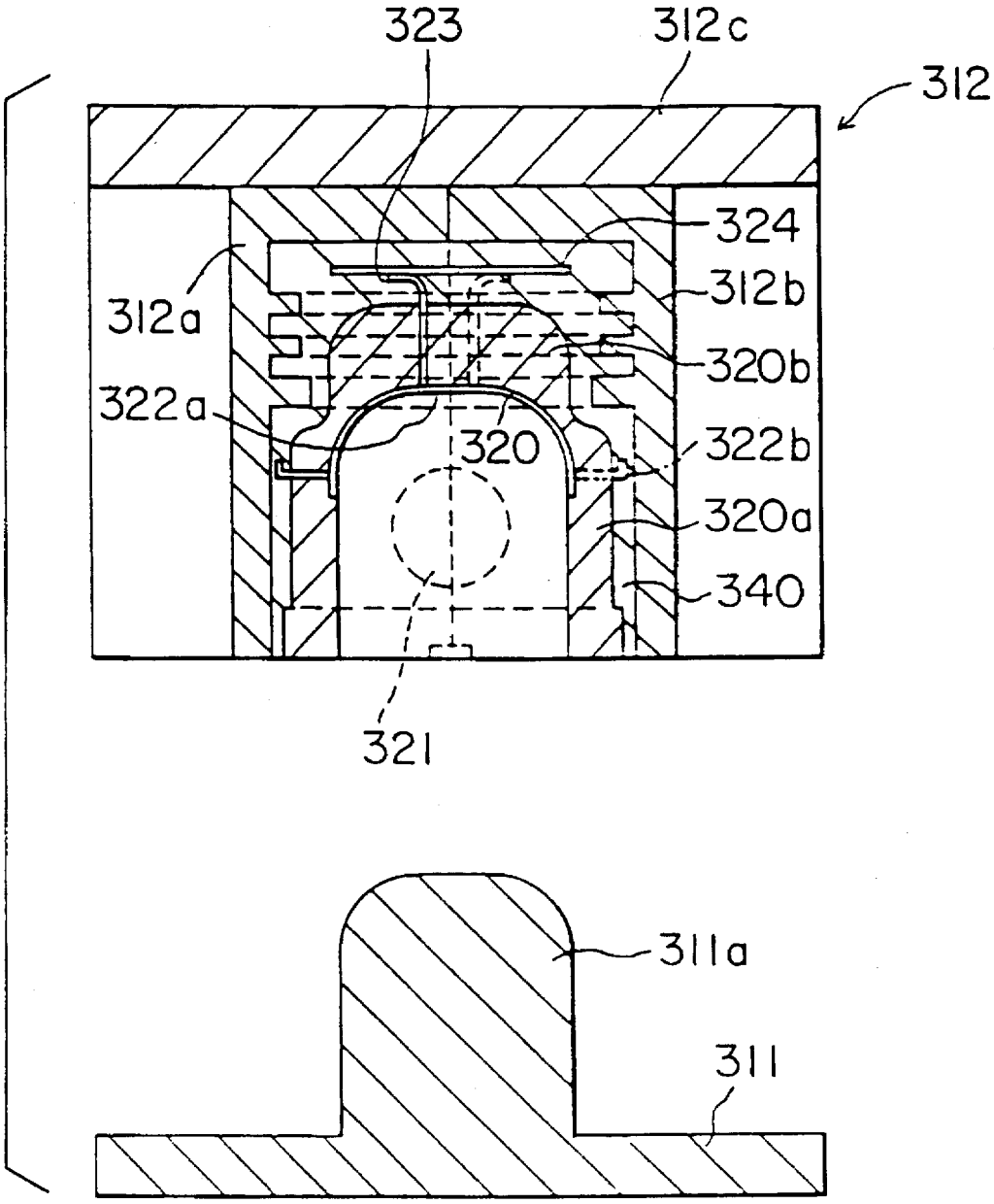
FIG. 31 is a sectional view to show a state in which the moving die is separated from the stationary die.
Figure 32:
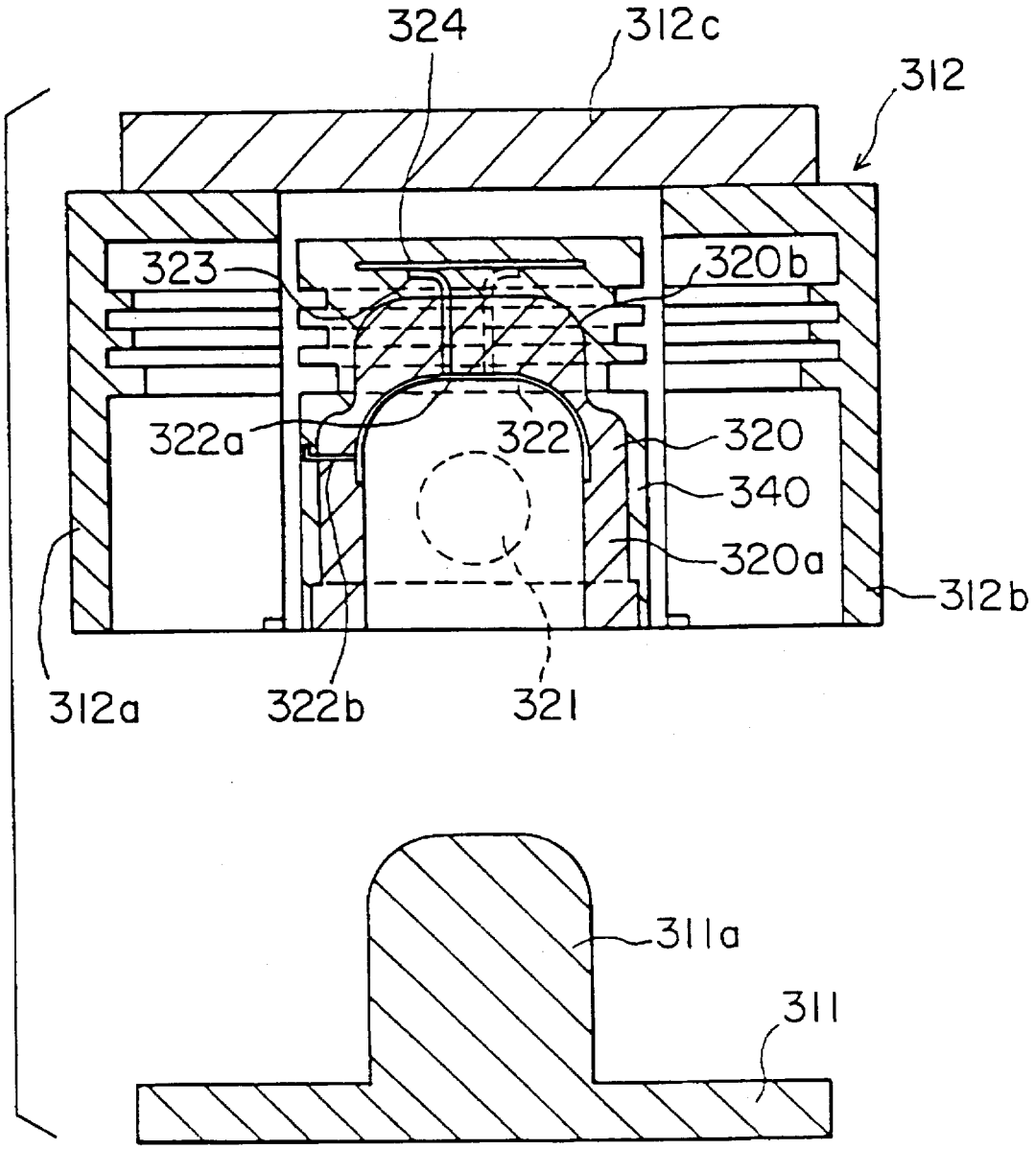
FIG. 32 is a sectional view to show a state in which the split dies of the moving die are separated from each other.
Figure 33:
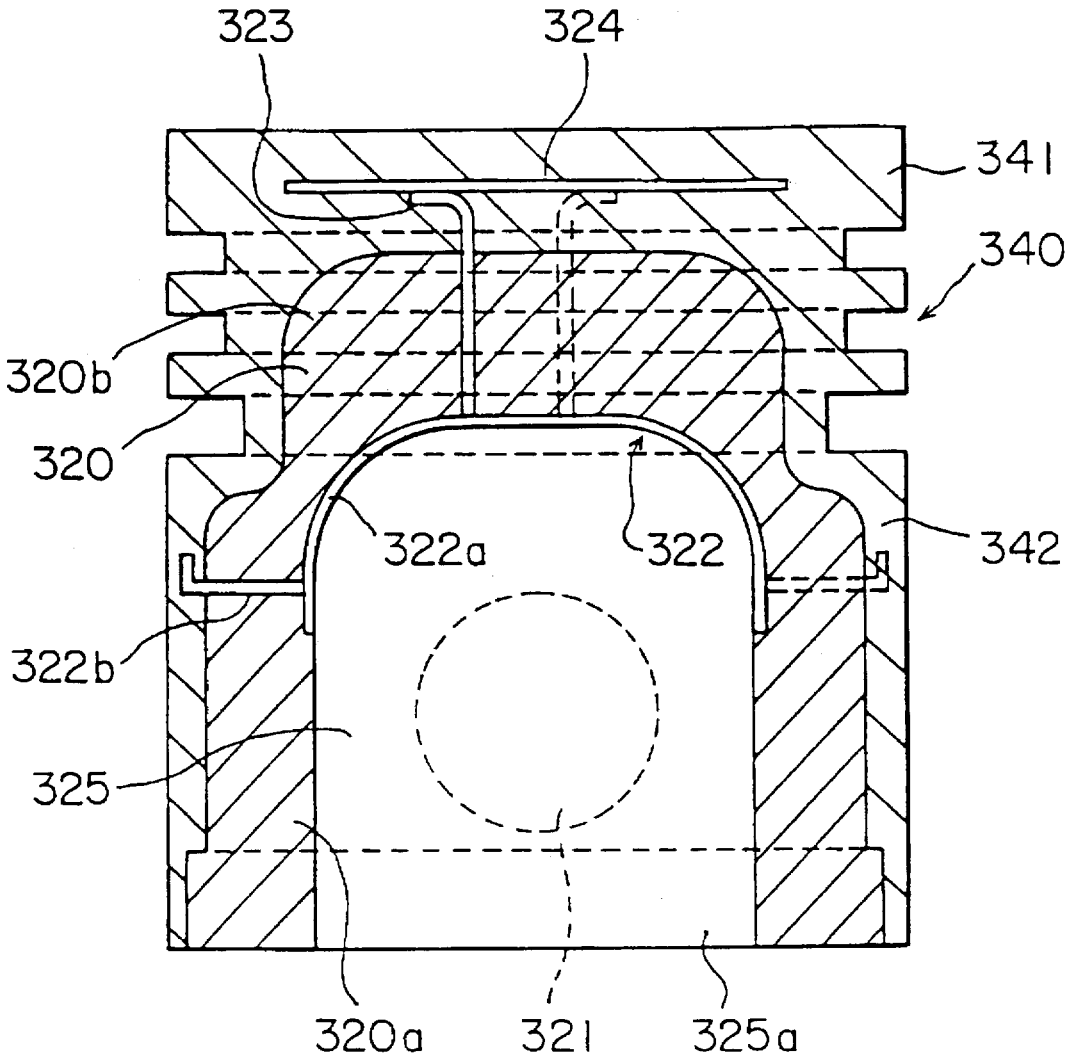
FIG. 33 is a sectional view to show the aluminum cast product in which the core is incorporated.

As shown in FIG. 31, the outer frame 312*c* in the moving die 312 is next moved along the guides 313 (FIG. 35), whereby the moving die 312 is separated from the stationary die 311. In this case, because the core 320 has excellent lubricity and releasability because of the graphite component, the core 320 can be easily and simply removed from the mount projection 311*a* of the stationary die 311 Then, as shown in FIG. 32, the split dies 312*a*, 312*b* in the moving die 312 are separated from each other, and aluminum cast product 340 is removed together with the 320 from the cavity 315 formed in the moving die 312.

The aluminum cast product 340 in which the core 320 is incorporated is obtained in this manner. The aluminum cast product 340 is used as a hollow piston for internal combustion engine, which is composed of a top wall 341 in which the copper circular plate 324 is buried, and a side wall 342 opening one side and having the space 343.

Then, the aluminum cast product 340 and core 320 are subjected to a salt bath treatment in a molten salt 380 stored in a tank 380*a*, as shown in FIG. 39A. This salt bath treatment in the molten salt 380 decomposes the organic material comprised of the thermosetting resin in the core 320.

As the molten salt 380, an alkaline salt (trade name: DGS, No. 4, No. 5, or No. 10) manufactured by KOLENE Company, U.S.A. is used, for example.

When heated to a predetermined temperature, such an alkaline salt becomes liquefied. The salt bath treatment in the liquid alkaline salt oxidizes the organic material comprised of the thermosetting resin in the core 320 to decompose it into carbon dioxide gas and sludge mainly composed of $Na_2CO_3$. Among them, the carbon dioxide gas is discharged out from the molten salt 380, and the sludge precipitates on the bottom of the tank 380*a*. At the same time, powder graphite in the core 320 precipitates on the bottom of the tank 380*a*.

The sludge and graphite, precipitating on the bottom of the tank 380*a*, are removed as occasion demands.

Heating conditions and a treating period of the salt bath treatment differ depending on the type of the alkaline salt, and it is preferred that the heating temperature be in the range of from 380° C. to 460° C. and that the treating period be a few ten seconds.

The core 320 is removed from the aluminum cast product 340 by the salt bath treatment in the molten salt 380, and then the aluminum cast product 340 is pulled up from the tank 380*a*. Next, the aluminum cast product 340 is post-treated in diluted nitric acid 381 (1% concentration) stored in a tank 381*a*. An oxidized later is formed on the surface of the aluminum cast product 340 by the salt bath treatment in the molten salt 380, but it is removed from the surface of the aluminum cast product 340 by the treatment in diluted nitric acid 381. At the same time, the surface of the aluminum cast product 340 is neutralized.

Then, the aluminum cast product 340 is washed with high-temperature (about 80° C.) water 382 stored in a tank 382*a*, thereby obtaining the aluminum cast product (a hollow piston for internal combustion engine) 340 from which the core 320 is completely removed. In FIG. 34, the through hole 340*a* is formed in the aluminum cast product 340 by the projecting portion 321 in the core 320, and the aluminum cast product 340 is provided with the copper molded article 322.

In this case, the cast product 340 is composed, as shown in FIG. 34, of the top wall 341 and the side wall 342 inside of which the space 343 is formed, and one side of the space is open. The copper circular plate 324 of the copper molded article 322 is buried in the top wall 341, and the copper circular plate 324 is connected to the body 322*a* through the leg portions 322*b* . This body 322*a* is disposed inside the space 343.

When the cast product 340 is used as a hollow piston for internal combustion engine, the top wall 341 becomes a portion directly heated in a combustion chamber, and heat of the top wall 341 is transferred to the body 322*a* from the copper circular plate 324 through the leg portions 322*b* . Then the heat in the body 322*a* is discharged into the space 343.

The cast product 340 as a hollow piston may be produced not only by the aluminum diecast casting method, but also by the gravity casting method.

FIG. 39A showed an example in which the thermosetting resin in the core 320 was decomposed by the salt bath treatment, but the cast product 340 and core 320 may be heat-treated in a fluidized layer 385 comprising alumina fine particles (or sand fine particles), as shown in FIG. 39B. Namely, in FIG. 39B, a tank 388 forming the fluidized layer 385 is provided in a casing 383 and a heater 387 is provided outside the tank 388.

Alumina fine particles (or sand fine particles) are stored in the tank 388, and the fluidized layer 385 composed of the alumina fine particles (or sand fine particles) is formed inside the tank 388 by blowing a gas into the tank 388 through a nozzle 386 from the lower part of the tank 388. The fluidized layer 385 is heated by the heater 387 up to 800° C. to 900° C., and the cast product 340 and core 320 are put into the fluidized layer 385 thus heated, whereby the thermosetting resin in the core 320 can be decomposed into gas.

Next described are modifications of the material for the core 320.

The embodiment described above showed an example in which the core 320 was comprised of powder graphite and the thermosetting resin, but the core 320 may be comprised of a heat-resistant inorganic material of powder graphite and an organic material for bonding powder graphite. The organic material may be, for example, a thermoplastic synthetic resin such as polycarbonate, a natural adhesive such as starch, paste, etc., or a synthetic adhesive (for example, Cemedine). Further, a rubber may be used as the organic material.

Further, instead of the heat-resistant inorganic material of powder graphite, another heat-resistant inorganic material such as powder silicon, powder ceramic, powder glass or powder talc may be used.

Furthermore, the entire core 320 may be comprised of the thermosetting resin or the thermoplastic resin.

Whatever material as described above is used for the core 320, the thermal conductivity of the core 320 is far smaller than the thermal conductivity of the moving die 312 made of steel, whereby the heat of the molten aluminum 345 transfers to the side of moving die 312 during casting. Therefore, heat transfer to the side of core 320 with smaller thermal conductivity becomes small, and thus, the core 320 does not soften or melt.

Whatever material as described above is used for the core 320, the aluminum cast product 340 and core 320 are treated in the molten salt 380 or in the fluidized layer 385 composed of the alumina particles (or sand particles), to decompose the organic material in the core 320, and then the core 320 can be removed from the aluminum cast product 340.

As described above, according to the present embodiment, the core 320 can be removed from the cast product simply by, after casting the aluminum cast product 340 using the core 320, taking out the cast product 340 and core 320 out of the stationary die 311 and moving die 312 and thereafter subjecting the cast product 340 and core 320 to the salt bath treatment in the molten salt 380 or to the heat treatment in the fluidized layer 385. The cast product 340 having complicated shapes of inner surface and outer surface can be easily and simply produced accordingly.

(Modifications)

Figure 40A:
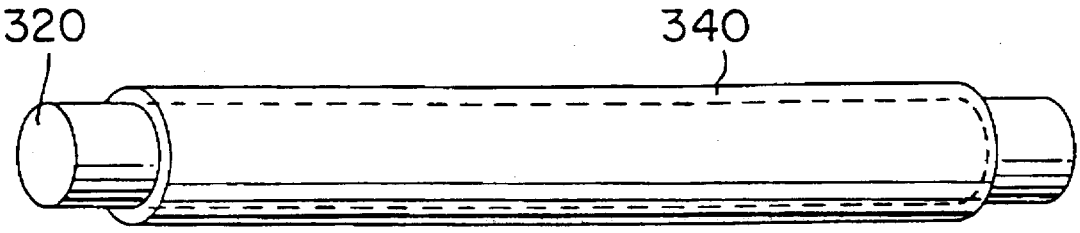
FIGS. 40A and 40B are drawings to show a modification of the core and the casting method using the core according to the present invention.
Figure 40B:
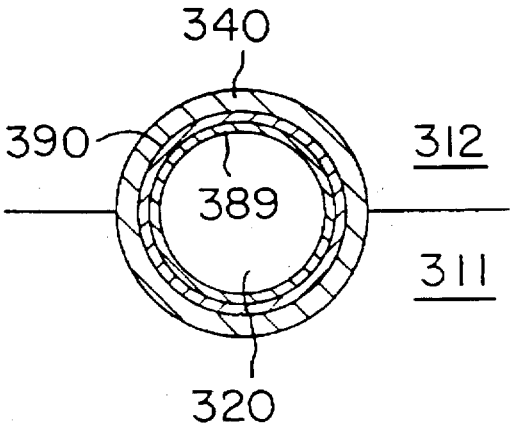

A modification of the present invention is described below referring to FIGS. 40A, 40B. As shown in FIGS. 40A and 40B, the core 320 is set between a stationary die 311 and a moving die 312. The core 320 is comprised of powder graphite and a thermosetting resin for binding the powder graphite.

Further, a copper plating 389 is formed on the surface of core 320 and a solder coating layer 390 is further formed on the surface of copper plating 389.

An aluminum cast product 340, for example, for piping, is obtained by setting the core 320 between the stationary die 311 and the moving die 312 and then injecting molten aluminum between the stationary die and the moving die 312. Then, the aluminum cast product 340 incorporated with the core 320 is subjected to a treatment in the molten salt 380 or fluidized layer 385 as described above to decompose the thermosetting resin in the core 320, and then the core 320 is removed from the aluminum cast product 340.

The aluminum cast product 340, for example, for piping, provided with the copper plating 389 inside, is obtained in this manner. In this case, the solder coating layer 390 functions to enhance bonding strength between the aluminum cast product 340 and the copper plating 389.

Further, the material for core 320 may be the same material as in the embodiment shown in FIG. 26 to FIG. 39B.

Figure 41A:
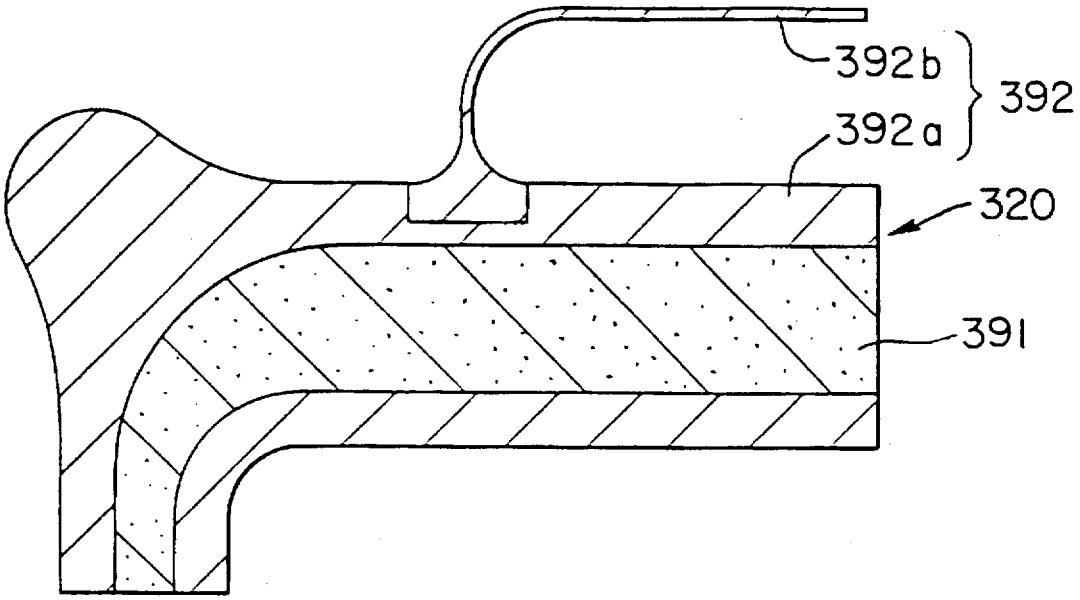
FIGS. 41A and 41B are drawings to show another modification of the core and the casting method using the core according to the present invention.

Next described is another modification of the present invention referring to FIG. 41A to FIG. 44. First, the core 320 is described referring to FIGS. 41A, 41B. FIG. 41A is a sectional view of the core and FIG. 41B is a sectional view of the surface of core. As shown in FIG. 41A, the core 320 has a center member 391 made of blowing styrol, and a core body 392 made of powder graphite bound with a thermosetting resin and formed outside the center member 391.

Figure 44:
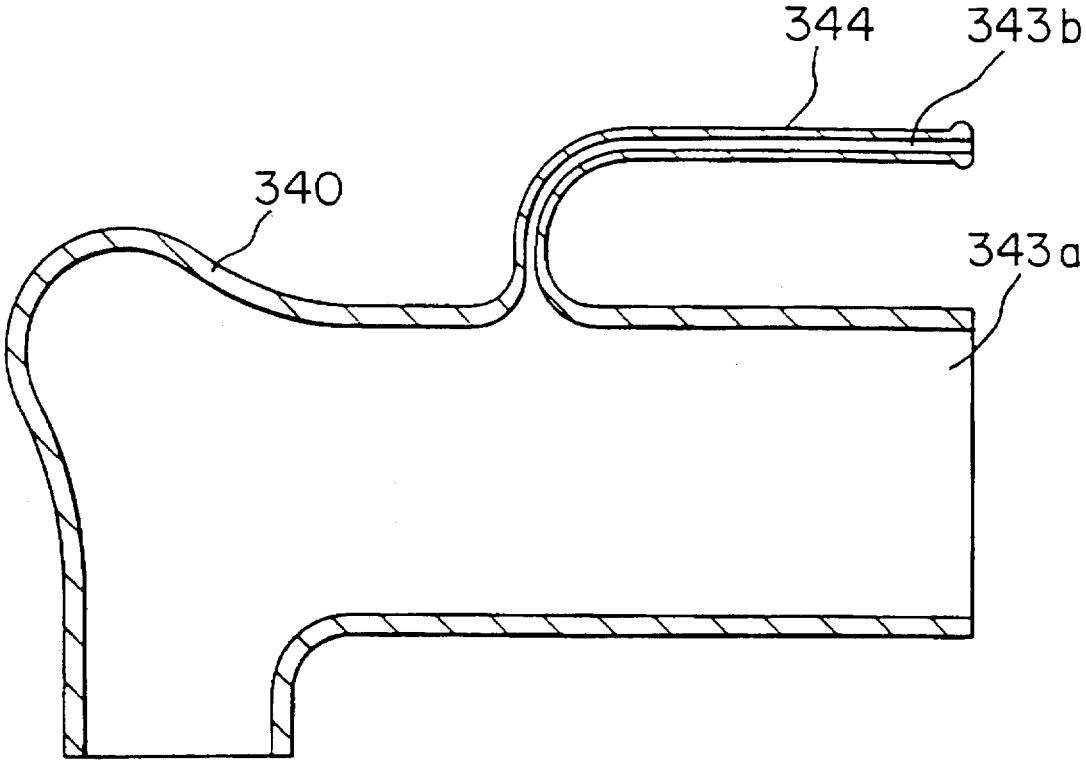
FIG. 44 is a sectional view to show the aluminum cast product.

The core body 392 of the core 320 is further composed of a thick portion 392*a* being relatively thick and a thin portion 392 being thinner than the thick portion 392, which extends outwardly from the thick portion 392*a*. Among them, the thick portion 392*a* is a portion for forming a space 343*a* having a relatively large diameter in the cast product 340, and the thin portion 392*b* is a portion for forming a space 343*b* having a relatively small diameter in a branch tube 344 (FIG. 44).

A weight ratio of powder graphite to the thermosetting resin in the thick portion 392*a* is higher than that of powder graphite to the thermosetting resin in the thin portion 392*b*. Since the thick portion 392*a* is a portion requiring lubricity and releasability, the weight ratio of powder graphite is set low. On the other hand, because the thin portion 392*b* is a portion requiring strength and toughness, the weight ratio of the thermosetting resin is set high.

Figure 41B:
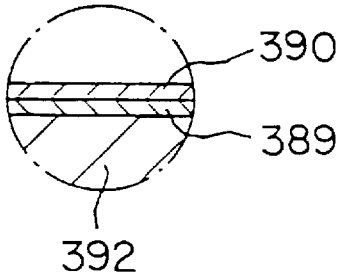

Further, as shown in FIG. 41B, a copper plating 389 is formed on the surface of core body 392, and a solder coating layer 390 is further formed on the surface of copper plate 389.

Figure 42:
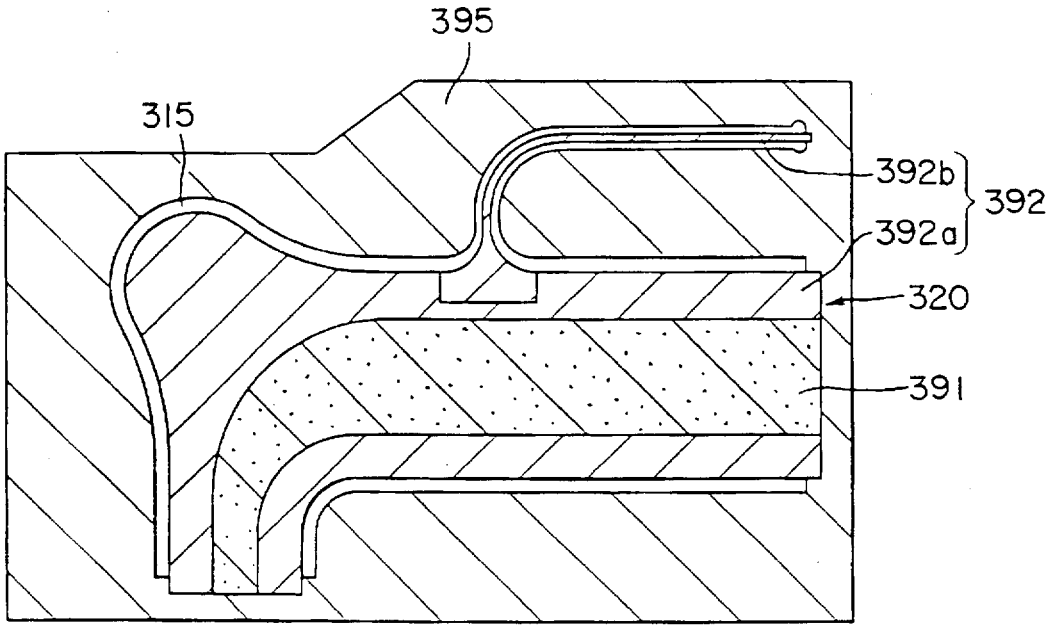
FIG. 42 is a sectional view to show a state in which the core is set in the casting die.

The core 320 having the above structure is then set in the casting die 395, so that a cavity 315 is formed between the inner surface of the casting die 395 and the outer surface of the core 320 (FIG. 42).

Figure 43A:
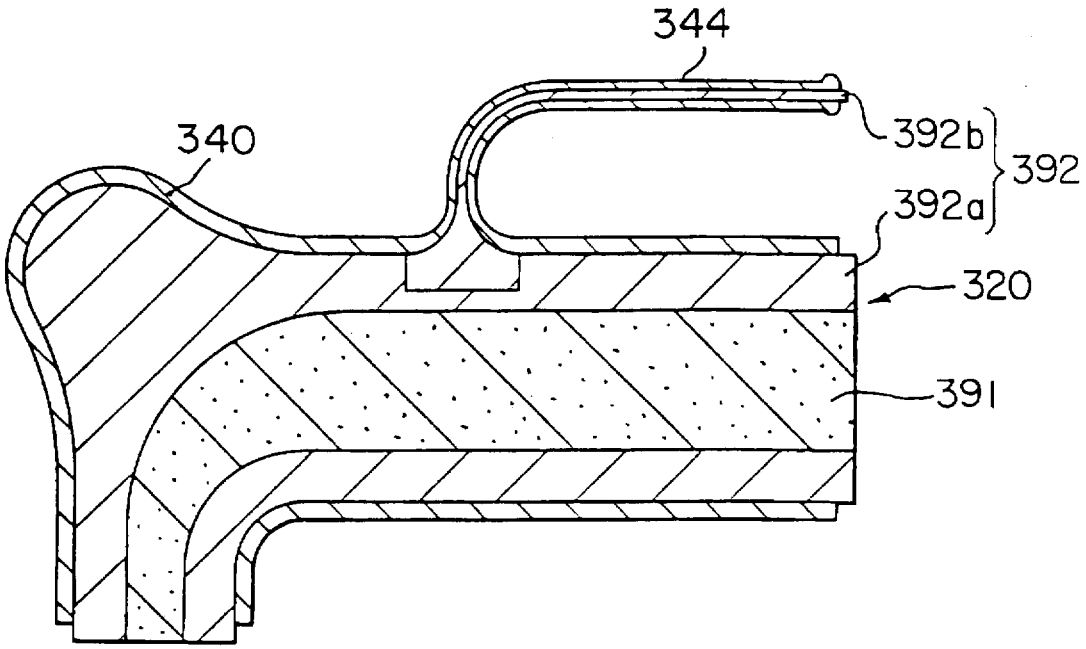
FIGS. 43A and 43B are sectional views to show the core and the cast product.
Figure 43B:
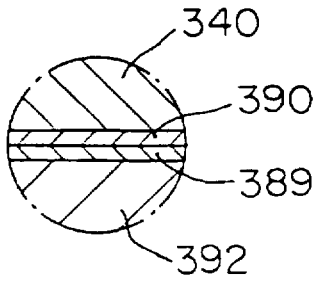

As shown in FIGS. 43A and 43B, molten aluminum is then injected into the cavity 315 in the casting die 395, and the molten aluminum is cooled by the casting die 395 to form the cast product 340. Here, FIG. 43A is a sectional view of the cast product 340 and core 320, and FIG. 43B is a sectional view of the surface of core 320. During casting, heat from the molten aluminum is transferred to the side of core 320; but, because the thermal conductivity of the core comprised of powder graphite and the thermosetting resin is far smaller than that of the casting die 395, heat transfer to the core 320 is extremely small.

Furthermore, although a gas is possibly generated from the thermosetting resin in the core 320 by heat from molten aluminum during casting, the gas from the core 320 is interrupted by the copper plating 389, whereby the gas does not flow out, but flows to the inside. Therefore, no porosity is formed in the cast product 340 by the gas from the core 320.

Next, the aluminum cast product 340 incorporated with the core 320 is treated in the molten aluminum 380 or fluidized layer 385 as described above, whereby the thermosetting resin in the core 320 decomposes, and then the core 320 is removed from the aluminum cast product 340.

The aluminum cast product 340 coated with the copper plating 389 inside as shown in FIG. 44 is obtained in this manner. In this case, the solder coating layer 390 functions to enhance bonding strength between the aluminum cast product 340 and the copper plating 389.

Further, the material for the core 320 may be the same as the one in the embodiment shown in FIG. 26 to FIG. 39B.

According to the present invention, the inner surface of cast product can be easily formed by the core upon casting. The core is then removed from the cast product, whereby the cast product having a desired shape of inner surface can be readily and simply obtained.

What is claimed is:

1. A casting method using a forming die for formation of an outer surface of a cast product, comprising the steps of:

providing the forming die having inner side surfaces and outer mount surfaces, the die being made of a plastic material;

setting the forming die, for formation of the outer surface of the cast product, on an inner surface of a cavity of a casting die;

pouring a molten metal into the cavity of the casting die to form the cast product including projecting portions communicating between the inner side surfaces and the outer mount surfaces of the forming die; and taking the cast product and the forming die out of the casting die.

2. A casting method according to claim 1, wherein the forming die has a plastic material, and the method further comprises a step of heating the cast product and forming die to make the forming die semi-melted so as to remove the forming die from the cast product.

3. A casting method according to claim 1, wherein the forming die has a plastic material, and the method further comprises a step of immersing the cast product and forming die in a solvent to dissolve the forming die so as to remove the forming die from the cast product.

4. A casting method according to claim 1, wherein the forming die has a plastic material, and the method further comprises a step of subjecting the cast product and forming die to a shot blast treatment so as to remove the forming die from the cast product.

5. A casting method according to claim 1, wherein the forming die has a plastic material, and the method further comprises a step of spraying high-temperature and high-pressure steam onto the cast product and forming die so as to remove the forming die from the cast product.

6. A casting method according to claim 1, wherein the forming die has a rubber material, and the method further comprises a step of heating the cast product and the forming die to make the forming die semi-molten so as to remove the forming die from the cast product.

7. A casting method according to claim 1, wherein the forming die has a rubber material, the method further comprises a step of immersing the cast product and the forming die in a solvent to dissolve the forming die so as to remove the forming die from the cast product.

8. A casting method according to claim 1, wherein the forming die has a rubber material, the method further comprises a step of subjecting the cast product and the forming die to a shot blast treatment so as to remove the forming die from the cast product.

9. A casting method according to claim 1, wherein the forming die has a rubber material, the method further comprises a step of spraying high-temperature and high-pressure steam onto the cast product and the forming die so as to remove the forming die from the cast product.

10. A casting method according to claim 1, wherein the forming die is made of paper, the method further comprises a step of heating the cast product and forming die to burn the forming die so as to remove the forming die thereby.

11. A casting method according to claim 1, wherein the forming die has a plastic material and powder graphite, and the method further comprises a step of heating the cast product and forming die to make the forming die semi-melted so as to remove the forming die from the cast product.

12. A casting method according to claim 1, wherein the forming die has a plastic material and powder graphite, and the method further comprises a step of immersing the cast product and forming die in a solvent to dissolve the forming die so as to remove the forming die from the cast product.

13. A casting method according to claim 1, wherein the forming die has a rubber material and powder graphite, and the method further comprises a step of heating the cast product and the forming die to make the forming die semi-molten so as to remove the forming die from the cast product.

14. A casting method according to claim 1, wherein the forming die has a rubber material and powder graphite, and the method further comprises a step of immersing the cast product and the forming die in a solvent to dissolve the forming die so as to remove the forming die from the cast product.

15. A casting method using a forming die for formation of an outer surface of a cast product, comprising:

providing the forming die having inner side surfaces and outer mount surfaces;

setting the forming die, for formation of the outer surface, containing an organic material, on an inner surface of a cavity of a casting die;

pouring a molten metal into the cavity of the casting die to form cast product including projecting portions communicating between the inner side surfaces and the outer mount surfaces of the forming die;

taking the cast product and the forming die out of the casting die; and subjecting the cast product and the forming die to a salt bath treatment in a molten salt to decompose the organic material in the forming die into sludge of inorganic material, and gas.

16. A casting method according to claim 15, wherein further comprises a step of neutralizing the cast product in an acid solution after the salt bath treatment, and a step of washing the cast product in water at a high temperature.

17. A casting method using a casting core and a forming die for formation of an outer surface of a cast product, comprising the steps of:

providing the forming die having inner side surfaces and outer mount surfaces;

setting the forming die, for formation of the outer surface, containing an organic material and the core containing an organic material, in a cavity of a casting die;

pouring a molten metal into the cavity of the casting die to form the cast product including projecting portions communicating between the inner side surfaces and the outer mount surfaces of the forming die;

taking the cast product, the forming die, and the core out of the casting die; and subjecting the cast product, the forming die, and the core to a salt bath treatment in a molten salt to decompose the organic materials in the forming die and the core into sludge of inorganic materials, and gas.

18. A casting method according to claim 17, wherein the method further comprises a step of neutralizing the cast product in an acid solution after the salt bath treatment, and a step of washing the cast product in water at a high temperature.

19. A casting method using a forming die for formation of an outer surface of a cast product, comprising:

providing the forming die having inner side surfaces and outer mount surfaces;

setting the forming die, for formation of the outer surface, containing an organic material, on an inner surface of a cavity of a casting die;

pouring a molten metal into the cavity of the casting die to form the cast product including projecting portions communicating between the inner side surfaces and the outer mount surfaces of the forming die;

taking the cast product and the forming die out of the casting die;

heating the cast product and the forming die so as to flow the organic material in the forming die; and subjecting the cast product to a salt bath treatment in a molten salt to decompose the rest of the organic material of the foreign die into sludge of inorganic materials, and gas.

20. A casting method using a forming die for formation of an outer surface of a cast product, comprising:

providing the forming die having inner side surfaces and outer mount surfaces;

setting the foreign die, for formation of the outer surface, containing an organic material, on an inner surface of a cavity of a casting die;

pouring a molten metal into the cavity of the casting die to form the cast product including projecting portions communicating between the inner side surfaces and the outer mount surfaces of the forming die;

taking the cast product and the forming die out of the casting die;

heating the cast product and the forming die so as to flow the organic material in the forming die; and immersing the cast product in a solvent to dissolve the rest of the organic material of the forming die.

21. A casting method using a forming die for formation of an outer surface of a cast product, comprising:

providing the forming die having inner side surfaces and outer mount surfaces;

setting the forming die, for formation of the outer surface, containing an organic material, on an inner surface of a cavity of a casting die;

pouring a molten metal into the cavity of the casting die to form the cast product including projecting portions communicating between the inner side surfaces and the outer mount surfaces of the forming die;

taking the cast product and the forming die out of the casting die;

heating the cast product and the forming die so as to flow the organic material in the forming die; and subjecting the cast product to a heat treatment in a fluidized layer composed of alumina fine particles or sand fine particles heated to a high temperature, to decompose the rest of the organic material of the forming die into gas.

22. A casting method using a casting core and a forming die for formation of an outer surface of a cast product, comprising:

providing the forming die having inner side surfaces and outer mount surfaces;

setting the forming die, for formation of the outer surface, containing an organic material and the casting core containing an organic material, in a cavity of a casting die;

pouring a molten metal into the cavity of the casting die to form the cast product including projecting portions communicating between the inner side surfaces and the outer mount surfaces of the forming die;

taking the cast product, the forming die and the casting core out of the casting die;

heating the cast product, the forming die and the casting core so as to flow the organic materials in the forming die and the core; and subjecting the cast product to a salt bath treatment in a molten salt to decompose the rest of the organic materials of the forming die and the core into sludge of inorganic materials, and gas.

23. A casting method using a casting core and a forming die for formation of an outer surface of a cast product, comprising:

providing the forming die having inner side surfaces and outer mount surfaces:

setting the forming die, for formation of the outer surface, containing an organic material, and the casting core containing an organic material in a cavity of a casting die;

pouring a molten metal into the cavity of the casting die to form the cast product including projecting portions communicating between the inner side surfaces and the outer mount surfaces of the forming die;

taking the cast product, the forming die and the casting core out of the casting die;

heating the cast product, the forming die and the casting core so as to flow the organic materials in the forming die and the core; and immersing the cast product in a solvent to dissolve the rest of the organic materials of the forming die and the core.

24. A casting method using a forming die for formation of an outer surface of a cast product, comprising:

providing the forming die having inner side surfaces and outer mount surfaces;

setting the forming die, for formation of the outer surface, containing an organic material and a casting core containing an organic material, in a cavity of a casting die;

pouring a molten metal into the cavity of the casting die to form the cast product including projecting portions communicating between the inner side surfaces and the outer mount surfaces of the forming die;

taking the cast product, the forming die and the casting core out of the casting die;

heating the cast product, the forming die and the casting core so as to flow the organic materials in the forming die and the core; and subjecting the cast product to a heat treatment in a fluidized layer composed of alumina fine particles or sand fine particles heated to a high temperature, to decompose the rest of the organic materials of the forming die and the core into gas.

* * * * *